US011107414B2

(12) United States Patent
Feng et al.

(10) Patent No.: US 11,107,414 B2
(45) Date of Patent: Aug. 31, 2021

(54) ELECTRONIC PANEL, DISPLAY DEVICE AND DRIVING METHOD

(71) Applicants: HEFEI BOE JOINT TECHNOLOGY CO., LTD., Hefei (CN); BOE TECHNOLOGY GROUP CO., LTD., Beijing (CN)

(72) Inventors: Xuehuan Feng, Beijing (CN); Can Yuan, Beijing (CN); Yongqian Li, Beijing (CN)

(73) Assignees: HEFEI BOE JOINT TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/754,200

(22) PCT Filed: Sep. 26, 2019

(86) PCT No.: PCT/CN2019/108149
§ 371 (c)(1),
(2) Date: Apr. 7, 2020

(87) PCT Pub. No.: WO2020/082978
PCT Pub. Date: Apr. 30, 2020

(65) Prior Publication Data

US 2021/0201805 A1 Jul. 1, 2021

(30) Foreign Application Priority Data

Oct. 24, 2018 (CN) ..... 201811244288.1

(51) Int. Cl.
*G09G 3/3266* (2016.01)
*G09G 3/3258* (2016.01)
*G09G 3/3275* (2016.01)

(52) U.S. Cl.
CPC ..... *G09G 3/3266* (2013.01); *G09G 3/3258* (2013.01); *G09G 3/3275* (2013.01); *G09G 2310/0286* (2013.01)

(58) Field of Classification Search
CPC .. G09G 3/3266; G09G 3/3258; G09G 3/3275; G09G 2310/0286; G09G 3/3208–3291
See application file for complete search history.

(56) References Cited

U.S. PATENT DOCUMENTS 10,366,651 B2 7/2019 Ha
2008/0129652 A1 6/2008 Park
(Continued)

FOREIGN PATENT DOCUMENTS

CN 101093304 A 12/2007
CN 103578411 A 2/2014
(Continued)

OTHER PUBLICATIONS

First Chinese Office Action in priority to Chinese Patent Application No. 201811244288.1 dated Dec. 26, 2019.

*Primary Examiner* — Roberto W Flores
(74) *Attorney, Agent, or Firm* — Dilworth & Barrese, LLP.; Michael J. Musella, Esq.

(57) ABSTRACT

An electronic panel, a display device and a driving method are disclosed. In the electronic panel, each row of subpixel units is divided into a plurality of subpixel unit groups, and each subpixel unit group includes a first subpixel unit and a second subpixel unit. The first subpixel unit includes a first light emitter unit, a first pixel driving circuit for driving the first light emitter unit to emit light, and a first sensing circuit for sensing the first pixel driving circuit; the second subpixel unit includes a second light emitter unit, a second pixel
(Continued)

driving circuit for driving the second light emitter unit to emit light, and a second sensing circuit for sensing the second pixel driving circuit.

20 Claims, 18 Drawing Sheets

(56) References Cited

U.S. PATENT DOCUMENTS

| | | | | |
|---|---|---|---|---|
| 2010/0156875 | A1 | 6/2010 | Kim et al. | |
| 2014/0022289 | A1 | 1/2014 | Lee et al. | |
| 2015/0062192 | A1* | 3/2015 | Kim | G09G 3/3291 345/690 |
| 2015/0138177 | A1* | 5/2015 | Kwon | G09G 3/3233 345/211 |
| 2017/0061865 | A1* | 3/2017 | Park | G09G 3/325 |
| 2017/0132977 | A1* | 5/2017 | Kim | G09G 3/3266 |
| 2017/0169767 | A1* | 6/2017 | Song | G09G 3/3291 |
| 2017/0193923 | A1 | 7/2017 | Park et al. | |
| 2017/0242533 | A1* | 8/2017 | Liu | G06F 3/04166 |
| 2018/0090043 | A1 | 3/2018 | Zhou et al. | |
| 2018/0190192 | A1 | 7/2018 | Kwon et al. | |

FOREIGN PATENT DOCUMENTS

| | | | |
|---|---|---|---|
| CN | 106960658 | A | 7/2017 |
| CN | 107068065 | A | 8/2017 |
| CN | 107464519 | A | 12/2017 |
| CN | 108269537 | A | 7/2018 |
| CN | 108648716 | A | 10/2018 |
| CN | 108648718 | A | 10/2018 |
| CN | 108682398 | A | 10/2018 |
| CN | 109166527 | A | 1/2019 |
| CN | 109166529 | A | 1/2019 |
| CN | 109935212 | A | 6/2019 |

* cited by examiner

ELECTRONIC PANEL, DISPLAY DEVICE AND DRIVING METHOD

CROSS-REFERENCE TO RELATED APPLICATION

The present application claims priority of the Chinese Patent Application No. 201811244288.1 filed on Oct. 24, 2018, the disclosure of which is incorporated herein by reference in its entirety as part of the present application.

TECHNICAL FIELD

The embodiments of the present disclosure relate to an electronic panel, a display device and a driving method.

BACKGROUND

In the display field, especially in an OLED (organic light-emitting diode) display panel, a gate driving circuit is currently generally integrated in a GATE IC. The area of the chip in the IC design is the main factor affecting the cost of the chip. How to effectively reduce the area of the chip is a technical developer's important consideration.

At present, the gate driving circuit of the OLED display panel usually includes three sub-circuits, namely a detection circuit, a display circuit, and a connection circuit (or gate circuit) that outputs a composite pulse of the detection circuit and the display circuit. Such a circuit structure is very complicated and cannot meet the requirements of the high-resolution narrow bezel of the display panel.

SUMMARY

At least one embodiment provides an electronic panel which includes a plurality of subpixel units arranged in an array and a gate driving circuit, the array includes N rows and M columns. Each row of subpixel units is divided into a plurality of subpixel unit groups, and each subpixel unit group includes a first subpixel unit and a second subpixel unit; the first subpixel unit includes a first light emitter unit, a first pixel driving circuit configured to drive the first light emitter unit to emit light, and a first sensing circuit configured to sense the first pixel driving circuit; the second subpixel unit includes a second light emitter unit, a second pixel driving circuit configured to drive the second light emitter unit to emit light, and a second sensing circuit configured to sense the second pixel driving circuit.

The gate driving circuit includes N+1 output terminal groups arranged in sequence, each output terminal group includes a first output terminal and a second output terminal, a plurality of first output terminals in the N+1 output terminal groups are configured to output a first gate scanning signal that turns on a plurality of first subpixel units in the N rows of the subpixel units of the array row by row, and a plurality of second output terminals in the N+1 output terminal groups are configured to output a second gate scanning signal that turns on a plurality of second subpixel units in the N rows of the subpixel units of the array row by row.

The first pixel driving circuit of the first subpixel unit in the subpixel unit group of an nth row among the N rows is connected to the first output terminal of an nth output terminal group among the N+1 output terminal groups of the gate driving circuit to receive the first gate scanning signal as a first scanning driving signal, and the first sensing circuit of the first subpixel unit in the subpixel unit group of the nth row is connected to the first output terminal of an (n+1)th output terminal group among the N+1 output terminal groups of the gate driving circuit to receive the first gate scanning signal as a first sensing driving signal.

The second pixel driving circuit of the second subpixel unit in the subpixel unit group of the nth row is connected to the second output terminal of the nth output terminal group of the gate driving circuit to receive the second gate scanning signal as a second scanning driving signal, and the second sensing circuit of the second subpixel unit in the subpixel unit group of the nth row is connected to the second output terminal of the (n+1)th output terminal group of the gate driving circuit to receive the second gate scanning signal as a second sensing driving signal; $1 \leq n \leq N$, and N and M are integers greater than or equal to 2.

For example, in the electronic panel provided by at least one embodiment of the present disclosure, the first pixel driving circuit includes a first data writing circuit, a first driving circuit and a first charge storage circuit. The first driving circuit is connected to the first data writing circuit, the first charge storage circuit, the first light emitter unit and the first sensing circuit, and the first driving circuit is configured to control a first driving current for driving the first light emitter unit to emit light; the first data writing circuit is further connected to the first charge storage circuit, and the first data writing circuit is configured to receive the first scanning driving signal and write a first data signal to the first driving circuit in response to the first scanning driving signal; the first sensing circuit is further connected to the first charge storage circuit and the first light emitter unit, and the first sensing circuit is configured to receive the first sensing driving signal, and write a first reference voltage signal to the first driving circuit in response to the first sensing driving signal or read the first sensing voltage signal from the first driving circuit; and the first charge storage circuit is further connected to the first light emitter unit and is configured to store the first data signal and the first reference voltage signal which are written.

For example, in the electronic panel provided by at least one embodiment of the present disclosure, the second pixel driving circuit includes a second data writing circuit, a second driving circuit and a second charge storage circuit. The second driving circuit is connected to the second data writing circuit, the second charge storage circuit, the second light emitter unit and the second sensing circuit, and the second driving circuit is configured to control a second driving current for driving the second light emitter unit to emit light; the second data writing circuit is further connected to the second charge storage circuit, and the second data writing circuit is configured to receive the second scanning driving signal and write a second data signal to the second driving circuit in response to the second scanning driving signal; the second sensing circuit is further connected to the second charge storage circuit and the second light emitter unit, and the second sensing circuit is configured to receive the second sensing driving signal, and write a second reference voltage signal to the second driving circuit in response to the second sensing driving signal or read the second sensing voltage signal from the second driving circuit; and the second charge storage circuit is further connected to the second light emitter unit and is configured to store the second data signal and the second reference voltage signal which are written.

For example, the electronic panel provided by at least one embodiment of the present disclosure further includes a plurality of data lines and a plurality of sensing lines. The first data writing circuit and the second data writing circuit which are in each subpixel unit group are connected to the same data line among the plurality of data lines; the first sensing circuit and the second sensing circuit which are in each subpixel unit group are connected to the same sensing line among the plurality of sensing lines.

For example, in the electronic panel provided by at least one embodiment of the present disclosure further includes 2N+2 gate lines arranged in sequence; the 2N+2 gate lines are respectively connected to the N+1 first output terminals of the gate driving circuit and the N+1 second output terminals of the gate driving circuit in a one-to-one manner; the first data writing circuit in the subpixel unit group of the nth row is connected to the first output terminal in the nth output terminal group of the gate driving circuit through a (2n−1)th gate line among the 2N+2 gate lines; the second data writing circuit in the subpixel unit group of the nth row is connected to the second output terminal in the nth output terminal group of the gate driving circuit through a (2n)th gate line among the 2N+2 gate lines; the first sensing circuit in the subpixel unit group of the nth row is connected to the first output terminal in the (n+1)th output terminal group of the gate driving circuit through a (2n+1)th gate line among the 2N+2 gate lines; the second sensing circuit in the subpixel unit group of the nth row is connected to the second output terminal in the (n+1)th output terminal group of the gate driving circuit through a (2n+2)th gate line among the 2N+2 gate lines.

For example, in the electronic panel provided by at least one embodiment of the present disclosure, the first data writing circuit includes a first scanning transistor, the first driving circuit includes a first driving transistor, the first sensing circuit includes a first sensing transistor, and the first charge storage circuit includes a first storage capacitor; a gate electrode of the first scanning transistor is configured to receive the first scanning driving signal, a first electrode of the first scanning transistor is configured to receive the first data signal, and a second electrode of the first scanning transistor is connected to a gate electrode of the first driving transistor; a first electrode of the first driving transistor is configured to receive a first driving voltage for generating the first driving current, and a second electrode of the first driving transistor is connected to a first electrode of the first sensing transistor; a gate electrode of the first sensing transistor is configured to receive the first sensing driving signal, and a second electrode of the first sensing transistor is configured to receive the first reference voltage signal or output the first sensing voltage signal; and a first electrode of the first storage capacitor is connected to a gate electrode of the first driving transistor, and a second electrode of the first storage capacitor is connected to the second electrode of the first driving transistor.

For example, in the electronic panel provided by at least one embodiment of the present disclosure, the second data writing circuit includes a second scanning transistor, the second driving circuit includes a second driving transistor, the second sensing circuit includes a second sensing transistor, and the second charge storage circuit includes a second storage capacitor; a gate electrode of the second scanning transistor is configured to receive the second scanning driving signal, a first electrode of the second scanning transistor is configured to receive the second data signal, and a second electrode of the second scanning transistor is connected to a gate electrode of the second driving transistor; a first electrode of the second driving transistor is configured to receive a first driving voltage for generating the second driving current, and a second electrode of the second driving transistor is connected to a first electrode of the second sensing transistor; a gate electrode of the second sensing transistor is configured to receive the second sensing driving signal, and a second electrode of the second sensing transistor is configured to receive the second reference voltage signal or output the second sensing voltage signal; and a first electrode of the second storage capacitor is connected to a gate electrode of the second driving transistor, and a second electrode of the second storage capacitor is connected to the second electrode of the second driving transistor.

For example, the electronic panel provided by at least one embodiment of the present disclosure further includes a plurality of data lines and a plurality of sensing lines; the first pixel driving circuit and the second pixel driving circuit which are in each subpixel unit group are connected to the same data line among the plurality of data lines; the first sensing circuit and the second sensing circuit which are in each subpixel unit group are connected to the same sensing line among the plurality of sensing lines.

For example, the electronic panel provided by at least one embodiment of the present disclosure further includes 2N+2 gate lines arranged in sequence; the 2N+2 gate lines are respectively connected to the N+1 first output terminals of the gate driving circuit and the N+1 second output terminals of the gate driving circuit in a one-to-one manner; the first pixel driving circuit in the subpixel unit group of the nth row is connected to the first output terminal in the nth output terminal group of the gate driving circuit through a (2n−1)th gate line among the 2N+2 gate lines; the second pixel driving circuit in the subpixel unit group of the nth row is connected to the second output terminal in the nth output terminal group of the gate driving circuit through a (2n)th gate line among the 2N+2 gate lines; the first sensing circuit in the subpixel unit group of the nth row is connected to the first output terminal in the (n+1)th output terminal group of the gate driving circuit through a (2n+1)th gate line among the 2N+2 gate lines; the second sensing circuit in the subpixel unit group of the nth row is connected to the second output terminal in the (n+1)th output terminal group of the gate driving circuit through a (2n+2)th gate line among the 2N+2 gate lines.

It should be noted that, for illustration, FIG. 1 to FIG. 3 only shows three rows of subpixel units and shows that each row includes one subpixel unit group. For a plurality of subpixel unit groups in the same row of subpixel units (for example, the nth row of subpixel units), the plurality of subpixel unit groups share the gate lines GL<2n−1> and GL<2n>.

For example, in the electronic panel provided by at least one embodiment of the present disclosure, the gate driving circuit includes a plurality of shift register units which are cascaded, and the shift register unit includes a first sub-unit, a second sub-unit and a blanking input sub-unit. The first sub-unit includes a first input circuit and a first output circuit, the first input circuit is configured to control a level of a first node in response to a first input signal, and the first output circuit is configured to output a shift signal, a first output signal and a third output signal under control of the level of the first node; the second sub-unit includes a second input circuit and a second output circuit, the second input circuit is configured to control a level of a second node in response to the first input signal, and the second output circuit is configured to output a second output signal and a fourth output signal under control of the level of the second node; and the blanking input sub-unit is connected to the first node and the second node, and is configured to receive a selection control signal and control the level of the first node and the level of the second node.

For example, in the electronic panel provided by at least one embodiment of the present disclosure, the blanking input sub-unit includes a selection control circuit, a third input circuit, a first transmission circuit and a second transmission circuit. The selection control circuit is configured to control a level of a third node by using a second input signal in response to the selection control signal and maintain the level of the third node; the third input circuit is configured to control a level of a fourth node under control of the level of the third node; the first transmission circuit is electrically connected to the first node and the fourth node, and is configured to control the level of the first node under control of the level of the fourth node or under control of a first transmission signal; and the second transmission circuit is electrically connected to the second node and the fourth node, and is configured to control the level of the second node under control of the level of the fourth node or under control of a second transmission signal.

For example, in the electronic panel provided by at least one embodiment of the present disclosure, the first sub-unit further includes a first control circuit, a first reset circuit, a second reset circuit, a shift signal output terminal, a first output signal terminal and a third output signal terminal; the second sub-unit further includes a second control circuit, a third reset circuit, a fourth reset circuit, a second output signal terminal and a fourth output signal terminal.

The shift signal output terminal is configured to output the shift signal, the first output signal terminal is configured to output the first output signal, the third output signal terminal is configured to output the third output signal, the second output signal terminal is configured to output the second output signal, and the fourth output signal terminal is configured to output the fourth output signal.

The first control circuit is configured to control a level of a fifth node under control of both the level of the first node and a second voltage; the first reset circuit is configured to reset the first node, the shift signal output terminal, the first output signal terminal and the third output signal terminal under control of the level of the fifth node; the second reset circuit is configured to reset the first node, the shift signal output terminal, the first output signal terminal and the third output signal terminal under control of a level of a sixth node.

The second control circuit is configured to control the level of the sixth node under control of the level of the second node and a third voltage; the third reset circuit is configured to reset the second node, the second output signal terminal and the fourth output signal terminal under control of the level of the sixth node; and the fourth reset circuit is configured to reset the second node, the second output signal terminal and the fourth output signal terminal under control of the level of the fifth node.

For example, in the electronic panel provided by at least one embodiment of the present disclosure, the blanking input sub-unit further includes a common reset circuit; the common reset circuit is electrically connected to the fourth node, the fifth node and the sixth node, and is configured to reset the fourth node under control of the level of the fifth node or the level of the sixth node.

For example, in the electronic panel provided by at least one embodiment of the present disclosure, the first sub-unit further includes a third control circuit and a fourth control circuit, the third control circuit is configured to control the level of the fifth node in response to a first clock signal, and the fourth control circuit is configured to control the level of the fifth node in response to the first input signal; and the second sub-unit further includes a fifth control circuit and a sixth control circuit, the fifth control circuit is configured to control the level of the sixth node in response to the first clock signal, and the sixth control circuit is configured to control the level of the sixth node in response to the first input signal.

For example, in the electronic panel provided by at least one embodiment of the present disclosure, the electronic panel is a display panel; the first sub-unit further includes a fifth reset circuit and a sixth reset circuit, the fifth reset circuit is configured to reset the first node in response to a display reset signal, and the sixth reset circuit is configured to reset the first node in response to a global reset signal; and the second sub-unit further includes a seventh reset circuit and an eighth reset circuit, the seventh reset circuit is configured to reset the second node in response to the display reset signal, and the eighth reset circuit is configured to reset the second node in response to the global reset signal.

For example, in the electronic panel provided by at least one embodiment of the present disclosure, the shift register unit further includes a common electric-leakage prevention circuit, a first electric-leakage prevention circuit and a second electric-leakage prevention circuit; the common electric-leakage prevention circuit is electrically connected to the first node and a seventh node, and is configured to control a level of the seventh node under control of the level of the first node; the first electric-leakage prevention circuit is electrically connected to the seventh node, the first reset circuit, the second reset circuit, the fifth reset circuit and the sixth reset circuit, and is configured to prevent electric leakage at the first node under control of the level of the seventh node; and the second electric-leakage prevention circuit is electrically connected to the seventh node, the third reset circuit, the fourth reset circuit, the seventh reset circuit and the eighth reset circuit, and is configured to prevent electric leakage at the second node under control of the level of the seventh node.

At least one embodiment of the present disclosure further provides a display device which includes the electronic panel according to any one of the embodiments of the present disclosure.

At least one embodiment of the present disclosure further provides a driving method of the electronic panel according to any one of the embodiments of the present disclosure, the electronic panel is a display panel, and in the driving method, a period for one frame includes a display period and a blanking period. During the display period, in each subpixel unit group, the first pixel driving circuit drives the first light emitter unit to emit light in a first stage, and the second pixel driving circuit drives the second light emitter unit to emit light in a second stage; wherein the first stage is different from the second stage.

For example, in the driving method provided by at least one embodiment of the present disclosure, during the blanking period, an i-th row of subpixel unit groups is randomly selected from the N rows of subpixel unit groups, so that the first sensing circuit in each subpixel unit group of the i-th row or the second sensing circuit in each subpixel unit group of the i-th row perform sensing; wherein $1 \leq i \leq N$.

For example, in the driving method provided by at least one embodiment of the present disclosure, during the blanking period, an i-th row of subpixel unit groups is randomly selected from the N rows of subpixel unit groups, so that the first sensing circuit in each subpixel unit group of the i-th row and the second sensing circuit in each subpixel unit group of the i-th row perform sensing; wherein $1 \leq i \leq N$.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

Figure 1:
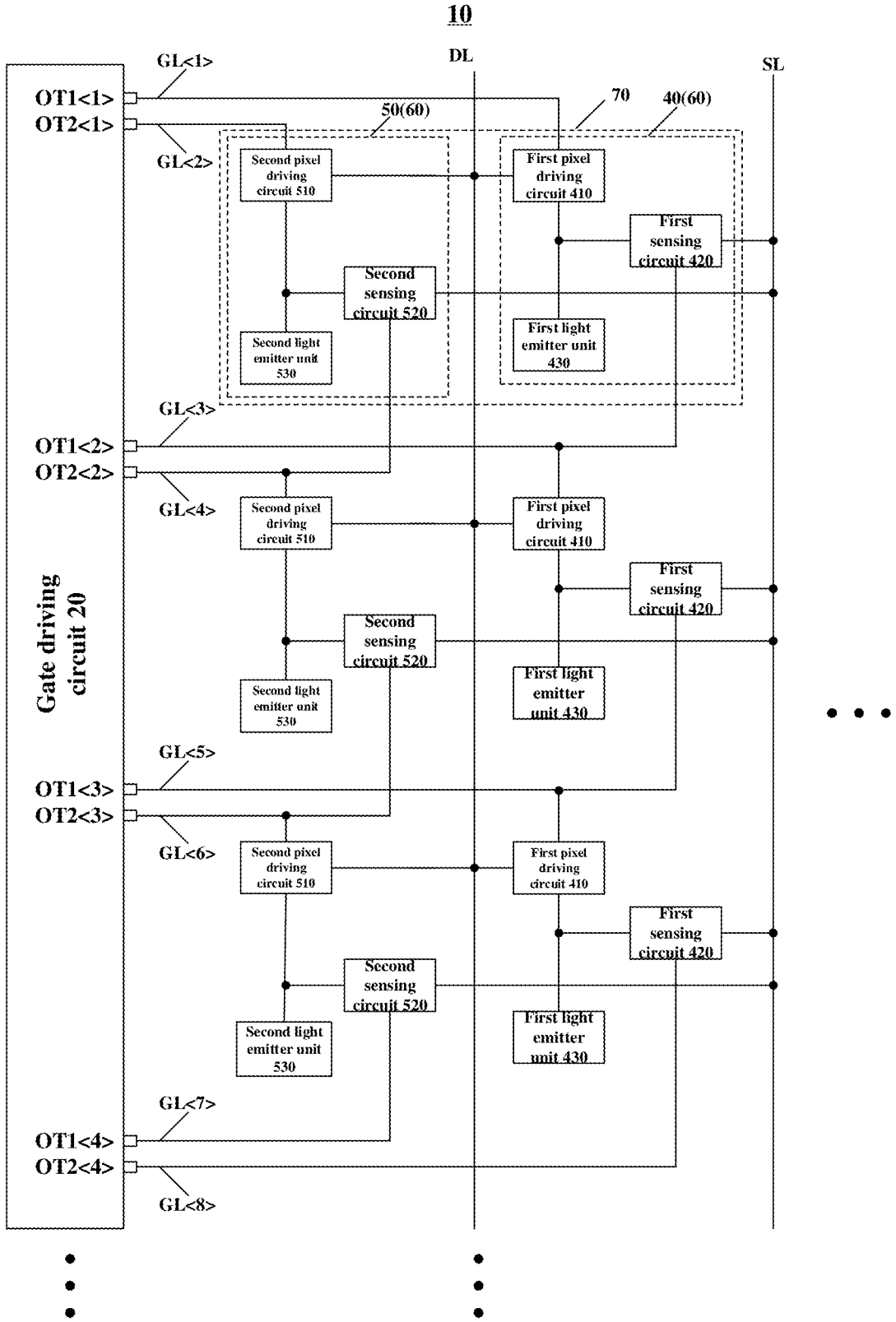
FIG. 1 is a schematic diagram of a display panel provided by at least one embodiment of the present disclosure.

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms "first," "second," etc., which are used in the description and the claims of the present application for invention, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In compensating a subpixel unit in an OLED display panel, in addition to setting a pixel compensation circuit in the subpixel unit for internal compensation, external compensation can also be performed by setting a sensing transistor. In performing the external compensation, a gate driving circuit formed of a shift register unit needs to respectively provide driving signals for a scanning transistor and the sensing transistor to the subpixel unit in the display panel; for example, a scanning driving signal for the scanning transistor is provided in a display period of one frame, and a sensing driving signal for the sensing transistor is provided in a blanking period of one frame.

In an external compensation method, the sensing driving signal output by the gate driving circuit is sequentially scanned row by row. For example, the sensing driving signal for the subpixel units of the first row in the display panel is output during the blanking period of the first frame, the sensing driving signal for the subpixel units of the second row in the display panel is output during the blanking period of the second frame, and so on. The sensing driving signal is sequentially output row by row in a frequency that the sensing driving signal corresponding to the subpixel units of one row is output in each frame, and thus the row-by-row sequential compensation of the display panel is completed.

However, the use of the above-mentioned row-by-row sequential compensation method may generate display defects: on one hand, there is a scanning line that moves progressively during a scanning display process of multiple frames; on the other hand, a large difference in the brightness between different regions of the display panel is caused due to the difference between time points of performing the external compensation. For example, in performing the external compensation on the subpixel units of the 100th row in the display panel, although the subpixel units of the 10th row in the display panel has already undergone the external compensation, the luminous brightness of the subpixel units of the 10th row may be already changed at this time, for example, the luminous brightness is reduced, which may cause uneven brightness in different regions of the display panel. This phenomenon is more obvious in large-sized display panels.

As described above, in the case where the gate driving circuit drives a plurality of rows of subpixel units in the display panel, in order to realize the external compensation, the gate driving circuit is required to not only output the scanning driving signal for the display period, but also output the sensing driving signal for the blanking period.

Due to the high cost of data driving circuits (chips), in order to reduce the number of the data driving circuits (the chips), two columns (adjacent columns or non-adjacent columns) of the subpixel units can share one data line in the display panel including N rows of subpixel units, thus the number of data lines can be reduced by half, and thus cost is reduced. For the above display panel, the gate driving circuit needs to be provided with 4N output terminals. In this case, the area occupied by the gate driving circuit may be relatively large, so the size of the frame of the display device using the gate driving circuit is relatively large, and it is difficult to increase the PPI (pixels per inch) of the display device.

At least one embodiment of the present disclosure provides an electronic panel including a plurality of subpixel units arranged in an array and a gate driving circuit, and the array includes N rows and M columns. Each row of subpixel units is divided into a plurality of subpixel unit groups, and each subpixel unit group includes a first subpixel unit and a second subpixel unit.

The first subpixel unit includes a first light emitter unit, a first pixel driving circuit for driving the first light emitter unit to emit light, and a first sensing circuit for sensing the first pixel driving circuit; the second subpixel unit includes a second light emitter unit, a second pixel driving circuit for driving the second light emitter unit to emit light, and a second sensing circuit for sensing the second pixel driving circuit.

The gate driving circuit includes N+1 output terminal groups arranged in sequence, each output terminal group includes a first output terminal and a second output terminal, and a plurality of first output terminals in the N+1 output terminal groups are configured to output first gate scanning signals that turn on a plurality of first subpixel units in the N rows of subpixel units of the array row by row, and a plurality of second output terminals in the N+1 output terminal groups are configured to output second gate scanning signals that turn on a plurality of second subpixel units in the N rows of subpixel units of the array row by row.

The first pixel driving circuit in the first subpixel unit in the subpixel unit group of the nth row is connected with the first output terminal OT1<n> in the nth output terminal group of the gate driving circuit to receive the first gate scanning signal which is output from the first output terminal OT1<n> and which is used as a first scanning driving signal, and the first sensing circuit in the first subpixel unit in the subpixel unit group of the nth row is connected with the first output terminal OT1<n+1> in the (n+1)th output terminal group of the gate driving circuit to receive the first gate scanning signal which is output by the first output terminal OT1<n+1> and which is used as a first sensing driving signal.

The second pixel driving circuit in the second subpixel unit in the subpixel unit group of the nth row is connected to the second output terminal OT2<n> in the nth output terminal group of the gate driving circuit to receive the second gate scanning signal which is output by the second output terminal OT2<n> and which is used as a second scanning driving signal, the second sensing circuit in the second subpixel unit in the subpixel unit group of the nth row is connected to the second output terminal OT2<n+1> in the (n+1)th output terminal group of the gate driving circuit to receive the second gate scanning signal which is output by the second output terminal OT2<n+1> and which is used as a second sensing driving signal; $1 \leq n \leq N$, and N and M are integers greater than or equal to 2.

Embodiments of the present disclosure also provide a display device and a driving method corresponding to the above-mentioned electronic panel.

The electronic panel, the display device and the driving method provided in the embodiments of the present disclosure enable the subpixel units of adjacent rows to share the gate scanning signal output by the gate driving circuit, thereby reducing the number of the output terminals of the gate driving circuit, further reducing the frame size of the display device using the gate driving circuit, and increasing the PPI of the display device. At the same time, the electronic panel and the corresponding display device can also achieve random compensation, which can avoid display defects such as progressive movement of the scanning line and uneven display brightness which are caused by sequential compensation.

It should be noted that, in the embodiments of the present disclosure, the random compensation refers to an external compensation method which is different from the sequential compensation; and in the random compensation, the sensing driving signal corresponding to any row of subpixel units in the electronic panel can be randomly output in the blanking period of a certain frame. The following embodiments are the same therewith, and descriptions are omitted herein.

The electronic panel in the embodiments of the present disclosure is, for example, a display panel for display or a light source for illumination, or is used for realizing a grating function, or is a panel capable of emitting light for other use.

In addition, in the embodiments of the present disclosure, for the purpose of explanation, "one frame", "each frame", or "a certain frame" are defined to include the display period and the blanking period performed in sequence; for example, the gate driving circuit outputs a driving signal (such as the first scanning driving signal and the second scanning driving signal mentioned below) in the display period, and the driving signal can drive the plurality of rows of subpixel units in the electronic panel to complete the scanning and displaying of a complete image from the first row to the last row; during the blanking period, the gate driving circuit outputs another driving signal (such as the first sensing driving signal and the second sensing driving signal mentioned below), and the another driving signal can be used to drive the sensing transistors in a certain row of subpixel units in the electronic panel to complete the external compensation of the row of subpixel units.

The embodiments of the present disclosure and examples thereof will be described in detail below with reference to the drawings. In the following embodiments, the electronic panel is used as an example for description. Embodiments of the present disclosure include, but are not limited to, the display panel.

Figure 2:
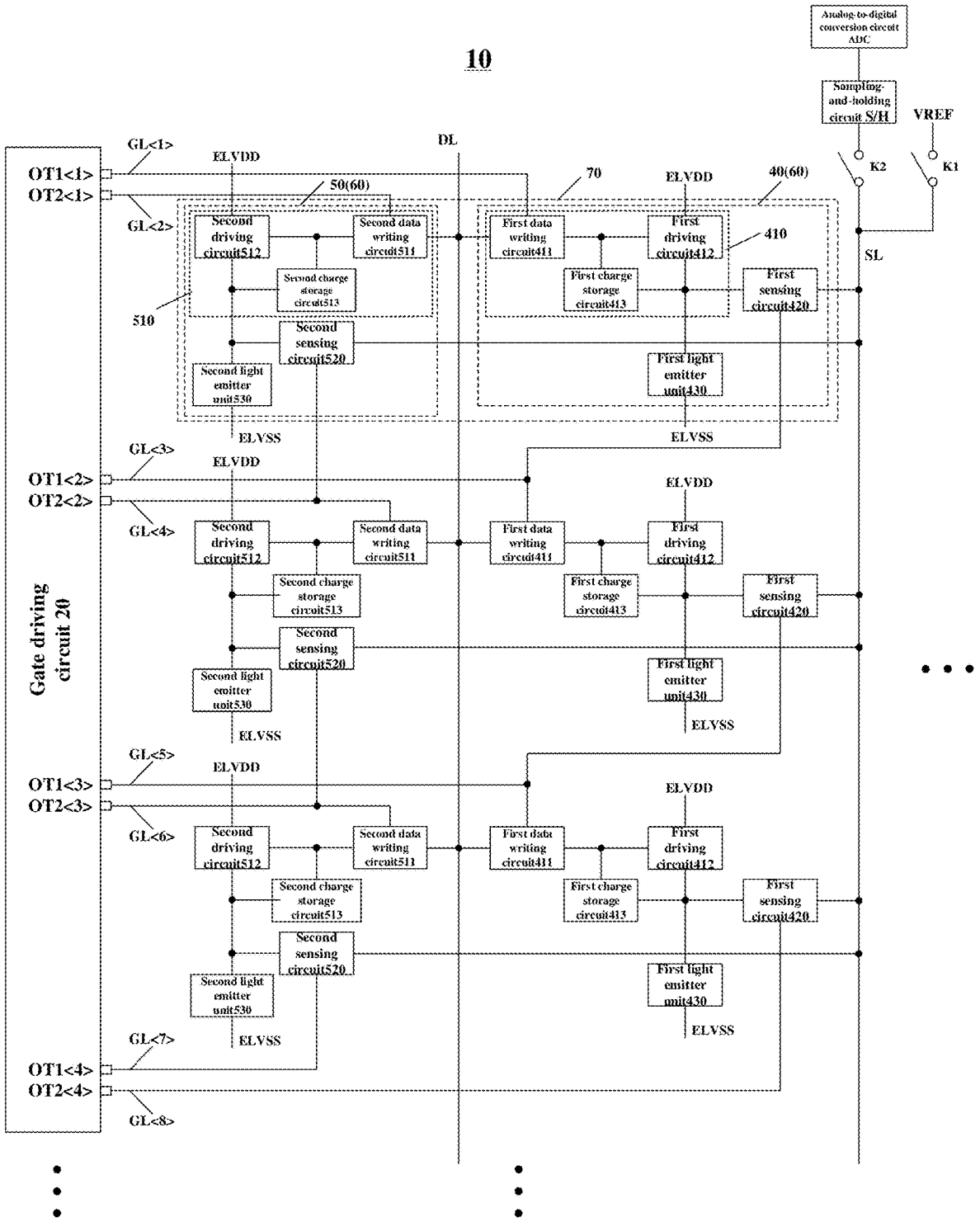
FIG. 2 is another schematic diagram of the display panel provided by at least one embodiment of the present disclosure.
Figure 3:
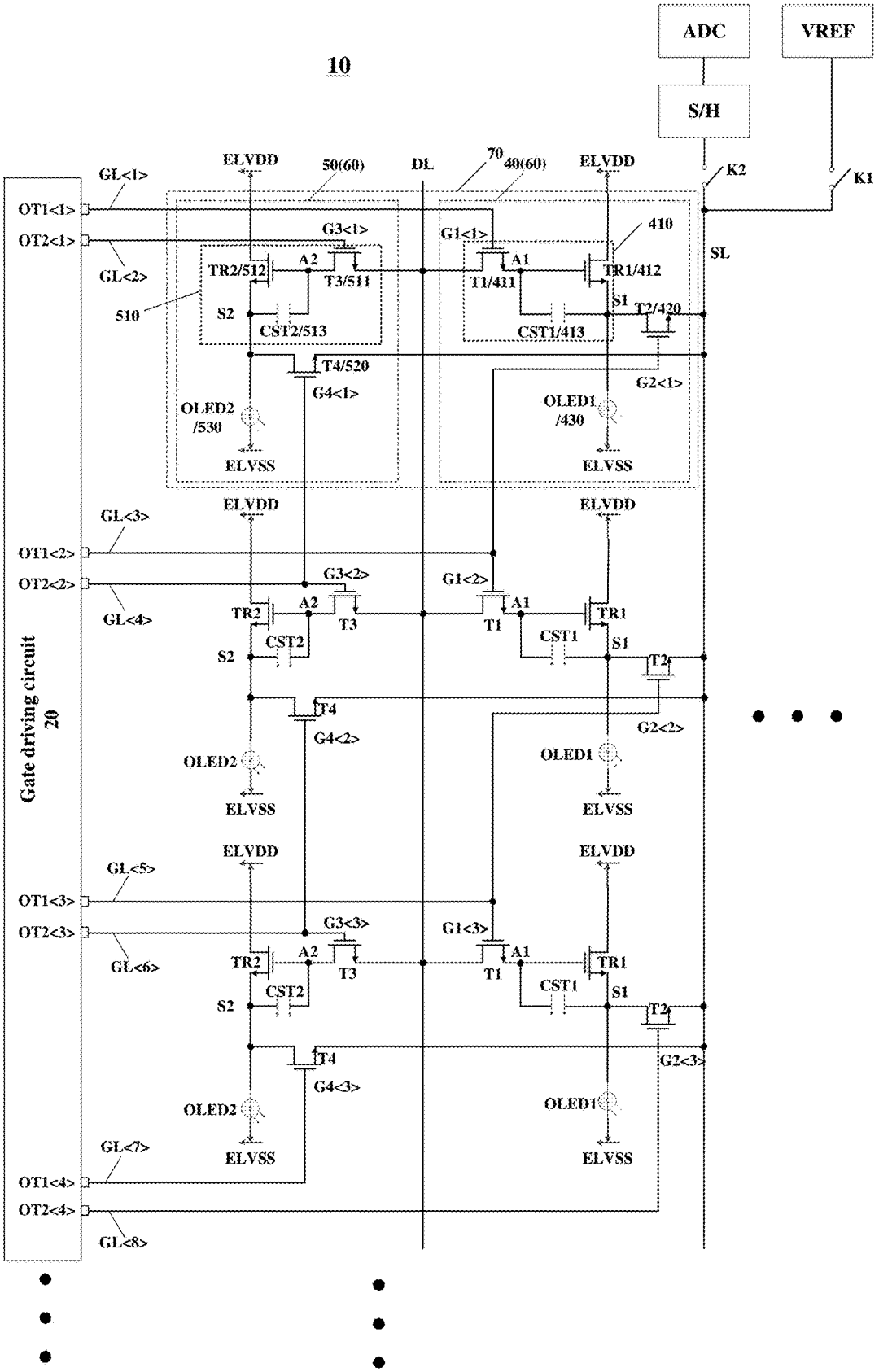
FIG. 3 is a circuit diagram of the display panel provided by at least one embodiment of the present disclosure.

At least one embodiment of the present disclosure provides the display panel 10, as shown in FIG. 1 to FIG. 3, the display panel 10 includes the plurality of subpixel units 60 arranged in an array and the gate driving circuit 20. The array includes N rows and M columns, and N and M are integers greater than or equal to 2. It should be noted that FIG. 1 to FIG. 3 only show three rows and two columns of subpixel units 60 by way of example. Embodiments of the present disclosure include, but are not limited thereto. The display panel 10 provided by the embodiments of the present disclosure may further include subpixel units of more plurality of rows and more plurality of columns.

For example, as shown in FIGS. 1 to 3, each row of subpixel units is divided into the plurality of subpixel unit groups 70, and each subpixel unit group 70 includes the first subpixel unit 40 and the second subpixel unit 50.

The first subpixel unit 40 includes the first light emitter unit 430, the first pixel driving circuit 410 for driving the first light emitter unit 430 to emit light, and the first sensing circuit 420 for sensing the first pixel driving circuit 410. For example, during the display period of one frame, the first pixel driving circuit 410 in the first subpixel unit 40 drives the first light emitter unit 430 to emit light; during the blanking period of one frame, the first sensing circuit 420 of the first subpixel unit 40 senses the first pixel driving circuit 410, thereby realizing the external compensation for the first subpixel unit 40.

The second subpixel unit 50 includes the second light emitter unit 530, the second pixel driving circuit 510 for driving the second light emitter unit 530 to emit light, and the second sensing circuit 520 for sensing the second pixel driving circuit 510. For example, the second light emitter unit 530 and the first light emitter unit 430 are configured to emit light at different stages. For example, during the display period of one frame, the second pixel driving circuit 510 in the second subpixel unit 50 drives the second light emitter unit 530 to emit light; during the blanking period of one frame, the second sensing circuit 520 in the second subpixel unit 50 senses the second pixel driving circuit 510, thereby realizing the external compensation for the second subpixel unit 50.

For example, the gate driving circuit 20 includes N+1 output terminal groups arranged in sequence, each output terminal group includes the first output terminal OT1 (one of OT1<1>, OT1<2>, OT1<3>, and OT1<4>, etc.) and the second output OT2 (one of OT2<1>, OT2<2>, OT2<3>, and OT2<4>, etc.), and the first output terminal and the second output terminal which are in the same output terminal group are adjacent to each other. For example, OT1<1> and OT2<1> form one output terminal group; OT1<2> and OT2<2> form another output terminal group; and so on.

The plurality of first output terminals OT1 in the N+1 output terminal groups are configured to output the first gate scanning signals that turn on the plurality of first subpixel units 40 in the N rows of subpixel units of the array row by row. For example, the first gate scanning signals respectively output by the N+1 first output terminals OT1 in the gate driving circuit 20 are continuous in time sequence, so that the plurality of first subpixel units 40 in the N rows of subpixel units of the array are turned on row by row.

The plurality of second output terminals OT2 in the N+1 output terminal groups are configured to output the second gate scanning signals that turn on the plurality of second subpixel units 50 in the N rows of subpixel units of the array row by row. For example, the second gate scanning signals output by the N+1 second output terminals OT2 in the gate driving circuit 20 are continuous in time sequence, so that the plurality of second subpixels units in the N rows of subpixel units of the array are turned on row by row.

It should be noted that the gate driving circuit 20 in FIG. 1 to FIG. 3 only exemplarily shows four output terminal groups. The embodiments of the present disclosure include, but are not limited thereto. The gate driving circuit 20 in the embodiments of the present disclosure can be provided with more output terminal groups as needed.

As shown in FIG. 1 to FIG. 3, the first pixel driving circuit 410 in the first subpixel unit 40 in the subpixel unit group of the nth row is connected to the first output terminal OT1<n> in the nth output terminal group of the gate driving circuit 20 to receive the first gate scanning signal which is output by the first output terminal OT1<n> and which is used as the first scanning driving signal, the first sensing circuit 420 in the first subpixel unit 40 in the subpixel unit group of the nth row is connected to the first output terminal OT1<n+1> in the (n+1)th output terminal group of the gate driving circuit 20 to receive the gate scanning signal which is output by the first output terminal OT1<n+1> and which is used as the first sensing driving signal, and $1 \leq n \leq N$.

For example, the first pixel driving circuit 410 in the first subpixel unit 40 in the subpixel unit group of the first row is connected to the first output terminal OT1<1> in the first output terminal group of the gate driving circuit 20, to receive the first gate scanning signal which is output by the first output terminal OT1<1> and which is used as the first scanning driving signal. For example, in the display period of one frame, the first scanning driving signal is used to turn on the first pixel driving circuit 410 included in the first subpixel unit 40 in the subpixel unit group of the first row. The first sensing circuit 420 in the first subpixel unit 40 in the subpixel unit group of the first row is connected to the first output terminal OT1<2> in the second output terminal group of the gate driving circuit 20, to receive the first gate scanning signal which is output by the first output terminal OT1<2> and which is used as the first sensing driving signal. For example, in the blanking period of one frame, the first sensing driving signal is used to turn on the first sensing circuit 420 included in the first subpixel unit 40 in the subpixel unit group of the first row. The connection relationship between the first subpixel unit 40 and the gate driving circuit 20 in the subpixel unit groups of the second row and the third row is similar to the above description, and is not repeated here.

As shown in FIG. 1 to FIG. 3, the second pixel driving circuit 510 in the second subpixel unit 50 in the subpixel unit group of the nth row is connected to the second output terminal OT2<n> in the nth output terminal group of the gate driving circuit 20 to receive the second gate scanning signal which is output by the second output terminal OT2<n> and which is used as the second scanning driving signal; the second sensing circuit 520 in the second subpixel unit 50 in the subpixel unit group of the nth row is connected to the second output terminal OT2<n+1> in the (n+1)th output terminal group of the gate driving circuit 20 to receive the second gate scanning signal which is output by the second output terminal OT2<n+1> and which is used as the second sensing driving signal; $1 \leq n \leq N$.

For example, the second pixel driving circuit 510 in the second subpixel unit 50 in the subpixel unit group of the first row is connected to the second output terminal OT2<1> in the first output terminal group of the gate driving circuit 20, to receive the second gate scanning signal which is output by the second output terminal OT2<1> and which is used as the second scanning driving signal. For example, in the display period of one frame, the second scanning driving signal is used to turn on the second pixel driving circuit 510 included in the second subpixel unit 50 in the subpixel unit group of the first row. The second sensing circuit 520 in the second subpixel unit 50 in the subpixel unit group of the first row is connected to the second output terminal OT2<2> in the second output terminal group of the gate driving circuit 20, to receive the second gate scanning signal which is output by the second output terminal OT2<2> and which is used as the second sensing driving signal. For example, in the blanking period of one frame, the second sensing driving signal is used to turn on the second sensing circuit 520 included in the second subpixel unit 50 in the subpixel unit group of the first row. The connection relationship between the second subpixel unit 50 and the gate driving circuit 20 which are in the subpixel unit groups of the second row and the third row is similar to the above description, and is not repeated here.

As shown in FIG. 1 to FIG. 3, the plurality of rows of subpixel units and the gate driving circuit 20 in the display panel provided by the embodiments of the present disclosure adopt the connection relationship as described above, which can reduce the number of the output terminals of the gate driving circuit 20. Furthermore, the frame size of the display device using the display panel 10 can be reduced, and the PPI of the display device can be increased.

In the display panel 10 provided by at least one embodiment of the present disclosure, as shown in FIGS. 2 and 3, the first pixel driving circuit 410 includes a first data writing circuit 411, a first driving circuit 412 and a first charge storage circuit 413.

As shown in FIGS. 2 and 3, the first driving circuit 412 is connected to the first data writing circuit 411, the first charge storage circuit 413, the first light emitter unit 430 and the first sensing circuit 420. The first driving circuit 412 is configured to control a first driving current for driving the first light emitter unit 430 to emit light. For example, in a light-emitting stage, the first driving circuit 412 provides the first driving current to the first light emitter unit 430 to drive the first light emitter unit 430 to emit light, and drives the first light emitter unit 430 to emit light according to a required "gray scale".

As shown in FIGS. 2 and 3, the first data writing circuit 411 is also connected to the first charge storage circuit 413, and is configured to receive the first scanning driving signal and to write a first data signal into the first driving circuit 412 in response to the first scanning driving signal. For example, taking the subpixel unit group of the first row as an example, the first data writing circuit 411 is connected to the first output terminal OT1<1> in the first output terminal group of the gate driving circuit 20 through a gate line GL<1> to receive the first scanning driving signal, and the first data writing circuit 411 is turned on in response to the first scanning driving signal. For example, the first data writing circuit 411 in the subpixel unit group of the first row is also connected to a data line DL to receive the first data signal, and write the first data signal into the first driving circuit 412 in the case that the first data writing circuit 411 is turned on. For example, at different stages, the first data signal received by the first data writing circuit 411 is a compensated data signal for the light emission of the subpixel units of this row, or is a data signal used for the light emission of the subpixel units in another row.

As shown in FIGS. 2 and 3, the first sensing circuit 420 is further connected to the first charge storage circuit 413 and the first light emitter unit 430, and is configured to receive the first sensing driving signal, and to write a first reference voltage signal (see VREF) into the first driving circuit 412 in response to the first sensing driving signal or to read the first sensing voltage signal from the first driving circuit 412. For example, taking the subpixel unit group of the first row as an example, the first sensing circuit 420 is connected to the first output terminal OT1<2> in the second output terminal group of the gate driving circuit 20 through the gate line GL<3> to receive the first sensing driving signal, and the first sensing circuit 420 is turned on in response to the first sensing driving signal. For example, the first sensing circuit 420 in the subpixel unit group of the first row is also connected to a sensing line SL. For example, in the case that the first sensing circuit 420 is turned on, the first sensing circuit 420 writes the first reference voltage signal received by means of the sensing line SL into the first driving circuit 412, or the first sensing circuit 420 outputs the first sensing voltage signal read from the first driving circuit 412 through the sensing line SL.

As shown in FIGS. 2 and 3, the first charge storage circuit 413 is further connected to the first light emitter unit 430 and is configured to store the written first data signal and the first reference voltage signal. For example, in the case that the first data signal is written into the first driving circuit 412 through the first data writing circuit 411, the first charge storage circuit 413 stores the first data signal at the same time. For another example, in the case that the first reference voltage signal is written into the first driving circuit 412 through the first sensing circuit 420, the first charge storage circuit 413 stores the first reference voltage signal at the same time.

Similarly, as shown in FIGS. 2 and 3, the second pixel driving circuit 510 includes a second data writing circuit 511, a second driving circuit 512 and a second charge storage circuit 513.

As shown in FIGS. 2 and 3, the second driving circuit 512 is connected to the second data writing circuit 511, the second charge storage circuit 513, the second light emitter unit 530 and the second sensing circuit 520, and is configured to control a second driving current that drives the second light emitter unit 530 to emit light. For example, in the light-emitting stage, the second driving circuit 512 provides the second driving current to the second light emitter unit 530 to drive the second light emitter unit 530 to emit light, and drives the second light emitter unit 530 to emit light according to a required "gray scale".

As shown in FIG. 2 and FIG. 3, the second data writing circuit 511 is also connected to the second charge storage circuit 513, and is configured to receive the second scanning driving signal and to write the second data signal into the second driving circuit 512 in response to the second scanning driving signal. For example, taking the subpixel unit group of the first row as an example, the second data writing circuit 511 is connected to the second output terminal OT2<1> in the first output terminal group of the gate driving circuit 20 through the gate line GL<2> to receive the second scanning driving signal, and the second data writing circuit 511 is turned on in response to the second scanning driving signal. For example, the second data writing circuit 511 in the subpixel unit group of the first row is also connected to the data line DL to receive a second data signal, and write the second data signal into the second driving circuit 512 in the case that the second data writing circuit 511 is turned on. For example, at different stages, the second data signal received by the second data writing circuit 511 is a compensated data signal for the light emission of the subpixel units in this row, or is used for the subpixel units in another row.

As shown in FIGS. 2 and 3, the second sensing circuit 520 is also connected to the second charge storage circuit 513 and the second light emitter unit 530, and is configured to receive the second sensing driving signal and to write a second reference voltage signal (see VREF) into the second driving circuit 512 in response to the second sensing driving signal or to read the second sensing voltage signal from the second driving circuit 512. For example, taking the subpixel unit group of the first row as an example, the second sensing circuit 520 is connected to the second output terminal OT2<2> of the second output terminal group of the gate driving circuit 20 through the gate line GL<4> to receive the second sensing driving signal, and the second sensing circuit 520 is turned on in response to the second sensing driving signal. For example, the second sensing circuit 520 in the subpixel unit group of the first row is also connected to the sensing line SL. For example, in the case that the second sensing circuit 520 is turned on, the second sensing circuit 520 writes the second reference voltage signal received by means of the sensing line SL into the second driving circuit 512, or the second sensing circuit 520 outputs the second sensing voltage signal read from the second driving circuit 512 through the sensing line SL.

As shown in FIGS. 2 and 3, the second charge storage circuit 513 is also connected to the second light emitter unit 530 and is configured to store the written second data signal and the second reference voltage signal. For example, in the case that the second data signal is written into the second driving circuit 512 through the second data writing circuit 511, the second charge storage circuit 513 can store the second data signal at the same time. As another example, in the case that the second reference voltage signal is written into the second driving circuit 512 through the second sensing circuit 520, the second charge storage circuit 513 can store the second reference voltage signal at the same time.

For example, as shown in FIG. 2 and FIG. 3, the display panel 10 provided by the embodiments of the present disclosure further includes a sampling-and-holding circuit S/H, an analog-to-digital conversion circuit ADC, a first switch K1 and a second switch K2. For example, in the case that the first reference voltage signal (or the second reference voltage signal) needs to be written through the sensing line SL, the first switch K1 is turned on and the second switch K2 is turned off. As another example, in the case that the first sensing voltage signal (or the second sensing voltage signal) needs to be read out through the sensing line SL, the first switch K1 is turned off and the second switch K2 is turned on.

For example, the sampling-and-holding circuit S/H is configured to sample and hold the first sensing voltage signal (or the second sensing voltage signal). The analog-to-digital conversion circuit ADC is connected to the sampling-and-holding circuit S/H, and is configured to perform analog-to-digital conversion (convert an analog signal into a digital signal) on the first sensing voltage signal (or the second sensing voltage signal) that is subjected sampling and holding, to facilitate subsequent further data processing. For example, by processing the first sensing voltage signal (or the second sensing voltage signal), compensation information related to a threshold voltage Vth and a current coefficient K of the first driving circuit 412 (or the second driving circuit 512) can be obtained. For example, in the blanking period of a certain frame, the first sensing voltage signal (or the second sensing voltage signal) is obtained through the first sensing circuit 420 (or the second sensing circuit 520), and a further data processing is performed on the first sensing voltage signal (or the second sensing voltage signal) to obtain the compensation information related to the threshold voltage Vth and the current coefficient K; then, in the display period of the next frame, the first light emitter unit 430 (or the second light emitter unit 530) is driven again according to the compensation information obtained as described above, to complete the external compensation of the first subpixel unit 40 (or the second subpixel unit 50).

In the display panel 10 provided by at least one embodiment of the present disclosure, as shown in FIGS. 1 to 3, the display panel 10 further includes a plurality of data lines DL and a plurality of sensing lines SL; for example, the data lines DL and the sensing lines SL have a substantially same extension direction. It should be noted that the number of the data lines DL and the number of the sensing lines SL included in the display panel 10 are the same as the number of the subpixel unit groups 70 included in each row in the display panel 10; in this case, each subpixel unit group 70 includes only one data line DL and one sensing line SL which are adjacent to each other. FIG. 1 to FIG. 3 only exemplarily show one data line DL and one sensing line SL. Embodiments of the present disclosure include, but are not limited thereto. The number of the data lines DL and the number of the sensing lines SL in the display panel 10 can be set as required.

For example, as shown in FIGS. 1 to 3, the first pixel driving circuit 410 and the second pixel driving circuit 510 which are in each subpixel unit group 70 are connected to the same data line DL among the plurality of data lines. For example, as shown in FIGS. 2 to 3, the first data writing circuit 411 and the second data writing circuit 511 which are in each subpixel unit group 70 are connected to the same data line DL among the plurality of data lines DL.

For example, as shown in FIGS. 1 to 3, the first sensing circuit 420 and the second sensing circuit 520 which are in each subpixel unit group 70 are connected to the same sensing line SL among the plurality of sensing lines SL.

As shown in FIG. 1 to FIG. 3, two columns of subpixel units share the same data line DL and the same sensing line SL, so that the number of the data lines DL and the number of the sensing lines SL can be reduced, thus the number of the data driving circuits (chips) that need to be set can be reduced, and the cost is reduced.

In the display panel 10 provided by at least one embodiment of the present disclosure, as shown in FIG. 1 to FIG. 3, the display panel 10 further includes 2N+2 gate lines GL (GL<1>, GL<2>, GL<3>, GL<4>, GL<5>, GL<6>, GL<7>, GL<8>, etc.) which are sequentially arranged, N+1 gate lines among the 2N+2 gate lines are respectively connected to the N+1 first output terminals OT1 of the gate driving circuit 20 in a one-to-one manner, and another N+1 gate lines among the 2N+2 gate lines are respectively connected to the N+1 second output terminals OT2 in a one-to-one manner. That is, each gate line only receives a signal output by one first output terminal OT1 or one second output terminal OT2, each first output terminal OT1 outputs a signal to only one gate line, and each second output terminal OT2 outputs a signal to only one gate line.

For example, in the case that the display panel 10 includes the N rows of subpixel unit groups, the gate driving circuit 20 includes N+1 first output terminals OT1 (OT1<1>, OT1<2>, OT1<3>, OT1<4> Etc.) and N+1 second output terminals OT2 (OT2<1>, OT2<2>, OT2<3>, OT2<4>, etc.), the first gate line GL<1> is connected to the first output terminal OT1<1> in the first output terminal group of the gate driving circuit 20, and the second gate line GL<2> is connected to the second output terminal OT2<1> in the first output terminal group of the gate driving circuit 20. By analogy, the (2N+1)th gate line GL<2N+1> is connected to the first output terminal OT1<N+1> in the (N+1)th output terminal group of the gate driving circuit 20, and the (2N+2)th gate line GL<2N+2> is connected to the second output terminal OT2<N+1> in the (N+1)th output terminal group of the gate driving circuit 20. That is, the 2N+2 gate lines are respectively connected to the N+1 first output terminals OT1 and N+1 second output terminals OT2 of the gate driving circuit 20 in a one-to-one manner.

For example, as shown in FIG. 1 to FIG. 3, the first pixel driving circuit 410 in the subpixel unit group 70 of the nth row is connected to the first output terminal OT1<n> in the nth output terminal group of the gate driving circuit 20 through the (2n−1)th gate line; the second pixel driving circuit 510 in the subpixel unit group 70 of the nth row is connected to the second output terminal OT2<n> of the nth output terminal group of the gate driving circuit 20 through the (2n)th gate line; the first sensing circuit 420 in the subpixel unit group 70 of the nth row is connected to the first output terminal OT1<n+1> in the (n+1)th output terminal group of the gate driving circuit 20 through the (2n+1)th gate line; the second sensing circuit 520 in the subpixel unit group 70 of the nth row is connected to the second output terminal OT2<n+1> in the (n+1)th output terminal group of the gate driving circuit 20 through the (2n+2)th gate line.

For example, as shown in FIG. 2 and FIG. 3, the first data writing circuit 411 in the subpixel unit group of the nth row is connected to the first output terminal OT1<n> in the nth output terminal group of the gate driving circuit 20 through the (2n−1)th gate line GL<2n−1>; the second data writing circuit 511 in the subpixel unit group of the nth row is connected to the second output terminal OT2<n> in the nth output terminal group of the gate driving circuit 20 through the (2n)th gate line GL<2n>; the first sensing circuit 420 in the subpixel unit group of the nth row is connected to the first output terminal OT1<n+1> in the (n+1)th output terminal group of the gate driving circuit 20 through the (2n+1)th gate line GL<2n+1>; the second sensing circuit 520 in the subpixel unit group of the nth row is connected to the second output terminal OT2<n+1> in the (n+1)th output terminal group of the gate driving circuit 20 through the (2n+2)th gate line GL<2n+2>.

As shown in FIG. 3, in the display panel 10 provided by at least one embodiment of the present disclosure, the first subpixel unit 40 and the second subpixel unit 50 are implemented as a circuit structure shown in FIG. 3.

For example, the first data writing circuit 411 is implemented as a first scanning transistor T1, the first driving circuit 412 is implemented as a first driving transistor TR1, the first sensing circuit 420 is implemented as a first sensing transistor T2, and the charge storage circuit 413 is implemented as a first storage capacitor CST1. The subpixel unit group of the first row is taken as an example to describe the transistors in the first subpixel unit 40 in detail.

A gate electrode of the first scanning transistor T1 is configured to receive the first scanning driving signal. For example, the gate electrode G1<1> of the first scanning transistor T1 is connected to the gate line GL<1> so as to receive the first scanning driving signal; a first electrode of the scanning transistor T1 is configured to receive the first data signal. For example, the first electrode of the first scanning transistor T1 is connected to the data line DL so as to receive the first data signal; a second electrode of the first scanning transistor T1 is connected to a gate electrode (A1) of the first driving transistor TR1.

A first electrode of the first driving transistor TR1 is configured to receive a first driving voltage ELVDD for generating the first driving current, and a second electrode (S1) of the first driving transistor TR1 is connected to a first electrode of the first sensing transistor T2.

A gate electrode G2<1> of the first sensing transistor T2 is configured to receive the first sensing driving signal. For example, the gate electrode G2<1> of the first sensing transistor T2 is connected to the gate line GL<3> so as to receive the first sensing driving signal. The second electrode of the first sensing transistor T2 is configured to receive the first reference voltage signal or output the first sensing voltage signal. For example, the second electrode of the first sensing transistor T2 is connected to the sensing line SL so as to receive the first reference voltage signal or to output the first sensing voltage signal.

A first electrode of the first storage capacitor CST1 is connected to the gate electrode (A1) of the first driving transistor TR1, and a second electrode of the first storage capacitor CST1 is connected to the second electrode (S1) of the first driving transistor TR1. The first storage capacitor CST1 is used to maintain a voltage difference between the gate electrode (A1) and the second electrode (S1) of the first driving transistor TR1.

For example, in the display panel 10 provided by the embodiment of the present disclosure, the first light emitter unit 430 is implemented as a first organic light emitting diode OLED1. The OLED1 can be of various types, such as top emission, or bottom emission, etc., and can emit red light, green light, blue light, or white light, which is not limited in the embodiments of the present disclosure. In other embodiments, the first light emitter unit 430 is implemented as other types of light emitting devices, such as a light emitting diode (LED), a quantum dot light emitting device, or the like.

As shown in FIG. 3, a first electrode of the first light emitter unit 430 (for example, OLED1) is connected to the second electrode (S1) of the first driving transistor TR1, so as to receive the first driving current of the first driving transistor TR1; a second electrode of the light emitter unit 430 (for example, OLED1) is configured to receive a second driving voltage ELVSS. For example, in some embodiments, the second electrode of the first light emitter unit 430 (for example, OLED1) is configured to be grounded, and in this case, the second driving voltage ELVSS is 0V. For example, the first driving voltage ELVDD is a high-level voltage (for example, 5V, 10V, or other suitable voltage), and the second driving voltage ELVSS is a low-level voltage (for example, 0V, −5V, −10V, or other suitable voltage). In the case that the first driving transistor TR1 is turned on (or partially turned on), the first driving voltage ELVDD and the second driving voltage ELVSS can be regarded as a power source, which is used to generate the first driving current for driving the OLED1.

Similarly, the transistors in the second subpixel unit 50 are described below.

For example, the second data writing circuit 511 is implemented as a second scanning transistor T3, the second driving circuit 512 is implemented as a second driving transistor TR2, the second sensing circuit 520 is implemented as a second sensing transistor T4, and the second charge storage circuit 513 is implemented as a second storage capacitor CST2. The subpixel unit group of the first row is taken as an example to describe the transistors in the second subpixel unit 50 in detail.

A gate electrode of the second scanning transistor T3 is configured to receive the second scanning driving signal. For example, the gate electrode G3<1> of the second scanning transistor T3 is connected to the gate line GL<2> so as to receive the second scanning driving signal. A first electrode of the second scanning transistor T3 is configured to receive the second data signal. For example, the first electrode of the second scanning transistor T3 is connected to the data line DL so as to receive the second data signal. A second electrode of the second scanning transistor T3 is connected to a gate electrode (A2) of the second driving transistor TR2.

A first electrode of the second driving transistor TR2 is configured to receive the first driving voltage ELVDD for generating the second driving current, a second electrode (S2) of the second driving transistor TR2 is connected to a second electrode of the second sensing transistor T4.

A gate electrode G4<1> of the second sensing transistor T4 is configured to receive the second sensing driving signal. For example, the gate electrode G4<1> of the second sensing transistor T4 is connected to the gate line GL<4> so as to receive the second sensing driving signal. The second electrode of the second sensing transistor T4 is configured to receive the second reference voltage signal or output the second sensing voltage signal. For example, the second electrode of the second sensing transistor T4 is connected to the sensing line SL, so as to receive the second reference voltage signal or output the second sensing voltage signal.

A first electrode of the second storage capacitor CST2 is connected to the gate electrode (A2) of the second driving transistor TR2, and a second electrode of the second storage capacitor CST2 is connected to the second electrode (S2) of the second driving transistor TR2. The second storage capacitor CST2 is used to maintain a voltage difference between the gate electrode (A2) and the second electrode (S2) of the second driving transistor TR2.

For example, in the display panel 10 provided by the embodiment of the present disclosure, the second light emitter unit 530 is implemented as a second organic light emitting diode OLED2. The OLED2 can be of various types, such as top emission, bottom emission, etc., and can emit red light, green light, blue light, or white light or the like, which is not limited in the embodiments of the present disclosure. In other embodiments, the first light emitter unit 430 is implemented as other types of light emitting devices, such as a light emitting diode (LED), a quantum dot light emitting device, or the like.

As shown in FIG. 3, a first electrode of the second light emitter unit (for example, OLED2) is connected to the second electrode (S2) of the second driving transistor TR2 so as to receive the second driving current of the second driving transistor TR2; the second electrode of the second light emitter unit (for example, OLED2) is configured to receive the second driving voltage ELVSS. For example, in some embodiments, the second electrode of the second light emitter unit (for example, OLED2) is configured to be grounded, and the second driving voltage ELVSS is 0V at this time. For example, the first driving voltage ELVDD is a high-level voltage (for example, 5V, 10V, or other suitable voltage), and the second driving voltage ELVSS is a low-level voltage (for example, 0V, −5V, −10V, or other suitable voltage). In the case that the second driving transistor TR2 is turned on (or partially turned on), the first driving voltage ELVDD and the second driving voltage ELVSS can be regarded as a power source, and the power source is used to generate the second driving voltage for the second light emitter unit (e.g., OLED2).

In the display panel 10 provided by the embodiments of the present disclosure, the first sensing transistor T2 in the subpixel unit group of the nth row and the first scanning transistor T1 in the subpixel unit group of the (n+1)th row are both connected to the first output terminal in the (n+1)th output terminal group of the gate driving circuit 20, so that the first sensing transistor T2 in the subpixel unit group of the nth row and the first scanning transistor T1 in the subpixel unit group of the (n+1)th row can share the first gate scanning signal output by the (n+1)th output terminal group.

Similarly, the second sensing transistor T4 in the subpixel unit group of the nth row and the second scanning transistor T3 in the subpixel unit group of the (n+1)th row are both connected to the second output terminal in the (n+1)th output terminal group of the gate driving circuit 20, so that the second sensing transistor T4 in the subpixel unit group of the nth row and the second scanning transistor T3 in the subpixel unit group of the (n+1)th row can share the second gate scanning signal output by the (n+1)th output terminal group.

In the embodiments of the present disclosure, for example, as shown in FIG. 1 to FIG. 3, the subpixel units located in the same column and respectively located in adjacent rows share the same output terminal of the gate driving circuit and are connected to the same data line DL, and the subpixel unit groups respectively located in adjacent rows share two output terminals (i.e., one output terminal group) of the gate driving circuit. Therefore, by using the connection method shown in FIG. 1 to FIG. 3, the number of the output terminals of the gate driving circuit 20 can be reduced, the frame size of the display device using the display panel 10 can be reduced, and the PPI of the display device can be increased.

In addition, the external compensation is implemented by the first sensing transistor T2 (or the second sensing transistor T4) in the first subpixel unit 40 (or the second subpixel unit 50). For example, during the blanking period of a certain frame, the first sensing voltage signal (or the second sensing voltage signal) is obtained through the first sensing transistor T2 (or the second sensing transistor T4), and a further data processing is performed on the first sensing voltage signal (or the second sensing voltage signal) to obtain the compensation information related to the threshold voltage Vth and the current coefficient K; then, in the display period of the next frame, the first light emitter unit (for example, OLED1) (or the second light emitter unit (for example, OLED 2)) is driven again according to the compensation information obtained as described above, to complete the external compensation of the first subpixel unit 40 (or the second subpixel unit 50).

Figure 4:
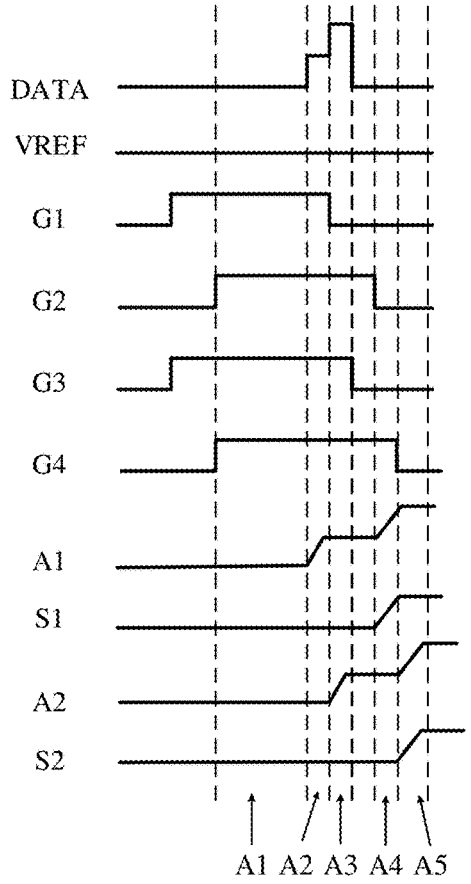
FIG. 4 is a signal timing diagram of the display panel shown in FIG. 3 in the case that the display panel works in a display period of one frame.

The following describes the working principle of one subpixel unit group 70 in the display panel 10 shown in FIG. 3 during the display period of one frame with reference to the signal timing diagram shown in FIG. 4. Here, description is given by taking the example that each transistor is an N-type transistor, but embodiments of the present disclosure are not limited thereto. The signal levels in the signal timing diagram shown in FIG. 4 are only schematic and do not represent the true level values.

In FIG. 4, DATA represents the data signal (the first data signal or the second data signal) received by the first subpixel unit 40 or the second subpixel unit 50 through the data line DL, and VREF represents the reference voltage signal (the first reference voltage signal or the second reference voltage signal) received by the first subpixel unit 40 or the second subpixel unit 50 through the sensing line SL.

G1 represents the gate electrode of the first scanning transistor T1 in the first subpixel unit 40, G2 represents the gate electrode of the first sensing transistor T2 in the first subpixel unit 40, A1 represents the gate electrode of the first driving transistor TR1 in the first subpixel unit 40, and S1 represents the second electrode of the first driving transistor TR1 in the first subpixel unit 40.

G3 represents the gate electrode of the second scanning transistor T3 in the second subpixel unit 50, G4 represents the gate electrode of the second sensing transistor T4 in the second subpixel unit 50, A2 represents the gate electrode of the second driving transistor TR2 in the second subpixel unit 50, and S2 represents the second electrode of the second driving transistor TR2 in the second subpixel unit 50.

As shown in FIG. 4, in an A1 stage, G1, G2, G3 and G4 are at a high level, and the first scanning transistor T1, the first sensing transistor T2, the second scanning transistor T3 and the second sensing transistor T4 are turned on. At this stage, no data signal is written, and this stage is set only to eliminate the rising edge of the gate scanning signal provided by the gate line GL.

In an A2 stage, G1 and G2 remain high, and the first scanning transistor T1 and the first sensing transistor T2 are turned on. At this stage, the first data signal is written into the first subpixel unit 40 through the data line DL and the first scanning transistor T1, and for example, the first data signal is a data signal which is subjected to the external compensation and which is used for the light emission of the first subpixel unit 40; the first reference voltage signal is written into the first subpixel unit 40 through the sensing line SL and the first sensing transistor T2, and for example, the first reference voltage signal is a low-level signal (for example, the low-level is 0V). At this stage, the electric potential of A1 becomes high because the first data signal is written; the electric potential of S1 remains low because the first reference voltage signal is written.

In an A3 stage, the electric potential of G1 is changed from a high level to a low level, and the first scanning transistor T1 is turned off. G3 and G4 remain high, and the second scanning transistor T3 and the second sensing transistor T4 are turned on. At this stage, the second data signal is written into the second subpixel unit 50 through the data line DL and the second scanning transistor T3, and for example, the second data signal is a data signal which is subjected to the external compensation and which is used for the light emission of the second subpixel unit 50; the second reference voltage signal is written into the second subpixel unit 50 through the sensing line SL and the second sensing transistor T4, and for example, the second reference voltage signal is a low-level signal (for example, the low-level is 0V). At this stage, the electric potential of A2 becomes high because the second data signal is written; the electric potential of S2 remains low because the second reference voltage signal is written.

In an A4 stage, the electric potential of G2 is changed from a high level to a low level, and the first sensing transistor T2 is turned off. G1 remains low, and the first scanning transistor T1 is turned off. At this stage, the first driving transistor TR1 is turned on under the combined effect of the electric potential of A1 and the electric potential of S1 (for example, an absolute value of the difference between the electric potential of A1 and the electric potential of S1 is greater than the threshold voltage Vth1 of the first driving transistor TR1), and the first driving voltage ELVDD charges the second electrode S1 of the first driving transistor TR1, that is, the first light emitter unit (for example, OLED1) is driven to emit light. At the same time, in the case that the electric potential of S1 rises, the electric potential of A1 also rises due to the bootstrap effect of the first storage capacitor CST1.

In an A5 stage, the electric potential of G4 is changed from a high level to a low level, and the second sensing transistor T4 is turned off. G3 remains low, and the second scanning transistor T3 is turned off. At this stage, the second driving transistor TR2 is turned on under the combined effect of the electric potential of A2 and the electric potential of S2 (for example, an absolute value of the difference between the electric potential of A2 and the electric potential of S2 is greater than the threshold voltage Vth2 of the second driving transistor TR2), and the first driving voltage ELVDD charges the second electrode S2 of the second driving transistor TR2, that is, the second light emitter unit (for example, OLED2) is driven to emit light. At the same time, in the case that the electric potential of S2 increases, the electric potential of A2 also increases due to the bootstrap effect of the second storage capacitor CST2.

In the above display period, the first subpixel unit 40 in the subpixel unit group 70 writes the first data signal at the A2 stage and completes the light emission at the A4 stage; the second subpixel unit 50 in the subpixel unit group writes the second data signal at the A3 stage and completes the light emission at the stage A5. That is, the first subpixel unit 40 and the second subpixel unit 50 in the same subpixel unit group respectively write different data signals at different stages, so that the two subpixel units can share the same data line DL and no display error occurs; then the first subpixel unit 40 and the second subpixel unit 50 respectively emit light at different stages, that is, time-division driving is realized.

Figure 5:
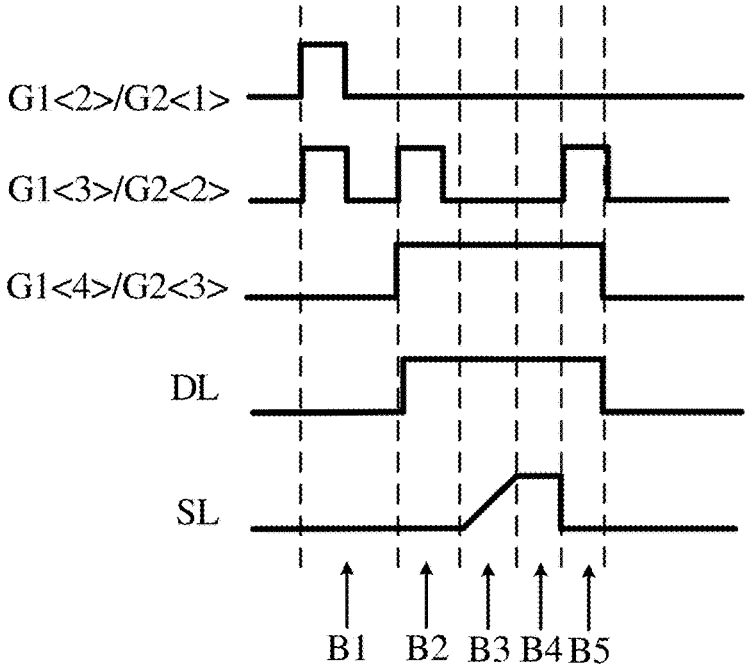
FIG. 5 is a signal timing diagram of the display panel shown in FIG. 3 in the case that the display panel works in a blanking period of one frame.

The working principle of the display panel 10 shown in FIG. 3 during the blanking period of one frame will be described below with reference to the signal timing diagram shown in FIG. 5. Here, description is given by taking the case that each transistor is an N-type transistor for example. The embodiments of the present disclosure are not limited thereto. The signal levels in the signal timing diagram shown in FIG. 5 are only schematic and do not represent true level values. For example, during the blanking period of the frame, the subpixel unit group in the third row is selected for sensing. The following uses the first subpixel unit 40 in the subpixel unit group 70 as an example for description.

In FIG. 5, G1<2>/G2<1> represents the gate electrode of the first scanning transistor T1 in the subpixel unit group of the second row (the gate electrode of the first sensing transistor T2 in the subpixel unit group of the first row); G1<3>/G2<2> represents the gate electrode of the first scanning transistor T1 in the subpixel unit group of the third row (the gate electrode of the first sensing transistor T2 in the subpixel unit group of the second row); G1<4>/G2<3> represents the gate electrode of the first scanning transistor T1 in the subpixel group of the fourth row (the gate electrode of the first sensing transistor T2 in the subpixel unit group of the third row); DL represents the signal provided by the data line, and SL represents the signal provided by (or read out from) the sensing line.

In sensing the first subpixel unit 40 in the subpixel unit group of the third row, first, the electric potential of the gate electrode G1<3> of the first scanning transistor T1 in the subpixel unit group of the third row and the electric potential of the gate electrode G2<3> of the first sensing transistor T2 in the subpixel unit group of the third row need to be high at first; at the same time, because the gate electrode G2<2> of the first sensing transistor T2 in the subpixel unit group of the second row is connected to the gate electrode G1<3> of the first scanning transistor T1 in the subpixel unit group of the third row, the first sensing transistor T2 in the subpixel unit group of the second row is turned on, and a sensing error occurs. Because the first subpixel unit 40 in the subpixel unit group of the second row is originally in the light-emitting stage, a current flows through the first driving transistor TR1 in the subpixel unit group of the second row, which causes the second electrode of the first driving transistor TR1 to be charged. At this time, the sensing line SL also senses the first subpixel unit 40 in the subpixel unit group of the second row in sensing the first subpixel unit 40 in the subpixel unit group of the third row, which causes the aforementioned sensing error.

In order to avoid the above-mentioned sensing error, in sensing the first subpixel unit 40 in the subpixel unit group of the third row, the first driving transistor TR1 in the subpixel unit group of the second row needs to be turned off first.

In a B1 stage (reset stage), the first driving transistor TR1 in the subpixel unit group of the second row is turned off. For example, at this stage, both the electric potential of G1<2> and the electric potential of G2<2> are high, so that the first scanning transistor T1 and the first sensing transistor T2 which are in the subpixel unit group of the second row are turned on, to write a correction potential to the gate electrode (A1) of the first driving transistor TR1 through the data line DL and the first scanning transistor T1, and to write the correction potential to the second electrode (S1) of the first driving transistor TR1 through the sensing line SL and the first sensing transistor T2. For example, the correction potential is 0V, so that the first driving transistor TR1 in the subpixel unit group of the second row is turned off.

In a B2 stage (restoring stage), both the electric potential of G1<3> and the electric potential of G2<3> are high, so that the first scanning transistor T1 and the first sensing transistor T2 which are in the subpixel unit group of the third row are turned on, to write the first data signal (e.g., a high-level signal, such as 3.5V) to the gate electrode (A1) of the first driving transistor TR1 through the data line DL and the first scanning transistor T1, and to write the first reference voltage signal (for example, a low-level signal, for example, 0V) to the second electrode (S1) of the first driving transistor TR1 through the sense line SL and the first sensing transistor T2, thereby turning on the first driving transistor TR1 in the subpixel unit group of the third row. It should be noted that in the B2 stage, the written first data signal and the written first reference voltage signal may be of constant values, which are, for example, 3.5V and 0V, respectively.

In a B3 stage (charging stage), the electric potential of G1<3> changes from a high level to a low level, so that the first scanning transistor T1 in the subpixel unit group of the third row is turned off; the electric potential of G2<3> continues high, so that the first sensing transistor T2 in the subpixel unit group of the third row remains being turned on. The first driving transistor TR1 in the subpixel unit group of the third row continues being turned on, so that the first driving voltage ELVDD charges the second electrode (S1) of the first driving transistor TR1. For example, at this stage, the sensing line SL remains floating.

In a B3 stage, after a period of charging, the electric potential of the second electrode (S1) of the first driving transistor TR1 remains substantially unchanged, and then in a B4 stage (sensing stage), the electric potential, namely the first sensing voltage signal, of the second electrode (S1) of the driving transistor T3 can be sensed through the sensing line SL, that is, the first sensing voltage signal is output through the sensing line SL.

In a B5 stage (data write-back stage), the electric potential of G1<3> and the electric potential of G2<3> are both high, so that the first scanning transistor T1 and the first sensing transistor T2 which are in the subpixel unit group of the third row are turned on, to write the first data signal to the gate electrode (A1) of the first driving transistor TR1 through the data line DL and the first scanning transistor T1, and to write the first reference voltage signal (for example, a low-level signal, for example, 0V) to the second electrode (S1) of the first driving transistor TR1 through the sensing line SL and the first sensing transistor T2, thereby turning on the first driving transistor TR1 in the subpixel unit group of the third row.

The working principle of the second subpixel unit 50 in the subpixel unit group 70 is similar to that described above, and is not repeated here.

At least one embodiment of the present disclosure also provides a driving method, which can be used to drive the display panel 10 provided by any one of the embodiments of the present disclosure. The driving method includes the display period and the blanking period for one frame.

In the display period, in each subpixel unit group 70, the first pixel driving circuit 410 drives the first light emitter unit 430 to emit light in a first stage, the second pixel driving circuit 510 drives the second light emitter unit 530 to emit in a second stage, and the first stage and the second stage are different. That is, the first light emitter unit 420 and the second light emitter unit 430 in the subpixel unit group 70 are time-division-driven in different stages of the display period.

It should be noted that, for the detailed description of the driving method in the display period, reference may be made to the above descriptions related to the A1 stage, the A2 stage, the A3 stage, the A4 stage and the A5 stage.

For example, in the driving method provided by at least one embodiment of the present disclosure, during the blanking period, the subpixel unit group of the i-th row is randomly selected from the N rows of subpixel unit groups, so that the first sensing circuit 420 in the subpixel unit group of the i-th row or the second sensing circuit 520 in the subpixel unit group of the i-th row performs sensing; $1 \leq i \leq N$. That is, during the blanking period of one frame, the first subpixel unit 40 in the subpixel unit group of a certain row is sensed, or the second subpixel unit 50 in the subpixel unit group of the certain row is sensed.

As another example, in the driving method provided by at least one embodiment of the present disclosure, during the blanking period, the subpixel unit group of the i-th row is randomly selected from the N rows of subpixel unit groups, so that the first sensing circuit 420 in the subpixel unit group of the i-th row and the second sensing circuit 520 in the subpixel unit group of the i-th row perform sensing; $1 \leq i \leq N$. That is, during the blanking period of one frame, the first subpixel unit 40 in the subpixel unit group of a certain row is sensed, and during the blanking period of the frame, the second subpixel unit 50 in the subpixel unit group of the certain row is also sensed. For example, during the blanking period of one frame, the first subpixel unit 40 in the subpixel unit group of a certain row is sensed first, and then the second subpixel unit 50 in the subpixel unit group of the certain row is sensed; or, the second subpixel unit 50 in the subpixel unit group of the certain row is sensed first, and then the first subpixel unit 40 in the subpixel unit group of the certain row is sensed.

It should be noted that, for a detailed description of the foregoing driving method in the display period, reference may be made to the above descriptions related to the B1 stage, the B2 stage, the B3 stage, the B4 stage and the B5 stage.

In addition, regarding the technical effects of the driving method provided by the embodiments of the present disclosure, reference may be made to the corresponding descriptions in the above-mentioned embodiments of the display panel 10, which are not repeated here.

The gate driving circuit 20 in the display panel 10 according to the embodiments of the present disclosure is described in detail below. The gate driving circuit 20 can be used in a display device, and provides the gate scanning signal during a display process of a frame of picture of the display device.

Figure 6:
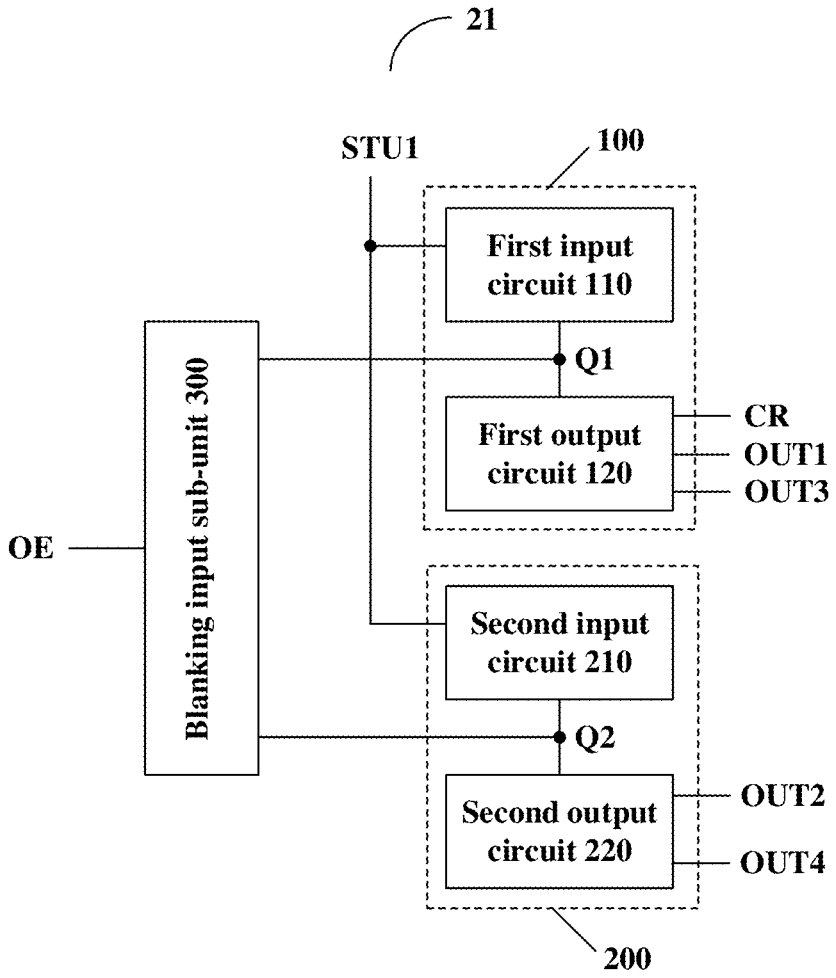
FIG. 6 is a schematic diagram of a shift register unit provided by at least one embodiment of the present disclosure.

For example, the gate driving circuit 20 includes a plurality of cascaded shift register units 21, as shown in FIG. 6, and the shift register unit 21 includes a first sub-unit 100 and a second sub-unit 200.

The first sub-unit 100 includes a first input circuit 110 and a first output circuit 120. The first input circuit 110 is configured to control a level of a first node Q1 in response to a first input signal STU1. For example, the first input circuit 110 is configured to charge the first node Q1. For example, the first input circuit 110 is configured to receive the first input signal STU1 and a first voltage VDD (see FIG. 7), and the first input circuit 110 is turned on in response to the first input signal STU1, so as to use the first voltage VDD to charge the first node Q1.

The first output circuit 120 is configured to output a shift signal CR, a first output signal OUT1 and a third output signal OUT3 under the control of the level of the first node Q1. For example, the first output circuit 120 is configured to receive a second clock signal CLKB, a third clock signal CLKC and a fifth clock signal CLKE (see FIG. 11), and in the case that the first output circuit 120 is turned on under the control of the level of the first node Q1, the first output circuit 120 outputs the second clock signal CLKB used as the shift signal CR, outputs the third clock signal CLKC used as the first output signal OUT1, and outputs the fifth clock signal CLKE used as the third output signal OUT3.

For example, during the display period of one frame, the shift signal CR output by the first output circuit 120 is provided to the other shift register unit 21 and used as the first input signal STU1 of the other shift register unit 21 to complete the progressive shift of display scanning. The first output signal OUT1 and the third output signal OUT3 which are output by the first output circuit 120 can drive a certain row of subpixel unit groups in the display panel 10 to perform display scanning. For another example, during the blanking period of one frame, the first output signal OUT1 and the third output signal OUT3 which are output by the first output circuit 120 are used to drive a certain row of subpixel unit groups in the display panel 10 to perform sensing, so as to complete the external compensation of the certain row of the subpixel unit groups. That is, in the same output circuit 120, the terminal for outputting the first output signal OUT1 and the terminal for outputting the third output signal OUT3 are the first output terminal OT1 and the second output terminal OT2 which are included in the same output terminal group, respectively.

It should be noted that, in the display period of one frame, the signal waveforms of the shift signal CR and the first output signal OUT1 which are output by the first output circuit 120 may be the same or may be different, which is not limited in the embodiments of the present disclosure.

The second sub-unit 200 includes a second input circuit 210 and a second output circuit 220. The second input circuit 210 is configured to control a level of the second node Q2 in response to the first input signal STU1. For example, the second input circuit 210 is configured to charge the second node Q2. For example, the second input circuit 210 is configured to receive the first input signal STU1 and the first voltage VDD, and the second input circuit 210 is turned on in response to the first input signal STU1, so as to use the first voltage VDD to charge the second node Q2.

The second output circuit 220 is configured to output a second output signal OUT2 and a fourth output signal OUT4 under the control of the level of the second node Q2. For example, the first output circuit 120 is configured to receive a fourth clock signal CLKD and a sixth clock signal CLKF (see FIG. 11), and in the case that the second output circuit 220 is turned on under the control of the level of the second node Q2, the second output circuit outputs the fourth clock signal CLKD used as the second output signal OUT2, and outputs the sixth clock signal CLKF used as the fourth output signal OUT4.

For example, during the display period of one frame, the second output signal OUT2 and the fourth output signal OUT4 which are output by the second output circuit 220 drive a certain row of subpixel units in the display panel 10 to perform display scanning. For another example, during the blanking period of one frame, the second output signal OUT2 and the fourth output signal OUT4 which are output by the second output circuit 220 are used to drive a certain row of subpixel unit groups in the display panel 10 to perform sensing, so as to complete the external compensation of the certain row of the subpixel unit groups. That is, in the same output circuit 220, the terminal for outputting the second output signal OUT2 and the terminal for outputting the fourth output signal OUT4 are the first output terminal OT1 and the second output terminal OT2 which are included in the another output terminal group, respectively.

For example, in the case that the plurality of shift register units 21 are cascaded to form the gate driving circuit 20, some of the shift register units 21 are connected to a clock signal line, so as to receive the first input signal STU1 provided by the clock signal line; alternatively, some of the shift register units 21 receive shift signals CR which are output by the shift register units 21 of other stages and used as the first input signal STU1.

It should be noted that, in the embodiments of the present disclosure, the first voltage VDD is, for example, a high level, and the following embodiments are the same and are not be described again.

In addition, it should be noted that, in the embodiments of the present disclosure, the high level and the low level are relative. A high level indicates a higher voltage range (for example, the high level can be 5V, 10V, or other suitable voltages), and a plurality of high levels can be the same or different. Similarly, the low level indicates a lower voltage range (for example, the low level adopts 0V, −5V, −10V, or other suitable voltages), and a plurality of low levels may be the same or different. For example, the minimum value of the high level is greater than the maximum value of the low level.

It should be noted that, in the embodiments of the present disclosure, the control of the level of a node (for example, the first node Q1, the second node Q2, etc.) includes: charging the node to raise the level of the node, or discharging the node to lower the level of the node. For example, a capacitor that is electrically connected to the node can be provided, and charging the node means charging the capacitor that is electrically connected to the node; similarly, discharging the node means discharging the capacitor that is electrically connected to the node; by means of the capacitor, the high level or low level of the node can be maintained.

The shift register unit 21 provided in the embodiments of the present disclosure can charge a plurality of sub-units (the first sub-unit 100 and the second sub-unit 200, etc.) at the same time, and require only one sub-unit (such as the first sub-unit 100) to output a shift signal, without requiring other sub-units (such as the second sub-unit 200, etc.) to output a shift signal, which can reduce the number of clock signal lines and the number of transistors, thereby reduce the area occupied by the gate driving circuit 20 of the shift register unit 21, further reduce the frame size of the display device using the gate driving circuit 20 and increase the PPI of the display device.

It should be noted that FIG. 6 is only an example of the present disclosure, and the number of sub-units included in the shift register unit 21 is not limited in the embodiments of the present disclosure. For example, three, four, or more sub-units may be included. The number of sub-units can be set according to the actual situation.

As shown in FIG. 6, the shift register unit 21 further includes a blanking input sub-unit 300. The blanking input sub-unit 300 is connected to the first node Q1 and the second node Q2, and is configured to receive a selection control signal OE and control the level of the first node Q1 and the level of the second node Q2. For example, the blanking input sub-unit 300 is configured to charge the first node Q1 and the second node Q2.

For example, during the blanking period of one frame, the blanking input sub-unit 300 charges the first node Q1 and the second node Q2, so that the first output circuit 120 outputs the first output signal OUT1 and the third output signal OUT3 under the control of the level of the first node Q1, or that the second output circuit 220 outputs the second output signal OUT2 and the fourth signal OUT4 under the control of the level of the second node Q2. The first output signal OUT1, the second output signal OUT2, the third output signal OUT3 and the fourth output signal OUT4 are used to drive a certain row of subpixel unit groups in the display panel 10 to perform sensing to complete the external compensation of the certain row of subpixel unit groups.

Figure 7:
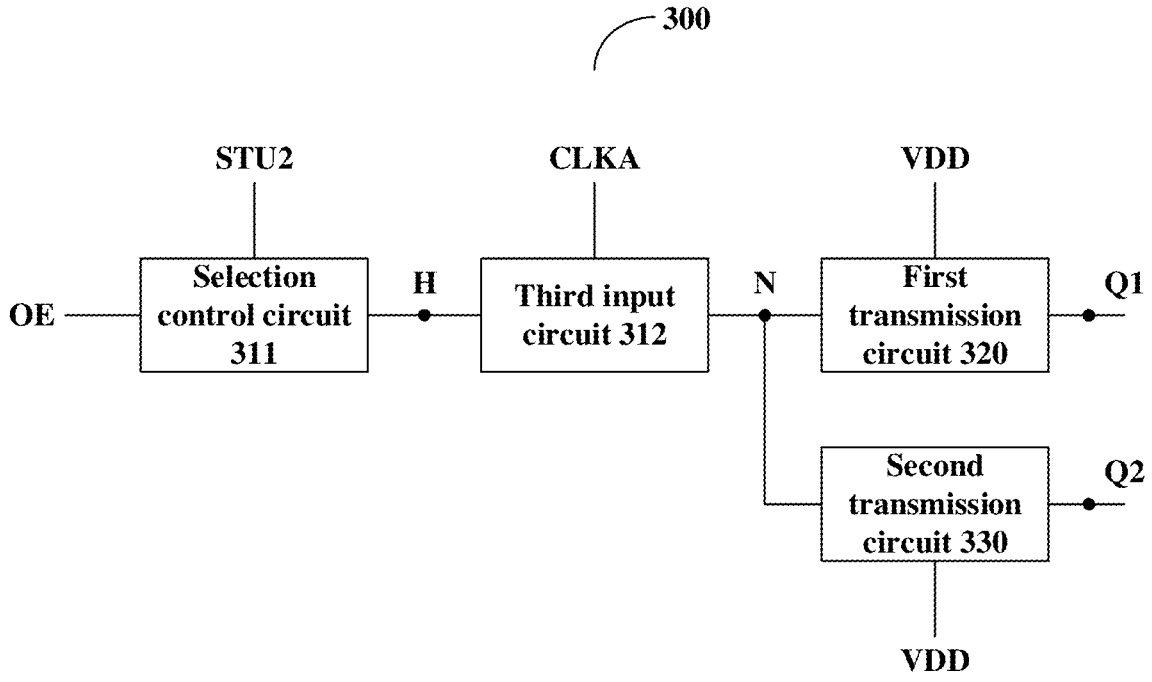
FIG. 7 is a schematic diagram of a blanking input sub-unit provided by at least one embodiment of the present disclosure.

As shown in FIG. 7, in at least one embodiment of the present disclosure, the blanking input sub-unit 300 includes a selection control circuit 311, a third input circuit 312, a first transmission circuit 320 and a second transmission circuit 330.

The selection control circuit 311 is configured to control a level of a third node H by using the second input signal STU2 in response to the selection control signal OE. For example, the selection control circuit 311 is configured to charge the third node H and maintain the level of the third node H. For example, during the display period of one frame, the selection control circuit 311 is turned on under the control of the selection control signal OE, so as to charge the third node H by using the second input signal STU2. For example, the level (e.g., high level) of the third node H is maintained from the display period of one frame to the blanking period of the frame.

For example, in the case that the plurality of shift register units 21 are cascaded to form the gate driving circuit 20, a certain stage of shift register unit 21 receives the shift signal CR which is output by another stage of shift register unit 21 and used as the second input signal STU2. For example, in the case that a certain stage of shift register unit 21 is to be selected to output a driving signal in the blanking period of one frame, the time sequence of the waveforms of the selection control signal OE and the second input signal STU2 which are provided to the stage of shift register unit 21 are the same, so that the selection control circuit 311 in the certain stage of shift register unit 21 is turned on.

The third input circuit 312 is configured to control a level of a fourth node N under the control of the level of the third node H. For example, the third input circuit 312 is configured to receive a first clock signal CLKA. In the case that the third input circuit 312 is turned on under the control of the level of the third node H, the third input circuit 312 can transmit the first clock signal CLKA to the fourth node N, so as to control the level of the fourth node N. For example, during the blanking period of one frame, in the case that the first clock signal CLKA is at a high level, the third input circuit 312 transmits the high level to the fourth node N, so that the electric potential of the fourth node N becomes the high level.

Figure 9A:
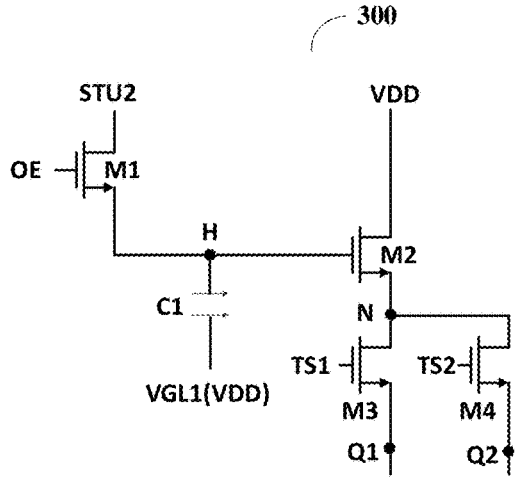
FIG. 9A to FIG. 9F are circuit diagrams of six types of blanking input sub-units provided by the embodiments of the present disclosure.

The first transmission circuit 320 is electrically connected to the first node Q1 and the fourth node N, and is configured to control the level of the first node Q1 under the control of the level of the fourth node N or under the control of a first transmission signal TS1 (which is, for example, shown in FIG. 9A). For example, the first transmission circuit 320 charges the first node Q1. For example, in some examples, the first transmission circuit 320 receives the first voltage VDD of high level, and in the case that the first transmission circuit 320 is turned on under the control of the level of the fourth node N, the first transmission circuit 320 uses the first voltage VDD to charge the first node Q1. For another example, in other examples, the first transmission circuit 320 is turned on under the control of the first transmission signal TS1, so as to realize the electrical connection between the fourth node N and the first node Q1, and then use the third input circuit 312 to charge the first node Q1.

The second transmission circuit 330 is electrically connected to the second node Q2 and the fourth node N, and is configured to control the level of the second node Q2 under the control of the level of the fourth node N or under the control of a second transmission signal TS2 (which is, for example, shown in FIG. 9A). For example, the second transmission circuit 330 is configured to charge the second node Q2. For example, in some examples, the second transmission circuit 330 receives the first voltage VDD of high level, and in the case that the second transmission circuit 330 is turned on under the control of the level of the fourth node N, the second transmission circuit 330 uses the first voltage VDD to charge the second node Q2. For another example, in other examples, the second transmission circuit 330 is turned on under the control of the second transmission signal TS2, so as to realize the electrical connection between the fourth node N and the second node Q2, and then use the third input circuit 312 to charge the second node Q2.

Figure 9B:
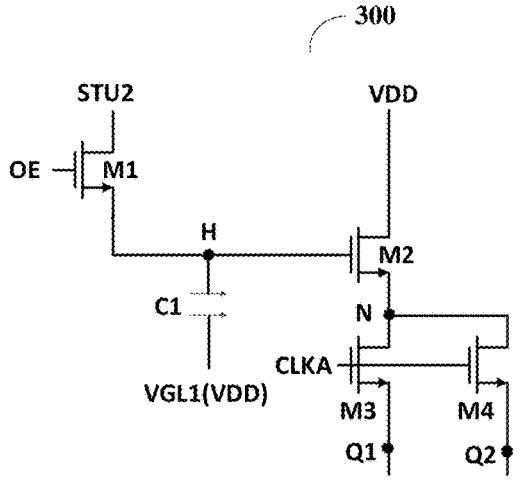

It should be noted that, in the embodiments of the present disclosure, the first transmission signal TS1 and the second transmission signal TS2 may be the same. For example, the first transmission signal TS1 and the second transmission signal TS2 both adopt the first clock signal CLKA (for example, as shown in FIG. 9B), which can save the clock signal lines. The first transmission signal TS1 and the second transmission signal TS2 use different signals to control the first transmission circuit 320 and the second transmission circuit 330 respectively. For example, in the case that it is not necessary to charge the second node Q2, the second transmission circuit 330 is turned off, so that power consumption can be reduced.

In addition, in the case that the shift register unit 21 includes three, four, or more sub-units, correspondingly, three, four, or more transmission circuits need to be provided to implement the function of the blanking input sub-unit 300.

In the embodiments of the present disclosure, in the case that the shift register unit 21 includes a plurality of sub-units (the first sub-unit 100 and the second sub-unit 200, etc.), these sub-units may share one blanking input sub-unit 300, thereby reducing the area occupied by the gate driving circuit 20 using the shift register unit 21, further reducing the frame size of the display device using the gate driving circuit 20, and thereby increasing the PPI of the display device.

It should be noted that, in the embodiments of the present disclosure, the blanking input sub-unit 300 is provided in the shift register unit 21 to realize that a driving signal can be output during the blanking period of one frame. The "blanking" in the blanking input sub-unit 300 only indicates that the blanking input sub-unit 300 is related to the blanking period in one frame, and is not limited to that the blanking input sub-unit 300 only works in the blanking period. The following embodiments are the same, and repeated description is omitted.

As shown in FIGS. 8 and 9A-9F, in some embodiments, the selection control circuit 311 is implemented to include a first transistor M1 and a first capacitor C1. A gate electrode of the first transistor M1 is configured to receive the selection control signal OE, a first electrode of the first transistor M1 is configured to receive the second input signal STU2, and a second electrode of the first transistor M1 is connected to the third node H. For example, in the case that the selection control signal OE is a turn-on signal of high level, the first transistor M1 is turned on, so as to use the second input signal STU2 to charge the third node H.

A first electrode of the first capacitor C1 is connected to the third node H, and a second electrode of the first capacitor C1 is configured to receive a fourth voltage VGL1 or the first voltage VDD. The electric potential of the third node H can be maintained by setting the first capacitor C1. For example, during the display period of one frame, the selection control circuit 311 charges the third node H to pull up the third node H to a high electric potential, and the first capacitor C1 can maintain the high electric potential of the third node H until the blanking period of the frame. In addition, in other embodiments, the second electrode of the first capacitor C1 may also be connected to the fourth node N.

It should be noted that, in the embodiments of the present disclosure, the fourth voltage VGL1 is, for example, a low level, and the following embodiments are the same, and are not described again.

Figure 8:
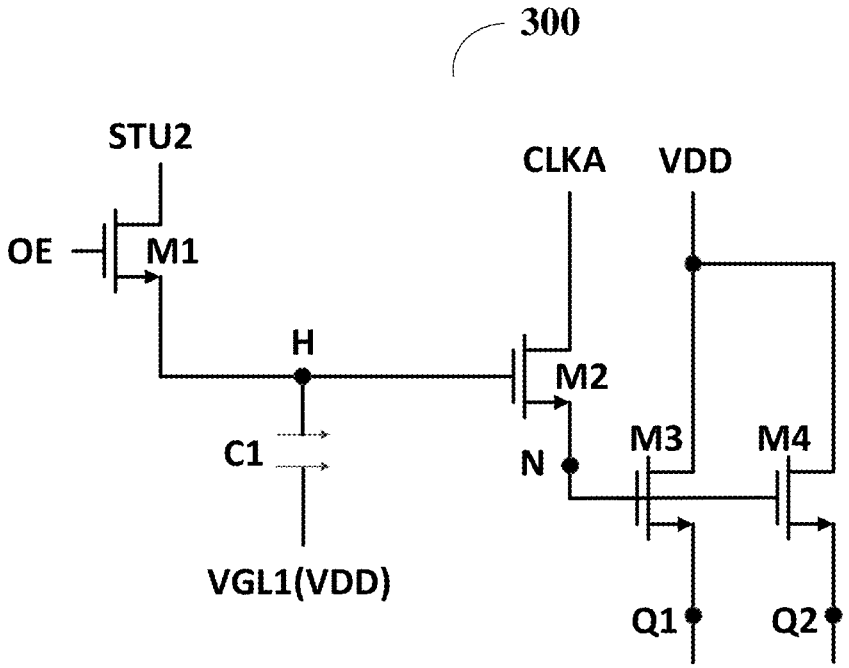
FIG. 8 is a circuit diagram of the blanking input sub-unit provided by at least one embodiment of the present disclosure.

For example, in the embodiment shown in FIG. 8, the third input circuit 312 is implemented as a second transistor M2. A gate electrode of the second transistor M2 is connected to the third node H, a first electrode of the second transistor M2 is configured to receive the first clock signal CLKA, and a second electrode of the second transistor M2 is connected to the fourth node N. For example, in the case that the third node H is at a high level, the second transistor M2 is turned on, so as to transmit the first clock signal CLKA to the fourth node N to pull up the level of the fourth node N.

For example, in the embodiment shown in FIG. 8, the first transmission circuit 320 is implemented as a third transistor M3, and the second transmission circuit 330 is implemented as a fourth transistor M4.

A gate electrode of the third transistor M3 is connected to the fourth node N, a first electrode of the third transistor M3 is configured to receive the first voltage VDD, and a second electrode of the third transistor M3 is connected to the first node Q1. For example, in the case that the fourth node N is at a high level, the third transistor M3 is turned on, so as to charge the first node Q1 by using the high-level first voltage VDD.

A gate electrode of the fourth transistor M4 is connected to the fourth node N, s first electrode of the fourth transistor M4 is configured to receive the first voltage VDD, and a second electrode of the fourth transistor M4 is connected to the second node Q2. For example, in the case that the fourth node N is at a high level, the fourth transistor M4 is turned on, so as to charge the second node Q2 by using the first voltage VDD which is a high level.

The blanking input sub-unit 300 provided in FIGS. 9A-9F is described below. It should be noted that, in the following description, the same parts of FIGS. 9A-9F and FIG. 8 are not described again.

For example, in the blanking input sub-unit 300 provided in FIG. 9A, the first electrode of the second transistor M2 is configured to receive the first voltage VDD; the gate electrode of the third transistor M3 is configured to receive the first transmission signal TS1, and the first electrode of the third transistor M3 is connected to the fourth node N; the gate electrode of the fourth transistor M4 is configured to receive the second transmission signal TS2, and the first electrode of the fourth transistor M4 is connected to the fourth node N. For example, in the blanking period of one frame, in the case that the first node Q1 needs to be charged, the first transmission signal TS1 is a high level, so that the third transistor M3 is turned on, and that the first voltage VDD of high level charges the first node Q1 through the second transistor M2 and the third transistor M3. As another example, during the blanking period of one frame, in the case that the second node Q2 needs to be charged, the second transmission signal TS2 is a high level, so that the fourth transistor M4 is turned on, and that the first voltage VDD of high level can charge the second node Q2 through the second transistor M2 and the fourth transistor M4.

For example, in the blanking input sub-unit 300 provided in FIG. 9B, the gate electrode of the third transistor M3 and the gate electrode of the fourth transistor M4 are both configured to receive the first clock signal CLKA. For example, in the blanking period of one frame, in the case that the first clock signal CLKA is a high level, the third transistor M3 and the fourth transistor M4 are turned on at the same time, and the first voltage VDD of high level can charge the first node Q1 and the second node Q2 at the same time.

Figure 9C:
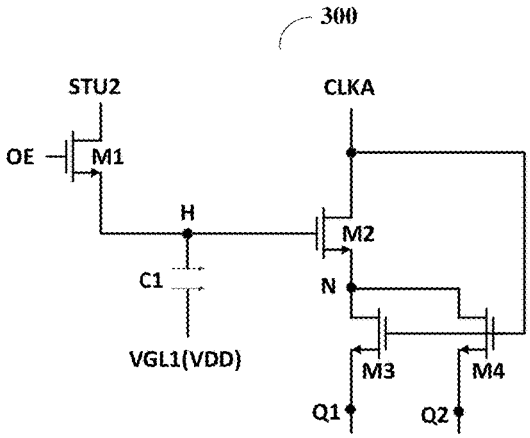

For example, as shown in FIG. 9C, the blanking input sub-unit 300 provided in FIG. 9C is different from the blanking input sub-unit 300 provided in FIG. 9B in that the first electrode of the second transistor M2 is configured to receive the first clock signal CLKA. Compared with the case that the first electrode of the second transistor M2 in FIG. 9B always receives the first voltage VDD of high level, the second transistor M2 in FIG. 9C can reduce the time that the first electrode is applied with a high level, thereby extending the service life of the second transistor M2 and ensuring the stability of the shift register unit 21.

Figure 9D:
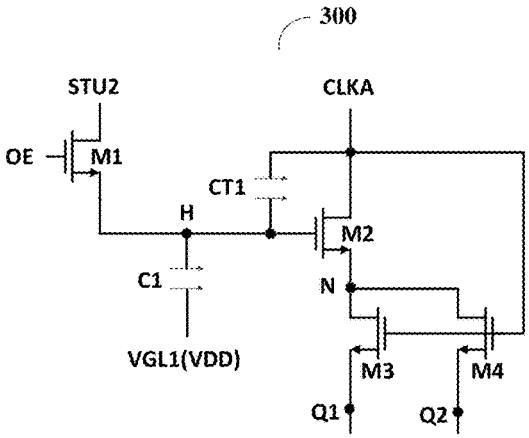

For example, as shown in FIG. 9D, compared with FIG. 9C, the blanking input sub-unit 300 further includes a first coupling capacitor CT1. A first electrode of the first coupling capacitor CT1 is configured to receive the first clock signal CLKA, and a second electrode of the first coupling capacitor CT1 is connected to the third node H. For example, in the case that the first clock signal CLKA changes from a low level to a high level, the first clock signal CLKA can couple and pull up the third node H through the coupling effect of the first coupling capacitor CT1, so that the level of the third node H is further pulled high, thereby ensuring that the second transistor M2 is turned on more fully.

Figure 9E:
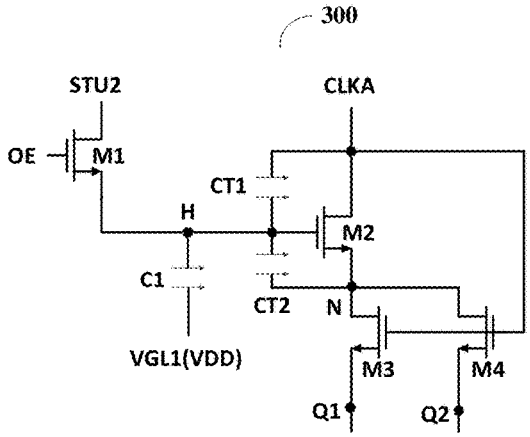

For example, as shown in FIG. 9E, compared with FIG. 9D, the blanking input sub-unit 300 further includes a second coupling capacitor CT2, a first electrode of the second coupling capacitor CT2 is connected to the third node H, and a second electrode of the first coupling capacitor CT2 is connected to the fourth node N. For example, in the case that the first clock signal CLKA changes from a low level to a high level, if the second transistor M2 is turned on at this time, the first clock signal CLKA of high level can be transmitted to the fourth node N through the second transistor M2, so that the electric potential of the second electrode of the second coupling capacitor CT2 is pulled up, and thus the level of the third node H can be further pulled up through the bootstrap action, thereby ensuring that the second transistor M2 is turned on more fully.

Figure 9F:
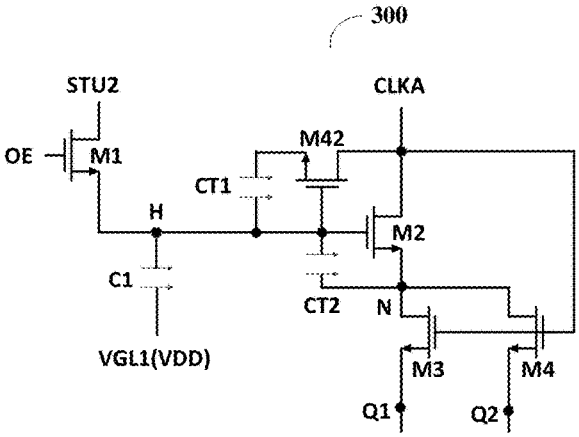

For example, as shown in FIG. 9F, compared with FIG. 9E, the blanking input sub-unit 300 further includes a forty-second transistor M42, a gate electrode of the forty-second transistor M42 is connected to the third node H. A first electrode of the forty-second transistor M42 is configured to receive the first clock signal CLKA, and a second electrode of the forty-second transistor M42 is connected to the first electrode of the first coupling capacitor CT1. For example, in the case that the third node H is at a high level, the forty-second transistor M42 is turned on, and the first clock signal CLKA can couple and pull up the third node H through the coupling effect of the first coupling capacitor CT1, so that the level of the third node H is further pulled up, thereby ensuring that the second transistor M2 is turned on more fully.

Figure 10:
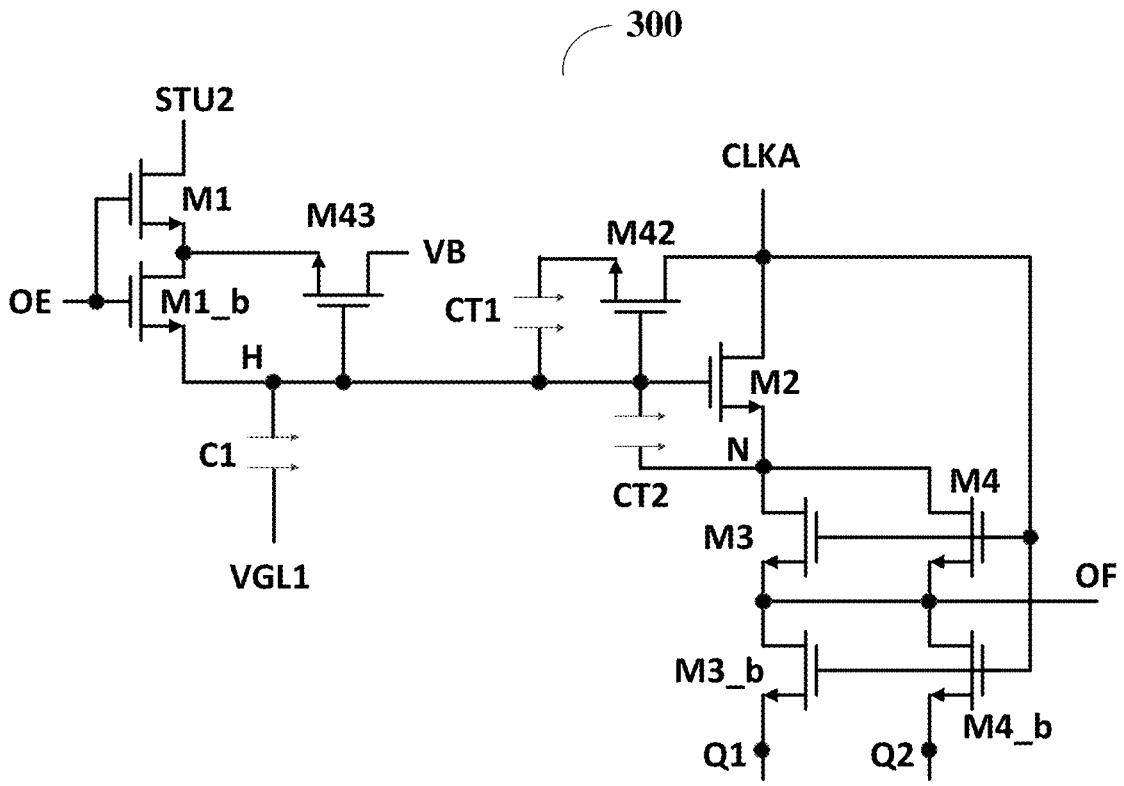
FIG. 10 is a circuit diagram of the blanking input sub-unit having a leakage prevention structure provided by at least one embodiment of the present disclosure.

For example, FIG. 10 also provides the blanking input sub-unit 300. Compared with FIG. 9E, the blanking input sub-unit 300 further includes a forty-third transistor M43 and transistors M1_*b*, M3_*b* and M4_*b*.

As shown in FIG. 10, a gate electrode of the forty-third transistor M43 is connected to the third node H, a first electrode of M43 is configured to receive a sixth voltage VB, and a second electrode of M43 is connected to the second electrode of the first transistor M1; a gate electrode of the transistor M1_*b* is configured to receive the selection control signal OE, a first electrode of M1_*b* is connected to the second electrode of the first transistor M1, and a second electrode of M1_*b* is connected to the third node H; a gate electrode of the transistor M3_*b* and a gate electrode of the transistor M4_*b* are configured to receive the first clock signal CLKA, a first electrode of the transistor M3_*b* and a first electrode of the transistor M4_*b* are connected to a seventh node OF, a second electrode of the transistor M3_*b* is connected to the first node Q1, and a second electrode of the transistor M4_*b* is connected to the second node Q2.

The forty-third transistor M43 and the transistor M1_*b* cooperate to prevent the third node H from generating electric leakage, the transistor M3_*b* can prevent the first node Q1 from generating electric leakage, and the transistor M4_*b* can prevent the second node Q2 from generating electric leakage. The working principle of the electric-leakage prevention in FIG. 10 and the seventh node OF will be described in detail below, and will not be repeated here.

It should be noted that, in the embodiments of the present disclosure, the sixth voltage VB is, for example, a high level. The following embodiments are the same, and will not be described again.

In addition, it should be noted that the transistors in the blanking input sub-unit 300 provided in FIGS. 8, 9A-9F, and 10 are all described by taking N-type transistors as an example.

Figure 11:
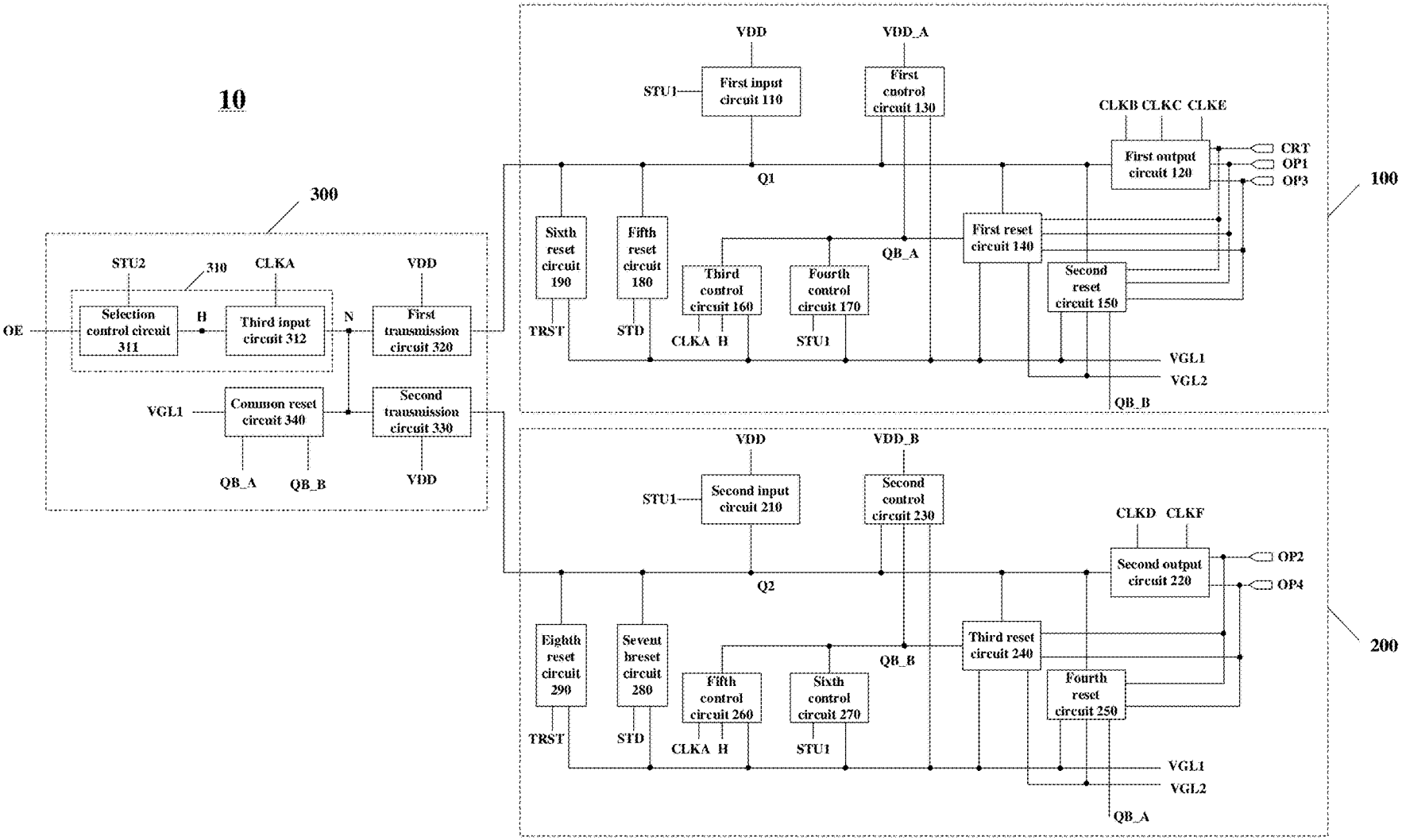
FIG. 11 is another schematic diagram of the shift register unit provided by at least one embodiment of the present disclosure.

At least one embodiment of the present disclosure further provides a shift register unit 21. As shown in FIG. 11, the first sub-unit 100 further includes a first control circuit 130, a first reset circuit 140, a second reset circuit 150, a shift signal output terminal CRT, a first output signal terminal OP1 and a third output signal terminal OP3. The shift signal output terminal CRT is configured to output the shift signal CR, the first output signal terminal OP1 is configured to output the first output signal OUT1, and the third output signal terminal OP3 is configured to output the third output signal OUT3.

The first control circuit 130 is configured to control a level of a fifth node QB_A under the control of both the level of the first node Q1 and a second voltage VDD_A. For example, the first control circuit 130 is connected to the first node Q1 and the fifth node QB_A, and is configured to receive the second voltage VDD_A and the fourth voltage VGL1. For example, in the case that the first node Q1 is at a high level, the first control circuit 130 pulls down the fifth node QB_A to a low level by using the fourth voltage VGL1 of low level. As another example, in the case that the electric potential of the first node Q1 is at a low level, the first control circuit 130 uses the second voltage VDD_A (for example, a high level) to charge the fifth node QB_A to pull up the fifth node QB_A to a high level.

The first reset circuit 140 is configured to reset the first node Q1, the shift signal output terminal CRT, the first output signal terminal OP1 and the third output signal terminal OP3 under the control of the level of the fifth node QB_A. For example, the first reset circuit 140 is connected to the first node Q1, the fifth node QB_A, the shift signal output terminal CRT, the first output signal terminal OP1 and the third output signal terminal OP3, and is configured to receive the fourth voltage VGL1 and a fifth voltage VGL2. For example, in the case that the first reset circuit 140 is turned on under the control of the level of the fifth node QB_A, the fourth voltage VGL1 is used to pull down and reset the first node Q1 and the shift signal output terminal CRT, and the fifth voltage VGL2 is used to pull down and reset the first output signal terminal OP1 and the third output signal terminal OP3 at the same time. It should be noted that in the embodiments of the present disclosure, the fourth voltage VGL1 is also used to pull down and reset the first output signal terminal OP1 and the third output signal terminal OP3, which is not limited in the present disclosure. In addition, in the embodiments of the present disclosure, the fifth voltage VGL2 is, for example, a low level, and the following embodiments are the same therewith, and will not be described again. In the embodiments of the present disclosure, the fifth voltage VGL2 may be the same as or different from the fourth voltage VGL1.

The second reset circuit 150 is configured to reset the first node Q1, the shift signal output terminal CRT, the first output signal terminal OP1 and the third output signal terminal OP3 under the control of a level of a sixth node QB_B. For example, the second reset circuit 150 is connected to the first node Q1, the sixth node QB_B, the shift signal output terminal CRT, the first output signal terminal OP1 and the third output signal terminal OP3, and is configured to receive the fourth voltage VGL1 and the fifth voltage VGL2. For example, in the case that the second reset circuit 150 is turned on under the control of the level of the sixth node QB_B, the fourth voltage VGL1 is used to pull down and reset the first node Q1 and the shift signal output terminal CRT, and the fifth voltage VGL2 is used to pull down and reset the first output signal terminal OP1 and the third output signal terminal OP3 at the same time.

As shown in FIG. 11, the second sub-unit 200 further includes a second control circuit 230, a third reset circuit 240, a fourth reset circuit 250, a second output signal terminal OP2 and a fourth output signal terminal OP4. The second output signal terminal OP2 is configured to output a second output signal OUT2, and the fourth output signal terminal OP4 is configured to output a fourth output signal OUT4.

The second control circuit 230 is configured to control the level of the sixth node QB_B under the control of both the level of the second node Q2 and a third voltage VDD_B. For example, the second control circuit 230 is connected to the second node Q2 and the sixth node QB_B, and is configured to receive the third voltage VDD_B and the fourth voltage VGL1. For example, in the case that the second node Q2 is at a high level, the second control circuit 230 uses the fourth voltage VGL1 of low level to pull down the sixth node QB_B to a low level. As another example, in the case that the electric potential of the second node Q2 is at a low level, the second control circuit 230 uses the third voltage VDD_B (for example, a high level) to charge the sixth node QB_B to pull up the sixth node QB_B to a high level.

The third reset circuit 240 is configured to reset the second node Q2, the second output signal terminal OP2 and the fourth output signal terminal OP4 under the control of the level of the sixth node QB_B. For example, the third reset circuit 240 is connected to the second node Q2, the sixth node QB_B, the second output signal terminal OP2 and the fourth output signal terminal OP4, and is configured to receive the fourth voltage VGL1 and the fifth voltage VGL2. For example, in the case that the third reset circuit 240 is turned on under the control of the level of the sixth node QB_B, the second node Q2 is pulled down and reset by using the fourth voltage VGL1, and the second output signal terminal OP2 and the fourth output signal terminal OP4 are pulled down and reset by using the fifth voltage VGL2. It should be noted that, in the embodiments of the present disclosure, the fourth voltage VGL1 may be used to pull down and reset the second output signal terminal OP2 and the fourth output signal terminal OP4, which is not limited in this disclosure.

The fourth reset circuit 250 is configured to reset the second node Q2, the second output signal terminal OP2 and the fourth output signal terminal OP4 under the control of the level of the fifth node QB_A. For example, the fourth reset circuit 250 is connected to the second node Q2, the fifth node QB_A, the second output signal terminal OP2 and the fourth output signal terminal OP4, and is configured to receive the fourth voltage VGL1 and the fifth voltage VGL2. For example, in the case that the fourth reset circuit 250 is turned on under the control of the level of the fifth node QB_A, the fourth voltage VGL1 is used to pull down and reset the second node Q2, and the fifth voltage VGL2 is used to pull down and reset the second output signal terminal OP2 and the fourth output signal terminal OP4.

It should be noted that, in the embodiments of the present disclosure, for example, the second voltage VDD_A and the third voltage VDD_B are configured to be mutually inverted signals, that is, in the case that the second voltage VDD_A is at a high level, the third voltage VDD_B is at a low level; and in the case that the second voltage VDD_A is at a low level, the third voltage VDD_B is at a high level. In this way, only one of the first control circuit 130 and the second control circuit 230 can be in an operating state at the same time, which can avoid performance drift caused by the long-time operation of the circuit, thereby improving the stability of the circuit.

As shown in FIG. 11, the blanking input sub-unit 300 further includes a common reset circuit 340. The common reset circuit 340 is electrically connected to the fourth node N, the fifth node QB_A and the sixth node QB_B, and is configured to reset the fourth node N under the control of the level of the fifth node QB_A or under the control of the level of the sixth node QB_B. For example, the common reset circuit 340 is configured to receive the fourth voltage VGL1, and in the case that the common reset circuit 340 is turned on under the control of the level of the fifth node QB_A or under the control of the level of the sixth node QB_B, the fourth voltage VGL1 is used to pull down and reset the fourth node N.

In the embodiments of the present disclosure, by setting the common reset circuit 340, the level of the fourth node N can be better controlled. For example, in the case that it is not necessary to charge the first node Q1 or the second node Q2, the fourth node N is at a low level, and the first transmission circuit 320 and the second transmission circuit 330 are turned off, so as to avoid that the first voltage VDD of high level charges the first node Q1 or the second node Q2, which can prevent occurrence of abnormal output, and thereby improves the stability of the circuit.

It should be noted that, in the embodiments of the present disclosure, each node (the first node Q1, the second node Q2, the third node H, the fourth node N, the fifth node QB_A, the sixth node QB_B, etc.) and each output terminals (the shift signal output terminal CRT, the first output signal terminal OP1, the second output signal terminal OP2, the third output signal terminal OP3, and the fourth output signal terminal OP4, etc.) are all provided to better describe the circuit structure, and do not indicate actual parts. A node represents a meeting point where related circuits are connected in a circuit structure, that is, the related circuits having the same node identifier are electrically connected to each other. For example, as shown in FIG. 11, the first control circuit 130, the first reset circuit 140, the fourth reset circuit 250 and the common reset circuit 340 are all connected to the fifth node QB_A, which means that these circuits are electrically connected to each other.

At least one embodiment of the present disclosure further provides the shift register unit 21. As shown in FIG. 11, in the shift register unit 21, the first sub-unit 100 further includes a third control circuit 160 and a fourth control circuit 170. The third control circuit 160 is configured to control the level of the fifth node QB_A in response to the first clock signal CLKA, and the fourth control circuit 170 is configured to control the level of the fifth node QB_A in response to the first input signal STU1.

For example, in at least one example, the third control circuit 160 is connected to the fifth node QB_A, and is configured to receive the first clock signal CLKA and the fourth voltage VGL1. For example, during the blanking period of one frame, the third control circuit 160 is turned on in response to the first clock signal CLKA, so as to pull down the fifth node QB_A by using the fourth voltage VGL1 of low level. For example, in another example, the third control circuit 160 is also connected to the third node H. For example, during the blanking period of one frame, in the case that the third node H is at a high level and the first clock signal CLKA is at a high level, the third control circuit 160 is turned on, so that the fourth voltage VGL1 of low level can be used to pull down the fifth node QB_A.

For example, the fourth control circuit 170 is connected to the fifth node QB_A, and is configured to receive the first input signal STU1 and the fourth voltage VGL1. For example, in the display period of one frame, the fourth control circuit 170 is turned on in response to the first input signal STU1, so as to pull down the fifth node QB_A by using the fourth voltage VGL1 of low level. By pulling down the fifth node QB_A to a low electric potential, the influence of the fifth node QB_A on the first node Q1 can be avoided, so that the first node Q1 is more fully charged in the display period.

As shown in FIG. 11, the second sub-unit 200 further includes a fifth control circuit 260 and a sixth control circuit 270. The fifth control circuit 260 is configured to control the level of the sixth node QB_B in response to the first clock signal CLKA. The sixth control circuit 270 is configured to control the level of the sixth node QB_B in response to the first input signal STU1.

For example, in at least one example, the fifth control circuit 260 is connected to the sixth node QB_B, and is configured to receive the first clock signal CLKA and the fourth voltage VGL1. For example, during the blanking period of one frame, the fifth control circuit 260 is turned on in response to the first clock signal CLKA, so as to pull down the sixth node QB_B by using the fourth voltage VGL1 of low level. For example, in another example, the fifth control circuit 260 is also connected to the third node H. For example, during the blanking period of one frame, in the case that the third node H is at a high level and the first clock signal CLKA is at a high level, the fifth control circuit 260 is turned on, so that the fourth voltage VGL1 of low level can be used to pull down the sixth node QB_B.

For example, the sixth control circuit 270 is connected to the sixth node QB_B, and is configured to receive the first input signal STU1 and the fourth voltage VGL1. For example, during the display period of one frame, the sixth control circuit 270 is turned on in response to the first input signal STU1, so as to pull down the sixth node QB_B by using the fourth voltage VGL1 of low level. Pulling down the sixth node QB_B to a low electric potential can avoid the influence of the sixth node QB_B on the second node Q2, so that the second node Q2 is more fully charged in the display period.

As shown in FIG. 11, the first sub-unit 100 further includes a fifth reset circuit 180 and a sixth reset circuit 190. The fifth reset circuit 180 is configured to reset the first node Q1 in response to the display reset signal STD. The sixth reset circuit 190 is configured to reset the first node Q1 in response to a global reset signal TRST.

For example, the fifth reset circuit 180 is connected to the first node Q1 and is configured to receive the display reset signal STD and the fourth voltage VGL1. For example, during the display period of one frame, the fifth reset circuit 180 is turned on in response to the display reset signal STD, so that the fourth voltage VGL1 can be used to pull down and reset the first node Q1. For example, in the case that the plurality of shift register units 21 are cascaded to form the gate driving circuit 20, a certain stage of shift register unit 21 receives the shift signal CR which is output by the another stage of shift register unit 21 and which is used as the display reset signal STD.

For example, the sixth reset circuit 190 is connected to the first node Q1 and is configured to receive the global reset signal TRST and the fourth voltage VGL1. For example, in the case that the plurality of shift register units 21 are cascaded to form the gate driving circuit 20, before the display period of one frame, the sixth reset circuit 190 in each stage of shift register unit 21 is turned on in response to the global reset signal TRST, so that the fourth voltage VGL1 of low level can be used to pull down and reset the first node Q1, thereby achieving a global reset of the gate driving circuit 20.

As shown in FIG. 11, the second sub-unit 200 further includes a seventh reset circuit 280 and an eighth reset circuit 290. The seventh reset circuit 280 is configured to reset the second node Q2 in response to the display reset signal STD. The eighth reset circuit 290 is configured to reset the second node Q2 in response to the global reset signal TRST.

For example, the seventh reset circuit 280 is connected to the second node Q2 and is configured to receive the display reset signal STD and the fourth voltage VGL1. For example, during the display period of one frame, the seventh reset circuit 280 is turned on in response to the display reset signal STD, so that the fourth voltage VGL1 can be used to pull down and reset the second node Q2.

For example, the eighth reset circuit 290 is connected to the second node Q2 and is configured to receive the global reset signal TRST and the fourth voltage VGL1. For example, in the case that the plurality of shift register units 21 are cascaded to form the gate driving circuit 20, before the display period of one frame, the eighth reset circuit 290 in each stage of shift register unit 21 is turned on in response to the global reset signal TRST, so that the fourth voltage VGL1 can be used to pull down and reset the second node Q2, thereby achieving the global reset of the gate driving circuit 20.

Those skilled in the art can understand that although a plurality of control circuits and a plurality of reset circuits are shown in FIG. 11, the above examples cannot limit the protection scope of the present disclosure. In practical applications, a technician may choose to use or not use one or more of the above circuits according to situations. Based on the principle that various combinations and modifications of the foregoing circuits do not depart from the present disclosure, details are omitted herein.

Figure 12A:
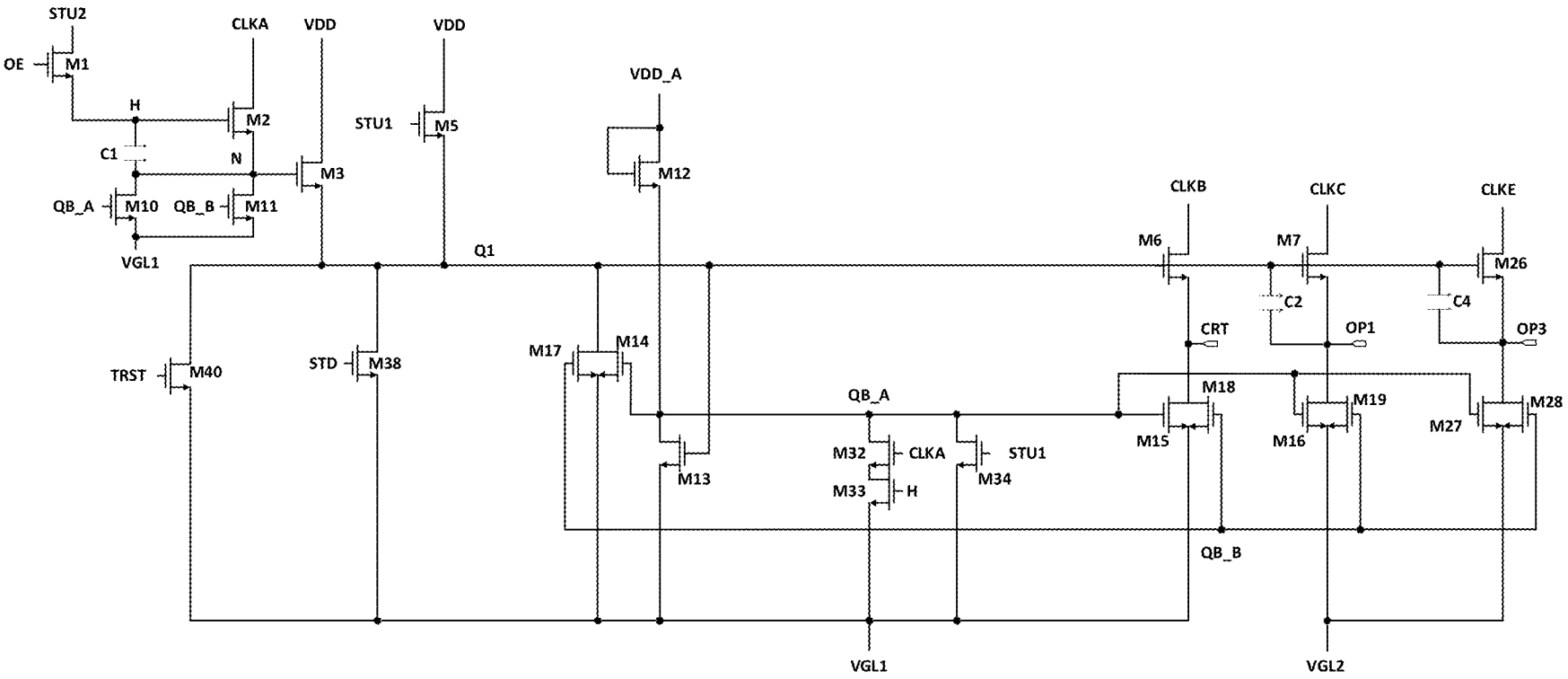
FIG. 12A and FIG. 12B are circuit diagrams of the shift register unit provided by at least one embodiment of the present disclosure.
Figure 12B:
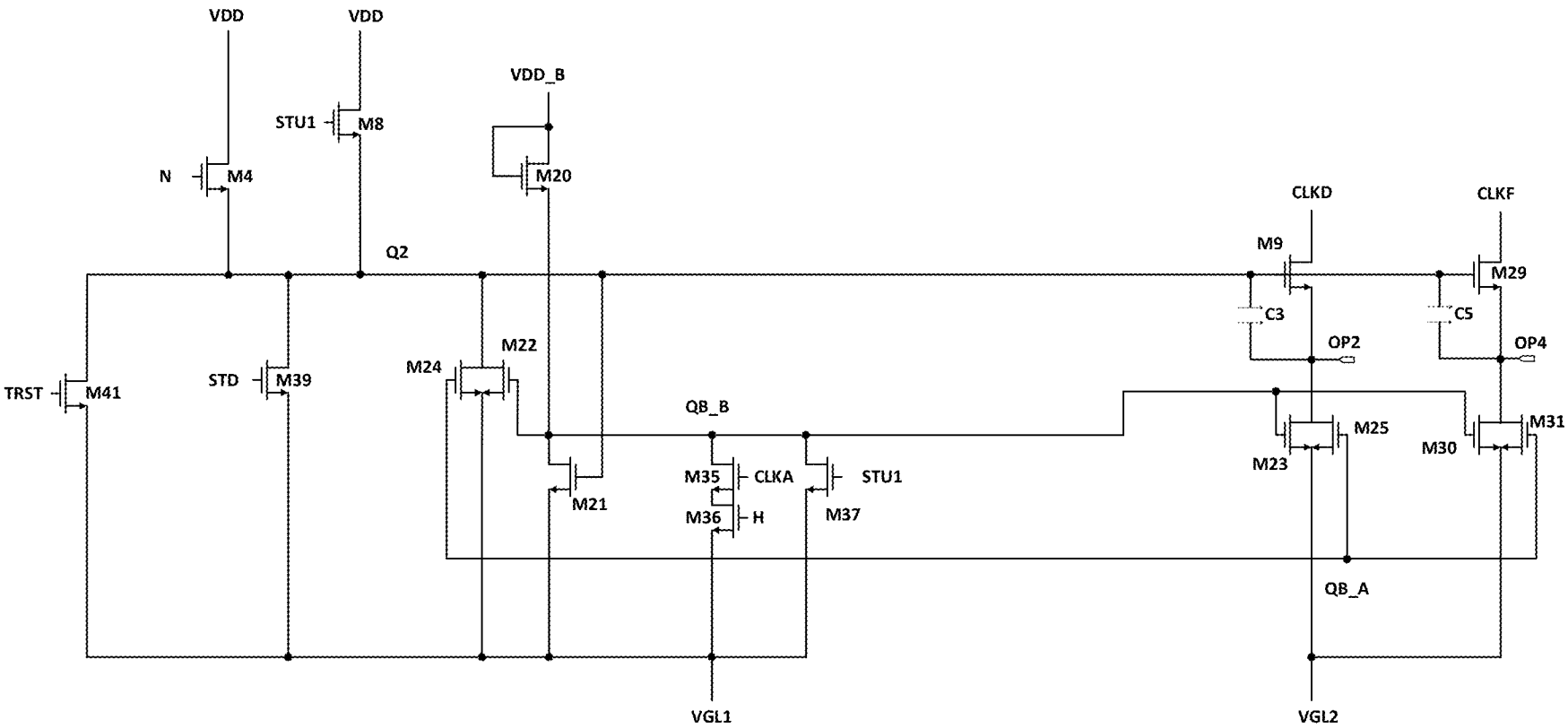

In at least one embodiment of the present disclosure, the shift register unit 21 shown in FIG. 11 is implemented as the circuit structure shown in FIGS. 12A and 12B. It should be noted that, for the sake of clarity, FIG. 12A shows a portion of the first sub-unit 100 and the blanking input sub-unit 300 of the shift register unit 21 except the second transmission circuit 330, FIG. 12B shows the second sub-unit 200 and the second transmission circuit 330 in the shift register unit 21, and the circuits in FIGS. 12A and 12B are electrically connected through corresponding nodes. The schematic manners of the circuit structure of the shift register unit 21 in the following embodiments are the same, and repeated description is omitted herein.

As shown in FIGS. 12A and 12B, the shift register unit 21 includes: the first transistor M1 to a forty-first transistor M41, the first capacitor C1, a second capacitor C2, a third capacitor C3, a fourth capacitor C4 and a fifth capacitor C5. It should be noted that the transistors shown in FIGS. 12A and 12B are all described by taking N-type transistors as examples, and the parts of the blanking input sub-unit 300 described above will not be repeated here.

As shown in FIG. 12A, the first input circuit 110 is implemented as a fifth transistor M5. A gate electrode of the fifth transistor M5 is configured to receive the first input signal STU1, a first electrode of the fifth transistor M5 is configured to receive the first voltage VDD, and a second electrode of the fifth transistor M5 is connected to the first node Q1.

Figure 13A:
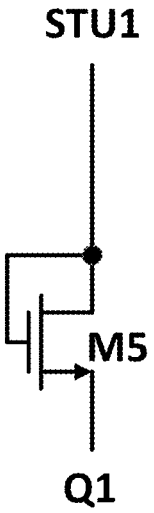
FIG. 13A to FIG. 13C are circuit diagrams of three first input circuits provided by the embodiments of the present disclosure.

For example, in another example, as shown in FIG. 13A, the gate electrode of the fifth transistor M5 is connected to the first electrode of the fifth transistor M5 and is configured to receive the first input signal STU1, so that in the case that the first input signal STU1 is a high level, use the first input signal STU1 of high level to charge the first node Q1.

Figure 13B:
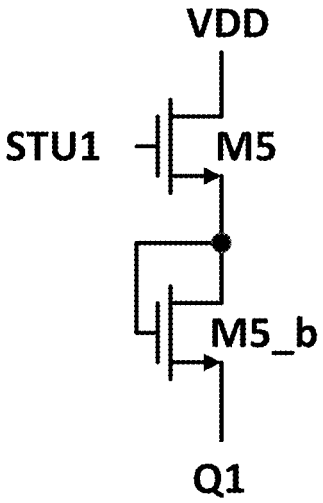

For example, in yet another example, as shown in FIG. 13B, the first input circuit 110 further includes a transistor M5_b. A gate electrode of the transistor M5_b and a first electrode of the transistor M5_b are connected to the second electrode of the fifth transistor M5, and a second electrode of the transistor M5_b is connected to the first node Q1. Because the transistor M5_b uses a diode connection, the current can only flow from the first electrode of the transistor M5_b to the second electrode of the transistor M5_b, and cannot flow from the second electrode of the transistor M5_b (that is, the first node Q1) to the first electrode of the transistor M5_b, thereby avoiding that the first node Q1 leaks electricity through the fifth transistor M5.

Figure 13C:
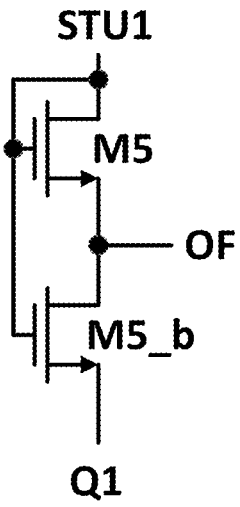

For example, in yet another example, as shown in FIG. 13C, the gate electrode of the transistor M5_b and the gate electrode of the fifth transistor M5 are connected, and are both configured to receive the first input signal STU1, and the first electrode of the transistor M5_b is connected to the seventh Node OF. The first input circuit 110 shown in FIG. 13C adopts an electric-leakage prevention structure to prevent electric leakage of the first node Q1. It should be noted that the working principle of the electric-leakage prevention and the seventh node OF will be described below, and will not be repeated here.

As shown in FIG. 12A, the first output circuit 120 is implemented to include a sixth transistor M6, a seventh transistor M7, a twenty-sixth transistor M26, the second capacitor C2 and the fourth capacitor C4. A gate electrode of the sixth transistor M6 is connected to the first node Q1. A first electrode of the sixth transistor M6 is configured to receive the second clock signal CLKB which is used as the shift signal CR. A second electrode of the sixth transistor M6 is connected to the shift signal output terminal CRT and configured to output the shift signal CR.

A gate electrode of the seventh transistor M7 is connected to the first node Q1. A first electrode of the seventh transistor M7 is configured to receive the third clock signal CLKC which is used as the first output signal OUT1. A second electrode of the seventh transistor M7 is connected to the first output signal terminal OP1 and configured to output the first output signal OUT1. A first electrode of the second capacitor C2 is connected to the first node Q1, and a second electrode of the second capacitor C2 is connected to the second electrode of the seventh transistor M7 (that is, the first output signal terminal OP1).

A gate electrode of the twenty-sixth transistor M26 is connected to the first node Q1. A first electrode of the twenty-sixth transistor M26 is configured to receive the fifth clock signal CLKE which is used as the third output signal OUT3. A second electrode of the twenty-sixth transistor M26 is connected to the third output signal terminal OP3 and is configured to output a third output signal OUT3. A first electrode of the fourth capacitor C4 is connected to the first node Q1, and a second electrode of the fourth capacitor C4 is connected to the third output signal terminal OP3.

As shown in FIG. 12B, the second input circuit 210 is implemented as an eighth transistor M8. A gate electrode of the eighth transistor M8 is configured to receive the first input signal STU1, a first electrode of the eighth transistor M8 is configured to receive the first voltage VDD, and a second electrode of the eighth transistor M8 is connected to the second node Q2. It should be noted that the second input circuit 210 may also adopt a circuit structure similar to the circuit structure as shown in FIGS. 13A-13C, and details are not described herein again.

As shown in FIG. 12B, the second output circuit 220 is implemented to include a ninth transistor M9, a twenty-ninth transistor M29, the third capacitor C3 and the fifth capacitor. A gate electrode of the ninth transistor M9 is connected to the second node Q2. A first electrode of the ninth transistor M9 is configured to receive the fourth clock signal CLKD which is used as the second output signal OUT2. A second electrode of the ninth transistor M9 is connected to the second output signal terminal OP2 and configured to output the second output signal OUT2. A first electrode of the third capacitor C3 is connected to the second node Q2, and a second electrode of the third capacitor C3 is connected to the second electrode of the ninth transistor M9 (that is, the second output signal terminal OP2).

A gate electrode of the twenty-ninth transistor M29 is connected to the second node Q2. A first electrode of the twenty-ninth transistor M29 is configured to receive the sixth clock signal CLKF which is used as the fourth output signal OUT4. A second electrode of the twenty-ninth transistor M29 is connected to the fourth output signal terminal OP4 and configured to output the fourth output signal OUT4. A first electrode of the fifth capacitor C5 is connected to the second node Q2, and a second electrode of the fifth capacitor C5 is connected to the fourth output signal terminal OP4.

As shown in FIG. 12A, the common reset circuit 340 is implemented to include a tenth transistor M10 and an eleventh transistor M11. A gate electrode of the tenth transistor M10 is connected to the fifth node QB_A, a first electrode of the tenth transistor M10 is connected to the fourth node N, and a second electrode of the tenth transistor M10 is configured to receive the fourth voltage VGL1. A gate electrode of the eleventh transistor M11 is connected to the sixth node QB_B, a first electrode of the eleventh transistor M11 is connected to the fourth node N, and a second electrode of the eleventh transistor M11 is configured to receive the fourth voltage VGL1.

As shown in FIG. 12A, the first control circuit 130 is implemented to include a twelfth transistor M12 and a thirteenth transistor M13. A gate electrode of the twelfth transistor M12 and a first electrode of the twelfth transistor M12 are configured to receive the second voltage VDD_A, and a second electrode of the twelfth transistor M12 is connected to the fifth node QB_A. A gate electrode of the thirteenth transistor M13 is connected to the first node Q1, a first electrode of the thirteenth transistor M13 is connected to the fifth node QB_A, and a second electrode of the thirteenth transistor M13 is configured to receive the fourth voltage VGL1.

As shown in FIG. 12A, the first reset circuit 140 is implemented to include a fourteenth transistor M14, a fifteenth transistor M15, a sixteenth transistor M16 and a twenty-seventh transistor M27, and the second reset circuit 150 is implemented to include a first seventeenth transistor M17, an eighteenth transistor M18, a nineteenth transistor M19 and a twenty-eighth transistor M28.

A gate electrode of the fourteenth transistor M14 is connected to the fifth node QB_A, a first electrode of the fourteenth transistor M14 is connected to the first node Q1, and a second electrode of the fourteenth transistor M14 is configured to receive the fourth voltage VGL1. A gate electrode of the fifteenth transistor M15 is connected to the fifth node QB_A, a first electrode of the fifteenth transistor M15 is connected to the shift signal output terminal CRT, and a second electrode of the fifteenth transistor M15 is configured to receive the fourth voltage VGL1. A gate electrode of the sixteenth transistor M16 is connected to the fifth node QB_A, a first electrode of the sixteenth transistor M16 is connected to the first output signal terminal OP1, and a second electrode of the sixteenth transistor is configured to receive the fifth voltage VGL2. A gate electrode of the twenty-seventh transistor M27 is connected to the fifth node QB_A, a first electrode of the twenty-seventh transistor M27 is connected to the third output signal terminal OP3, and a second electrode of the twenty-seventh transistor M27 is configured to receive the fifth voltage VGL2.

A gate electrode of the seventeenth transistor M17 is connected to the sixth node QB_B, a first electrode of the seventeenth transistor M17 is connected to the first node Q1, and a second electrode of the seventeenth transistor M17 is configured to receive the fourth voltage VGL1. A gate electrode of the eighteenth transistor M18 is connected to the sixth node QB_B, a first electrode of the eighteenth transistor M18 is connected to the shift signal output terminal CRT, and a second electrode of the eighteenth transistor M18 is configured to receive the fourth voltage VGL1. A gate electrode of the nineteenth transistor M19 is connected to the sixth node QB_B, a first electrode of the nineteenth transistor M19 is connected to the first output signal terminal OP1, and a second electrode of the nineteenth transistor M19 is configured to receive the fifth voltage VGL2. A gate electrode of the twenty-eighth transistor M28 is connected to the sixth node QB_B, a first electrode of the twenty-eighth transistor M28 is connected to the third output signal terminal OP3, and a second electrode of the twenty-eighth transistor M28 is configured to receive the fifth voltage VGL2.

As shown in FIG. 12B, the second control circuit 230 is implemented to include a twentieth transistor M20 and a twenty-first transistor M21. A gate electrode of the twentieth transistor M20 and a first electrode of the twentieth transistor M20 are configured to receive the third voltage VDD_B, and a second electrode of the twentieth transistor M20 is connected to the sixth node QB_B. A gate electrode of the twenty-first transistor M21 is connected to the second node Q2, a first electrode of the twenty-first transistor M21 is connected to the sixth node QB_B, and a second electrode of the twenty-first transistor M21 is configured to receive the fourth voltage VGL1.

As shown in FIG. 12B, the third reset circuit 240 is implemented to include a twenty-second transistor M22, a twenty-third transistor M23 and a thirtieth transistor M30, and the fourth reset circuit 250 is implemented to include a twenty-fourth transistor M24, a twenty-fifth transistor M25 and a thirty-first transistor M31.

A gate electrode of the twenty-second transistor M22 is connected to the sixth node QB_B, a first electrode of the twenty-second transistor M22 is connected to the second node Q2, and a second electrode of the twenty-second transistor M22 is configured to receive the fourth voltage VGL1. A gate electrode of the twenty-third transistor M23 is connected to the sixth node QB_B, a first electrode of the twenty-third transistor M23 is connected to the second output signal terminal OP2, and a second electrode of the twenty-third transistor M23 is configured to receive the fifth voltage VGL2. A gate electrode of the thirtieth transistor M30 is connected to the sixth node QB_B, a first electrode of the thirtieth transistor M30 is connected to the fourth output signal terminal OP4, and a second electrode of the thirtieth transistor M30 is configured to receive the fifth voltage VGL2.

A gate electrode of the twenty-fourth transistor M24 is connected to the fifth node QB_A, a first electrode of the twenty-fourth transistor M24 is connected to the second node Q2, and a second electrode of the twenty-fourth transistor M24 is configured to receive the fourth voltage VGL1. A gate electrode of the twenty-fifth transistor M25 is connected to the fifth node QB_A, a first electrode of the twenty-fifth transistor M25 is connected to the second output signal terminal OP2, and a second electrode of the twenty-fifth transistor M25 is configured to receive the fifth voltage VGL2. A gate electrode of the thirty-first transistor M31 is connected to the fifth node QB_A, a first electrode of the thirty-first transistor M31 is connected to the fourth output signal terminal OP4, and a second electrode of the thirty-first transistor M31 is configured to receive the fifth voltage VGL2.

It should be noted that, in the embodiments of the present disclosure, for example, the second voltage VDD_A and the third voltage VDD_B are configured to be mutually inverted signals, that is, in the case that the second voltage VDD_A is at a high level, the third voltage VDD_B is at a low level, and in the case that the second voltage VDD_A is at a low level, the third voltage VDD_B is at a high level. In this way, only one of the twelfth transistor M12 and the twentieth transistor M20 can be turned on at the same time, so that the performance drift caused by the long-term conduction of the transistors can be avoided, and the stability of the circuit can be improved.

In the shift register unit 21 shown in FIGS. 12A and 12B, the first control circuit 130 is provided in the first sub-unit 100 and is used to control the level of the fifth node QB_A, and the second control circuit 230 is provided in the second sub-unit 200 and is used to control the level of the sixth node QB_B. In this way, the number of transistors can be reduced, so that the area occupied by the gate driving circuit 20 using the shift register unit 21 can be further reduced, which can further reduce the frame size of the display device using the gate driving circuit 20, and improve the PPI of the display device.

As shown in FIG. 12A, the third control circuit 160 is implemented to include a thirty-second transistor M32 and a thirty-third transistor M33. A gate electrode of the thirty-second transistor M32 is configured to receive the first clock signal CLKA, a first electrode of the thirty-second transistor M32 is connected to the fifth node QB_A, and a second electrode of the thirty-second transistor M32 is connected to a first electrode of the thirty-third transistor M33. A gate electrode of the thirty-third transistor M33 is connected to the third node H, and a second electrode of the thirty-third transistor M33 is configured to receive the fourth voltage VGL1.

The fourth control circuit 170 is implemented as a thirty-fourth transistor M34. A gate electrode of the thirty-fourth transistor M34 is configured to receive the first input signal STU1, a first electrode of the thirty-fourth transistor M34 is connected to the fifth node QB_A, and a second electrode of the thirty-fourth transistor M34 is configured to receive the fourth voltage VGL1.

As shown in FIG. 12B, the fifth control circuit 260 is implemented to include a thirty-fifth transistor M35 and a thirty-sixth transistor M36. A gate electrode of the thirty-fifth transistor M35 is configured to receive the first clock signal CLKA, a first electrode of the thirty-fifth transistor M35 is connected to the sixth node QB_B, and a second electrode of the thirty-fifth transistor M35 is connected to a first electrode of the thirty-sixth transistor M36. A gate electrode of the thirty-sixth transistor M36 is connected to the third node H, and a second electrode of the thirty-sixth transistor M36 is configured to receive the fourth voltage VGL1.

The sixth control circuit 270 is implemented as a thirty-seventh transistor M37. A gate electrode of the thirty-seventh transistor M37 is configured to receive the first input signal STU1, a first electrode of the thirty-seventh transistor M37 is connected to the sixth node QB_B, and a second electrode of the thirty-seventh transistor M37 is configured to receive the fourth voltage VGL1.

As shown in FIG. 12A, the fifth reset circuit 180 is implemented as a thirty-eighth transistor M38, and the sixth reset circuit 190 is implemented as a fortieth transistor M40. A gate electrode of the thirty-eighth transistor M38 is configured to receive the display reset signal STD, a first electrode of the thirty-eighth transistor M38 is connected to the first node Q1, and a second electrode of the thirty-eighth transistor M38 is configured to receive the fourth voltage VGL1. A gate electrode of the fortieth transistor M40 is configured to receive the global reset signal TRST, a first electrode of the fortieth transistor M40 is connected to the first node Q1, and a second electrode of the fortieth transistor M40 is configured to receive the fourth voltage VGL1.

As shown in FIG. 12B, the seventh reset circuit 280 is implemented as a thirty-ninth transistor M39, and the eighth reset circuit 290 is implemented as the forty-first transistor M41. A gate electrode of the thirty-ninth transistor M39 is configured to receive the display reset signal STD, a first electrode of the thirty-ninth transistor M39 is connected to the second node Q2, and a second electrode of the thirty-ninth transistor M39 is configured to receive the fourth voltage VGL1. A gate electrode of the forty-first transistor M41 is configured to receive the global reset signal TRST, a first electrode of the forty-first transistor M41 is connected to the second node Q2, and a second electrode of the forty-first transistor M41 is configured to receive the fourth voltage VGL1.

It should be noted that, in the display panel 10 provided in the embodiments of the present disclosure, in the case that the plurality of shift register units 21 are cascaded to form the gate driving circuit 20, the first output signal terminal OP1 in the first stage of shift register unit is the first output terminal OT1<1> in the first output terminal group of the gate driving circuit 20, and the third output signal terminal OP3 in the first stage of shift register unit is the second output terminal OT2<1> in the first output terminal group of the gate driving circuit 20; the second output signal terminal OP2 in the first stage of shift register unit is the first output terminal OT1<2> in the second output terminal group of the gate driving circuit 20, and the fourth output signal terminal OP4 in the first stage of shift register unit is the second output terminal OT2<2> in the second output terminal group of the gate driving circuit 20. The corresponding relationship between the other stages of shift register units 21 and the output terminals of the gate driving circuit 20 is similar to what is described above, and will not be described again.

As mentioned above, in the shift register unit 21 provided by the embodiments of the present disclosure, for example, the electric potential at the third node H is maintained by using the first capacitor C1, the electric potential at the first node Q1 is maintained by using the second capacitor C2 and the fourth capacitor C4, and the electric potential at the second node Q2 is maintained by using the third capacitor C3 and the fifth capacitor C5. The first capacitor C1, the second capacitor C2, the third capacitor C3, the fourth capacitor C4 and the fifth capacitor C5 for example are capacitor devices manufactured through a process. For example, the capacitor device is realized by manufacturing special capacitor electrodes, and each electrode can be implemented by a metal layer or a semiconductor layer (such as doped polysilicon) or the like; or in some examples, by designing circuit wiring parameters, the first capacitor C1, the second capacitor C2, the third capacitor C3, the fourth capacitor C4 and the fifth capacitor C5 can be realized by the parasitic capacitances between the various devices. The connection method of the first capacitor C1, the second capacitor C2, the third capacitor C3, the fourth capacitor C4 and the fifth capacitor C5 is not limited to the above-mentioned method, or may be other suitable connection methods as long as the levels written to the third node H, the first node Q1 and the second node Q2 can be stored.

In the case that the electric potential of the first node Q1, the second node Q2 or the third node H is maintained at a high level, the first electrodes of some transistors (for example, the first transistor M1, the fourteenth transistor M14, the seventeenth transistor M17, the thirty-eighth transistor M38, the fortieth transistor M40, the twenty-second transistor M22, the twenty-fourth transistor M24, the thirty-ninth transistor M39, and the forty-first transistor M41 and so on) are connected to the first node Q1, the second node Q2 or the third node H, and the second electrodes of these transistors are connected to a low-level signal. Even in the case that a non-conducting signal is input to the gate electrodes of these transistors, electric leakage may occur due to the voltage differences between the first electrodes and the second electrodes of the transistors, which causes the effect of maintaining the electric potential of the first node Q1, the second node Q2, or the third node H to deteriorate.

For example, as shown in FIG. 12A, taking the third node H as an example, the first electrode of the first transistor M1 is configured to receive the second input signal STU2, and the second electrode of the first transistor M1 is connected to the third node H. In the case that the third node H is at a high level and the second input signal STU2 is at a low level, the third node H may leak electricity through the first transistor M1.

Figure 14A:
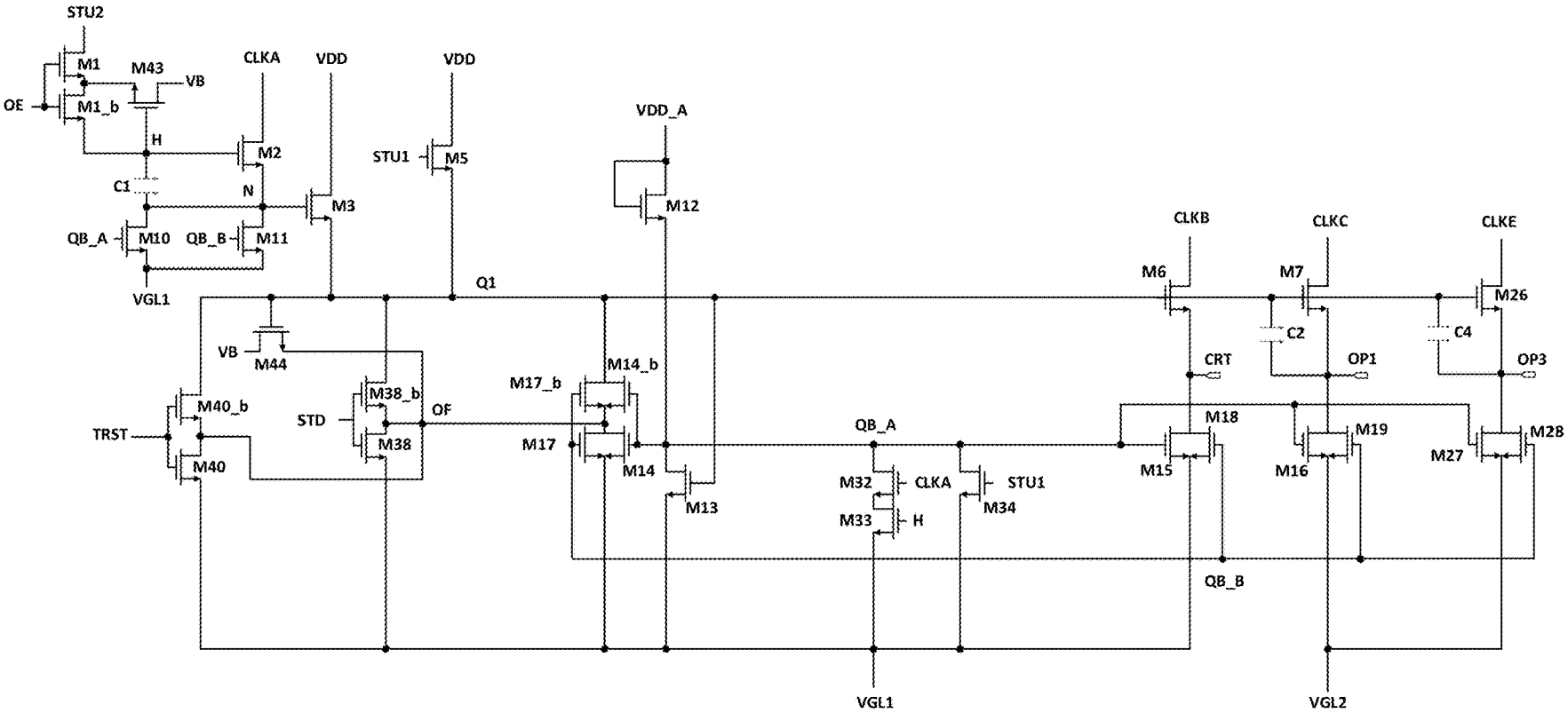
FIG. 14A to FIG. 14C are another circuit diagrams of the shift register unit provided by at least one embodiment of the present disclosure.
Figure 14B:
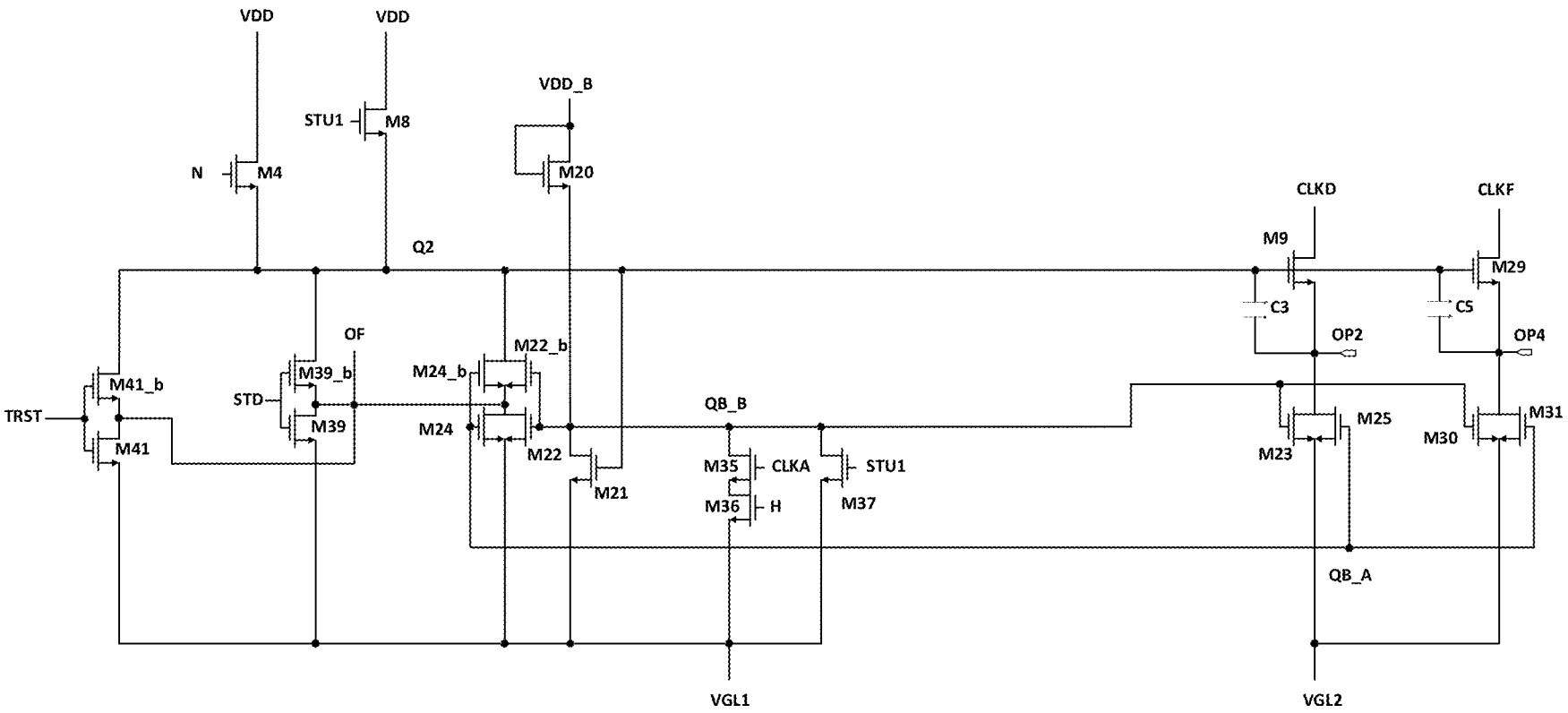

To prevent the electric leakage, for example, as shown in FIGS. 14A and 14B, at least one embodiment of the present disclosure provides the shift register unit 21 having an electric-leakage prevention structure. The shift register unit 21 further includes a common electric-leakage prevention circuit, a first electric-leakage prevention circuit and a second electric-leakage prevention circuit.

The common electric-leakage prevention circuit is electrically connected to the first node Q1 and the seventh node OF, and is configured to control the level of the seventh node OF under the control of the level of the first node Q1. The first electric-leakage prevention circuit is electrically connected to the seventh node OF, the first reset circuit 140, the second reset circuit 150, the fifth reset circuit 180 and the sixth reset circuit 190, and is configured to prevent the electric leakage of the first node Q1 under the control of the level of the seventh node OF. The second electric-leakage prevention circuit is electrically connected to the seventh node OF, the third reset circuit 240, the fourth reset circuit 250, the seventh reset circuit 280 and the eighth reset circuit 290, and is configured to prevent the electric leakage of the second node Q2 under the control of the level of the seventh node OF.

For example, as shown in FIGS. 14A and 14B, the common electric-leakage prevention circuit is implemented as a forty-fourth transistor M44, a gate electrode of the forty-fourth transistor M44 is connected to the first node Q1, a first electrode of the forty-fourth transistor M44 is configured to receive the sixth voltage VB, and a second electrode of the forty-fourth transistor M44 is connected to the seventh node OF. The first electric-leakage prevention circuit is implemented to include transistors M14_*b*, M17_*b*, M38_*b* and M40_*b*. The second electric-leakage prevention circuit is implemented to include transistors M22_*b*, M24_*b*, M39_*b* and M41_*b*. The connection relationship of the transistors M14_b, M17_b, M38_b, M40_b, M22_b, M24_b, M39_b and M41_b is shown in FIGS. 14A and 14B, and is not repeated here.

At the same time, as shown in FIG. 14A, in order to prevent the electric leakage of the third node H, a forty-third transistor M43 and a transistor M1_b are also added. In the following, the working principle of electric-leakage prevention will be described by using the transistor M1_b as an example.

A gate electrode of the transistor M1_b is connected to the gate electrode of the first transistor M1, a first electrode of the transistor M1_b is connected to a second electrode of the forty-third transistor M43, and a second electrode of the transistor M1_b is connected to the third node H. A gate electrode of the forty-third transistor M43 is connected to the third node H, and a first electrode of the forty-third transistor M43 is configured to receive the sixth voltage VB (for example, a high level). In the case that the third node H is at a high level, the forty-third transistor M43 is turned on under the control of the level of the third node H, so that the sixth voltage VB of high level can be input to the first electrode of the transistor M1_b, thus both the first electrode and the second electrode of the transistor M1_b are at a high level, and thereby the charges at the third node H can be prevented from leaking through the transistor M1_b. At this time, because the gate electrode of the transistor M1_b is connected to the gate electrode of the first transistor M1, the combination of the first transistor M1 and the transistor M1_b can achieve the same function as the aforementioned first transistor M1, and also has the effect of preventing electric leakage.

Similarly, as shown in FIG. 14A, the transistors M14_b, M17_b, M38_b and M40_b are connected to the forty-fourth transistor M44 through the seventh node OF, to respectively implement electric-leakage prevention structures, so that the electric leakage of the first node Q1 can be prevented. As shown in FIG. 14B, the transistors M22_b, M24_b, M39_b and M41_b can be connected to the forty-fourth transistor M44 through the seventh node OF to implement electric-leakage prevention structures, respectively, so that the electric leakage of the second node Q2 can be prevented.

In the shift register unit 21 shown in FIGS. 14A and 14B, the first electric-leakage prevention circuit and the second electric-leakage prevention circuit can share the transistor M44, so that the number of transistors can be reduced, so as to reduce the area occupied by the gate driving circuit 20 using the shift register unit 21, thereby further reduce the frame size of the display device using the gate driving circuit 20 and increase the PPI of the display device.

Figure 14C:
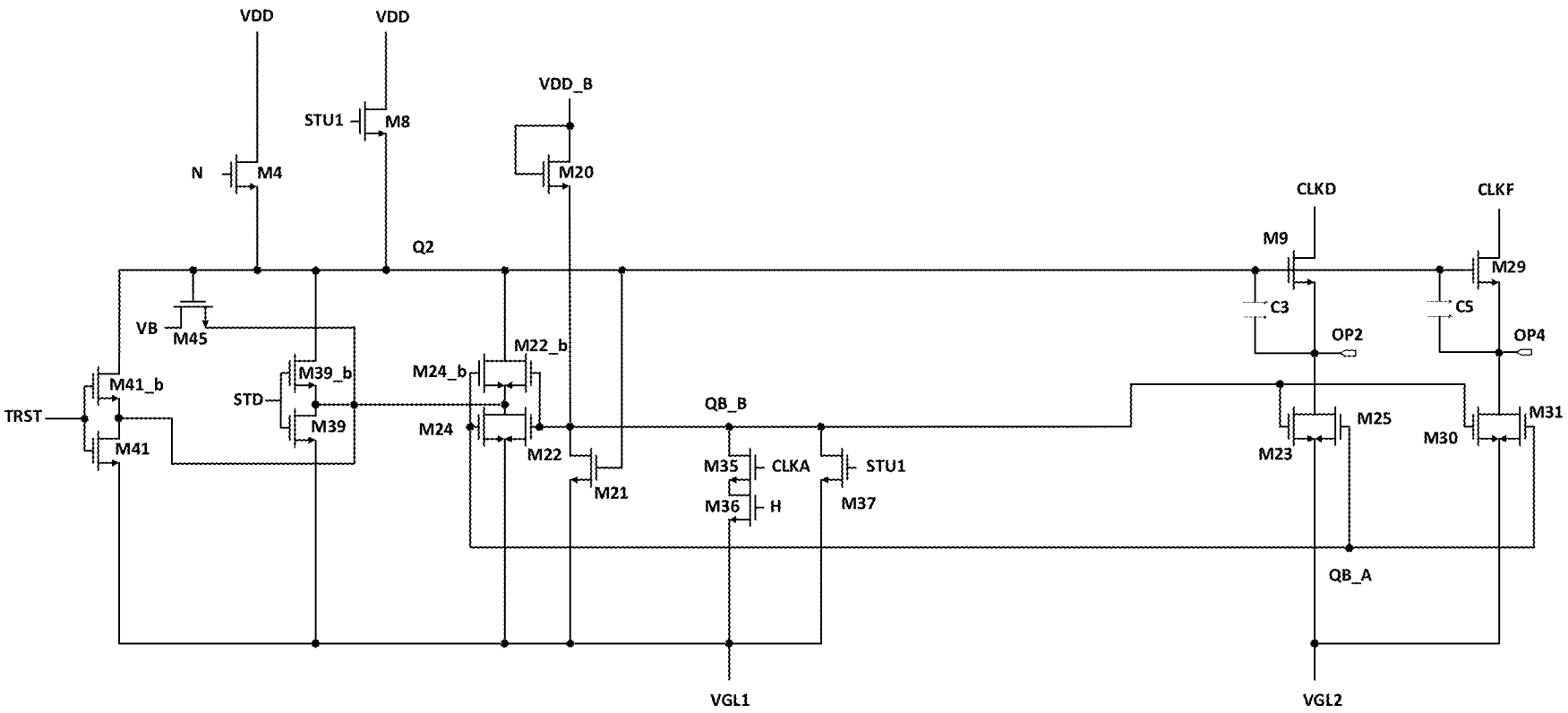

For example, in another example, as shown in FIG. 14C, the second electric-leakage prevention circuit (the transistors M22_b, M24_b, M39_b and M41_b) is not connected to the seventh node OF, but a forty-fifth transistor M45 is separately provided and is used to form the electric-leakage prevention structure, description of which is omitted here.

Similarly, as shown in FIG. 10, for the third transistor M3 and the fourth transistor M4, a transistor M3_b and a transistor M4_b are respectively provided to realize the electric-leakage prevention structure. A gate electrode of the transistor M3_b and a gate electrode of the transistor M4_b are both configured to receive the first clock signal CLKA, and a first electrode of the transistor M3_b and a first electrode of the transistor M4_b are both connected to the seventh node OF, thereby achieving connection with the forty-fourth transistor M44 in FIG. 14A, to respectively realize the electric-leakage prevention structures, so that the electric leakage of the first node Q1 and the electric leakage of the second node Q2 can be prevented.

Similarly, as shown in FIG. 13C, for the fifth transistor M5, a transistor M5_b is provided to realize the electric-leakage prevention structure. A gate electrode of the transistor M5_b is configured to receive the first input signal STU1, and a first electrode of the transistor M5_b is connected to the seventh node OF, so as to be connected to the forty-fourth transistor M44 in FIG. 14A to realize the electric-leakage prevention structure, and thereby it is possible to prevent the electric leakage of the first node Q1.

The transistors used in the embodiments of the present disclosure may all be thin film transistors or field effect transistors or other switching devices with the same characteristics. In the embodiments of the present disclosure, the thin film transistors are used as examples for description. A source electrode and a drain electrode of the transistor used here for example are symmetrical in structure, so there is no difference between structures of the source electrode and the drain electrode of the transistor. In the embodiments of the present disclosure, in order to distinguish the two electrodes of the transistor other than the gate electrode, one of the two electrodes is directly described as the first electrode and the other of the two electrodes is described as the second electrode. In addition, transistors can be classified into N-type and P-type transistors according to the characteristics of the transistors. In the case that the transistor is the P-type transistor, a turn-on voltage of the transistor is a low-level voltage (for example, 0V, −5V, −10V, or other suitable voltages), and a turn-off voltage of the transistor is a high-level voltage (for example, 5V, 10V, or other suitable voltages); in the case that the transistor is the N-type transistor, the turn-on voltage is a high-level voltage (for example, 5V, 10V or other suitable voltages), and the turn-off voltage is a low-level voltage (for example, 0V, −5V, −10V or other suitable voltages).

Figure 15:
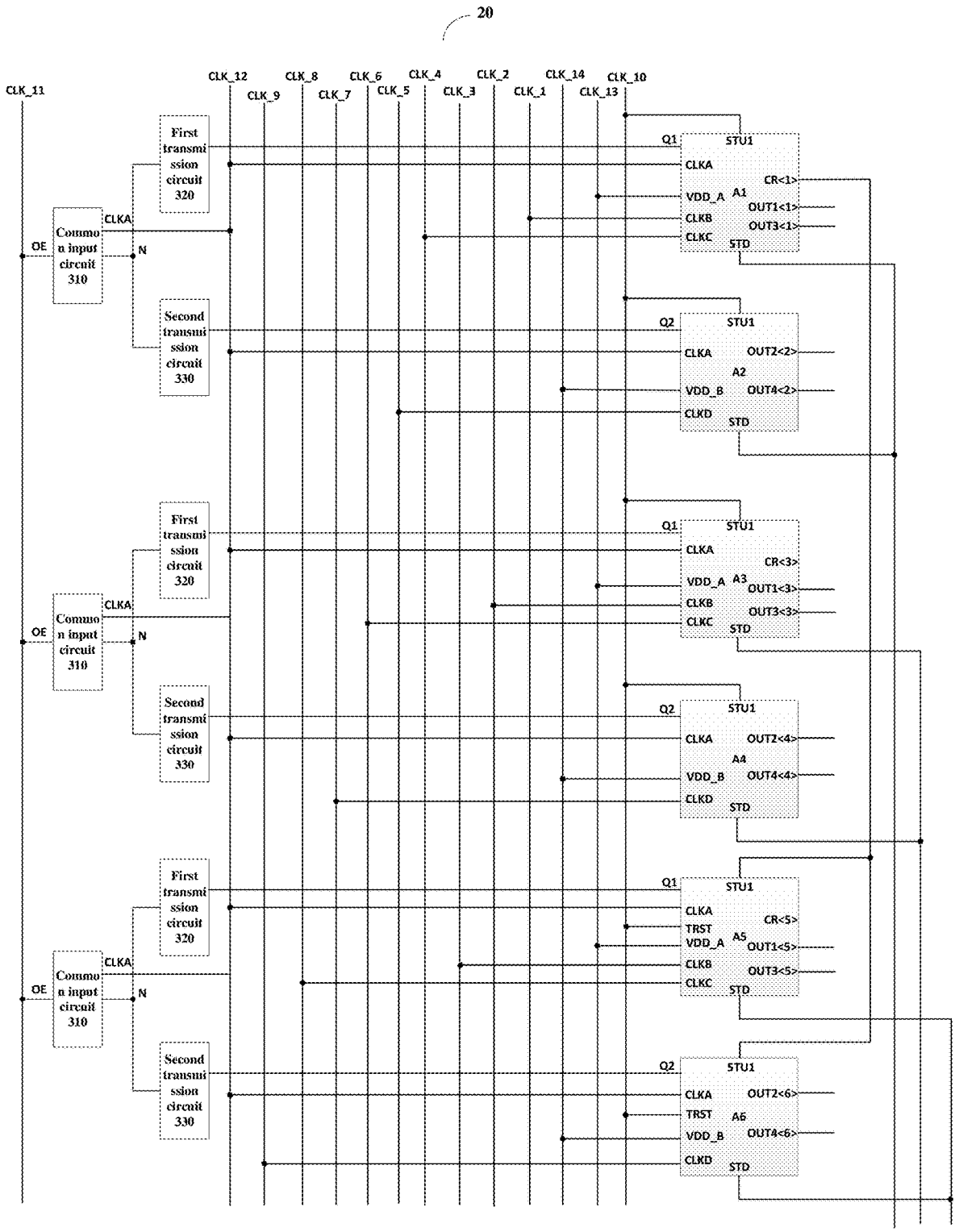
FIG. 15 is a schematic diagram of a gate driving circuit provided by at least one embodiment of the present disclosure.

At least one embodiment of the present disclosure further provides the gate driving circuit 20, as shown in FIG. 15, the gate driving circuit 20 includes the plurality of cascaded shift register units 21, and any one or more shift register units 21 may adopt the structure of the shift register unit 21 provided by the embodiments of the present disclosure or a modification thereof. A1, A2, A3, A4, A5 and A6 in FIG. 15 represent sub-units in the shift register unit 21, for example, A1, A3 and A5 represent the first sub-units of three shift register units 21, respectively, and A2, A4 and A6 represent the second sub-units of the three shift register units 21, respectively.

For example, as shown in FIG. 15, each shift register unit 21 includes the first sub-unit and the second sub-unit. The first sub-unit outputs the first output signal OUT1 and the third output signal OUT3, and the second sub-unit outputs the second output signal OUT2 and the fourth output signal OUT4. In the case that the gate driving circuit 20 is used to drive the plurality of rows of subpixel units in the display panel 10, the first output signal OUT1 and the third output signal OUT3 are used to drive a certain row of subpixel units in the display panel 10, and the second output signal OUT2 and the fourth output signal OUT4 are used to drive another row of subpixel units in the display panel 10. For example, A1, A2, A3, A4, A5 and A6 can drive the first row of subpixel units, the second row of subpixel units, the third row of subpixel units, the fourth row of subpixel units, the fifth row of subpixel units and sixth row of subpixel units of the display panel 10, respectively.

The gate driving circuit 20 provided in the embodiments of the present disclosure can share the blanking input sub-unit, thereby reducing the frame size of the display device using the gate driving circuit 20 and increasing the PPI of the display device. At the same time, random compensation can also be realized, so that display defects such as the scanning line and uneven display brightness which are caused by progressive compensation can be avoided.

In the following, taking the gate driving circuit 20 shown in FIG. 15 as an example, the signal lines in the gate driving circuit 20 are described.

As shown in FIG. 15, the gate driving circuit 20 includes a first sub-clock signal line CLK_1, a second sub-clock signal line CLK_2 and a third sub-clock signal line CLK_3. The first sub-unit in the (3k−2)th stage of shift register unit is connected to the first sub-clock signal line CLK_1 to receive the second clock signal CLKB of the (3k−2)th stage of shift register unit; the first sub-unit in the (3k−1)th stage of shift register unit is connected to the second sub-clock signal line CLK_2 to receive the second clock signal CLKB of the (3k−1)th stage of shift register unit; the first sub-unit in the 3k-th stage of shift register unit is connected to the third sub-clock signal line CLK_3 to receive the second clock signal CLKB of the 3k-th stage of shift register unit; k is an integer greater than zero.

As mentioned above, in the case that the shift register units 21 are cascaded, it is only necessary to sequentially provide the second clock signal CLKB to the first sub-unit in each stage of shift register unit 21, and the second clock signal CLKB can be used as the shift signal CR and be output to complete scanning and shift.

As shown in FIG. 15, the gate driving circuit 20 further includes a fourth sub-clock signal line CLK_4, a fifth sub-clock signal line CLK_5, a sixth sub-clock signal line CLK_6, a seventh sub-clock signal line CLK_7, an eighth sub-clock signal line CLK_8, a ninth sub-clock signal line CLK_9, a fifteenth sub-clock signal line CLK_15, a sixteenth sub-clock signal line CLK_16, a seventeenth sub-clock signal line CLK_17 and an eighteenth sub-clock signal line CLK_18. It should be noted that for clarity, the fifteenth sub-clock signal line CLK_15, the sixteenth sub-clock signal line CLK_16, the seventeenth sub-clock signal line CLK_17 and the eighteenth sub-clock signal line CLK_18 are not shown in FIG. 15.

The first sub-unit in the (3k−2)th stage of shift register unit is connected to the fourth sub-clock signal line CLK_4 to receive the third clock signal CLKC of the (3k−2)th stage of shift register unit, and the second sub-unit in the (3k−2)th stage of shift register unit is connected to the fifth sub-clock signal line CLK_5 to receive the fourth clock signal CLKD of the (3k−2)th stage of shift register unit.

The first sub-unit in the (3k−1)th stage of shift register unit is connected to the sixth sub-clock signal line CLK_6 to receive the third clock signal CLKC of the (3k−1)th stage of shift register unit, and the second sub-unit in the (3k−1)th stage of shift register unit is connected to the seventh sub-clock signal line CLK_7 to receive the fourth clock signal CLKD of the (3k−1)th stage of shift register unit.

The first sub-unit in the 3k-th stage of shift register unit is connected to the eighth sub-clock signal line CLK_8 to receive the third clock signal CLKC of the 3k-th stage of shift register unit, and the second sub-unit in the 3k-th stage of shift register unit is connected to the ninth sub-clock signal line CLK_9 to receive the fourth clock signal CLKD of the 3k-th stage of shift register unit.

Figure 16:
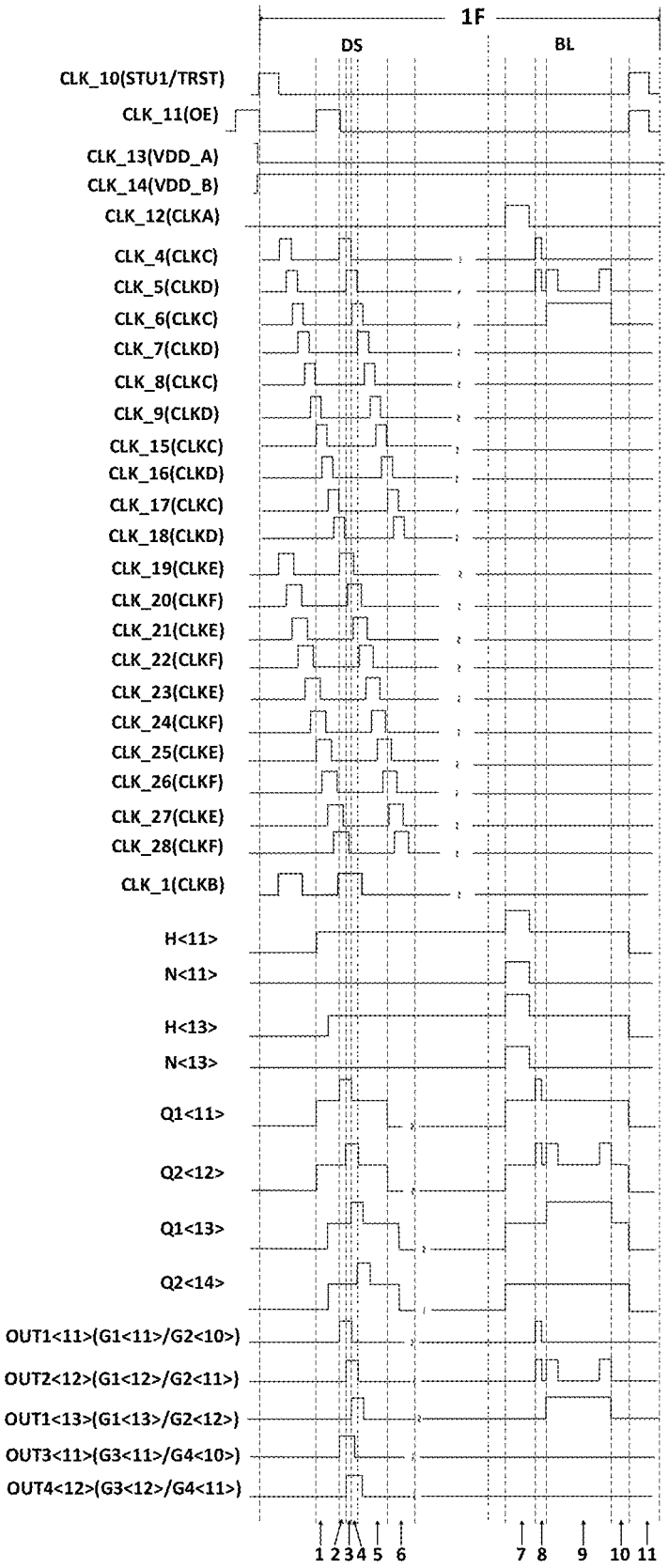
FIG. 16 is a signal timing diagram corresponding to the gate driving circuit shown in FIG. 15 during operation provided by at least one embodiment of the present disclosure.

As described above, by a total of ten clock signal lines including the fourth sub-clock signal line CLK_4, the fifth sub-clock signal line CLK_5, the sixth sub-clock signal line CLK_6, the seventh sub-clock signal line CLK_7, the eighth sub-clock signal line CLK_8, the ninth sub-clock signal line CLK_9, the fifteenth sub-clock signal line CLK_15, the sixteenth sub-clock signal line CLK_16, the seventeenth sub-clock signal line CLK_17 and the eighteenth sub-clock signal line CLK_18, the shift register units 21 are provided with the driving signal that is output row by row (for specific signal time sequence, refer to FIG. 16). That is, the gate driving circuit 20 provided in the embodiments of the present disclosure may use 10CLK clock signals, so that the waveforms of the driving signals output by the gate driving circuit 20 may overlap, and for example, the precharge time of each row of subpixel units may be increased. Therefore, the gate driving circuit 20 can be applied to high-frequency scanning display.

In addition, the gate driving circuit 20 also includes a total of ten clock signal lines from the nineteenth to the twenty-eighth clock signal lines (CLK_19 to CLK_28), and the ten clock signal lines are not shown in FIG. 15. For the specific signal time sequence of the ten clock signal lines, refer to FIG. 16. As shown in FIG. 16, the clock signals of CLK_19 to CLK_28 are also 10CLK, and the fifth clock signal CLKE and the sixth clock signal CLKF are provided to the cascaded shift register units 21 through the ten clock signal lines of CLK_19 to CLK_28. That is, the driving signal output by the third output signal terminal OP3 and the driving signal output by the fourth output signal terminal OP4 of the shift register unit 21 are continuous in time sequence. It should be noted that, in this embodiment, for example, a pulse width of the fifth clock signal CLKE (or the sixth clock signal CLKF) is wider than a pulse width of the third clock signal CLKC (or the fourth clock signal CLKD). Embodiments of the present disclosure include, but are not limited to this.

As shown in FIG. 15, the gate driving circuit 20 further includes a tenth sub-clock signal line CLK_10, an eleventh sub-clock signal line CLK_11 and a twelfth sub-clock signal line CLK_12.

As shown in FIG. 15, in this embodiment, the tenth sub-clock signal line CLK_10 is connected to the first sub-units and the second sub-units (i.e., A1, A2, A3 and A4) in the first two stages of the shift register units 21 to provide the first input signal STU1, and at the same time, the tenth sub-clock signal line CLK_10 is also connected to other two stages of shift register units 21 to provide the global reset signal TRST. In this way, the number of clock signal lines can be reduced, thereby reducing the frame size of the display device using the gate driving circuit 20 and increasing the PPI of the display device. For example, for the first two stages of the shift register units 21, the fortieth transistor M40 and the forty-first transistor M41 are not provided.

The common input circuit 310 in each stage of shift register unit 21 is connected to the eleventh sub-clock signal line CLK_11 to receive the selection control signal OE. The first sub-unit, the second sub-unit and the common input circuit 310 in each stage of shift register unit 21 are connected to the twelfth sub-clock signal line CLK_12 to receive the first clock signal CLKA.

As shown in FIG. 15, the gate driving circuit 20 further includes a thirteenth sub-clock signal line CLK_13 and a fourteenth sub-clock signal line CLK_14.

For example, the first sub-unit in each stage of shift register unit 21 is connected to the thirteenth sub-clock signal line CLK_13 to receive the second voltage VDD_A; the second sub-unit in each stage of shift register unit 21 is connected to the fourteenth sub-clock signal line CLK_14 to receive the third voltage VDD_B.

As shown in FIG. 15, except for the first two stages of the shift register units 21, both the first sub-units and the second sub-units in the other stages of the shift register units 21 are connected to the first sub-units in the first two stages of the shift register units 21 to receive the shift signal CR as the first input signal STU1. Except for the last four stages of shift register units 21, both the first sub-units and the second sub-units in the other stages of shift register units 21 are connected to the first sub-units in the last four stages of shift register units 21 to receive the shift signal CR as the display reset signal STD.

It should be noted that the cascading relationship shown in FIG. 15 is only an example. According to the description of the present disclosure, other cascading manners may also be adopted according to the actual situation.

For example, in at least one example, the shift register unit 21 in the gate driving circuit 20 shown in FIG. 15 adopts the circuit structure shown in FIGS. 12A and 12B, and FIG. 16 is a diagram of the signal time sequence of the gate driving circuit 20 shown in FIG. 15 in operation.

In FIG. 16, H<11> and H<13> respectively represent the third nodes H in the sixth stage of shift register unit 21 and the seventh stage of shift register unit 21, the sixth stage of shift register unit 21 corresponds to the eleventh and twelfth rows of subpixel units in the display panel, and the seventh stage of shift register unit 21 corresponds to the thirteenth and fourteenth rows of subpixel units in the display panel. N<11> and N<13> represent the fourth nodes N in the sixth stage of shift register unit 21 and the seventh stage of shift register unit 21, respectively.

Q1<11> and Q2<12> respectively represent the first node Q1 and the second node Q2 which are in the sixth stage of shift register unit 21; Q1<13> and Q2<14> respectively represent the first node Q1 and the second node Q2 which are in the seventh stage of shift register unit 21. The number in parentheses indicates the number of rows of subpixel units in the display panel corresponding to the node. The following embodiments are the same, and will not be described again.

OUT1<11> and OUT2<12> represent the first output signal OUT1 and the second output signal OUT2 which are output by the sixth stage of shift register unit 21, respectively. Similarly, OUT1<13> represents the first output signal OUT1 output by the seventh stage of shift register unit 21, and OUT3<11> and OUT4<12> represent the third output signal OUT3 and the fourth output signal OUT4 which are output by the sixth stage of shift register unit 21, respectively.

1F represents the first frame, DS represents the display period in the first frame, and BL represents the blanking period in the first frame. In addition, it should be noted that in FIG. 16, the second voltage VDD_A is at a low level and the third voltage VDD_B is at a high level for illustration, but the embodiments of the present disclosure are not limited thereto. The signal levels in the signal timing diagram shown in FIG. 16 are only schematic and do not represent true level values.

The working principle of the gate driving circuit 20 shown in FIG. 15 will be described below with reference to the signal timing diagram in FIG. 16 and the shift register unit 21 shown in FIGS. 12A and 12B.

Before the start of the first frame 1F, the tenth sub-clock signal line CLK_10 and the eleventh sub-clock signal line CLK_11 provide a high level, and the fortieth transistor M40 and the forty-first transistor M41 which are in each stage of shift register unit 21 are turned on, so that the first node Q1 and the second node Q2 which are in each stage of shift register unit 21 can be reset; the first transistor M1 in each stage of shift register unit 21 is turned on, because the second input signal STU2 that is received at the same time is a low level, the third node H in each stage of shift register unit 21 can be reset, thereby achieving a global reset before the start of the first frame 1F.

In the display period DS of the first frame 1F, the working process of the sixth stage of shift register units 21 and the seventh stage of shift register unit 21 (that is, corresponding to the eleventh to fourteenth rows of subpixel units in the display panel) is described as follows.

In the first stage 1, the shift signal (the signal provided by the fifteenth sub-clock signal line CLK_15) output by the first sub-unit in the fourth stage of shift register unit 21 is at a high level, that is, the first input signal STU1 received by the sixth stage of shift register unit 21 is a high level, so the fifth transistor M5 and the eighth transistor M8 are turned on. The first voltage VDD of high level charges the first node Q1<11> through the fifth transistor M5, and charges the second node Q2<12> through the eighth transistor M8, thereby pulling up the first node Q1<11> and the second node Q2<12> to a high level.

The seventh transistor M7 and the twenty-sixth transistor M26 are turned on under the control of the first node Q1<11>, but because the third clock signal CLKC provided by the fourth sub-clock signal line CLK_4 is at a low level at this time, the first output signal OUT1<11> output by the six stage of shift register unit 21 is at a low level, and at the same time, because the fifth clock signal CLKE provided by the nineteenth sub-clock signal line CLK_19 is at a low level at this time, the third output signal OUT3<11> output by the sixth stage shift register unit 21 is at a low level; the ninth transistor M9 and the twenty-ninth transistor M29 are turned on under the control of the second node Q2<12>, but because the fourth clock signal CLKD provided by the five sub-clock signal line CLK_5 is a low level at the same time, the second output signal OUT2<12> output by the sixth stage of shift register unit 21 is a low level, and at the same time, because the sixth clock signal CLKF provided by the clock signal line CLK_20 is at a low level, the fourth output signal OUT4<12> output by the sixth stage of shift register unit 21 is at a low level; at this stage, the precharge for the first node and the second node which are in the sixth stage of shift register unit 21 are completed at the same time.

In the second stage 2, the third clock signal CLKC provided by the fourth sub-clock signal line CLK_4 becomes a high level, and the fifth clock signal CLKE provided by the nineteenth sub-clock signal line CLK_19 becomes a high level. The electric potential of the first node Q1<11> is further pulled up due to the bootstrap effect, so the seventh transistor M7 and the twenty-sixth transistor M26 remain on, so that the first output signal OUT1<11> and the third output signal OUT3<11> which are output by the sixth stage of shift register unit 21 become a high level. However, at this time, because the fourth clock signal CLKD provided by the fifth sub-clock signal line CLK_5 and the sixth clock signal CLKF provided by the twentieth sub-clock signal line CLK_20 are still a low level, the second output signal OUT2<12> and the fourth output signal OUT4<12> which are output by the sixth stage of shift register unit 21 remain a low level.

In the third stage 3, the fourth clock signal CLKD provided by the fifth sub-clock signal line CLK_5 becomes a high level, the sixth clock signal CLKF provided by the twentieth sub-clock signal line CLK_20 becomes a high level, the electric potential of the second node Q2<12> is further pulled up due to the bootstrap effect, and the ninth transistor M9 and the twenty-ninth transistor M29 remain on, so that the second output signal OUT2<12> and the fourth output signal OUT4<12> which are output by the sixth stage of shift register unit 21 become a high level.

In the fourth stage 4, due to the holding effect of the second capacitor C2 and the fourth capacitor C4, the first node Q1<11> still remains at a high level, so the seventh transistor M7 and the twenty-sixth transistor M26 are turned on. However, because the third clock signal CLKC provided by the fourth sub-clock signal line CLK_4 becomes a low level, the first output signal OUT1<11> output by the sixth stage of shift register unit 21 becomes a low level. At the same time, due to the bootstrap effect of the second capacitor C2, the electric potential of the first node Q1<11> also drop. At this stage, because the pulse width of the fifth clock signal CLKE provided by the nineteenth sub-clock signal line CLK_19 is larger than the pulse width of the third clock signal CLKC provided by the fourth sub-clock signal line CLK_4, the third output signal OUT3<11> output by the sixth stage of shift register unit 21 remains at a high level before falling to a low level.

In the fifth stage 5, due to the holding effect of the third capacitor C3 and the fifth capacitor C5, the second node Q2<12> still maintains a high level, so the ninth transistor M9 and the twenty-ninth transistor M29 are turned on. However, because the fourth clock signal CLKD provided by the fifth sub-clock signal line CLK_5 becomes a low level, the second output signal OUT2<12> output by the sixth stage of shift register unit 21 becomes a low level. At the same time, due to the bootstrap effect of the third capacitor C3, the electric potential of the second node Q2<12> also drop. At this stage, because the pulse width of the sixth clock signal CLKF provided by the twentieth sub-clock signal line CLK_20 is wider than the pulse width of the fourth clock signal CLKD provided by the fifth sub-clock signal line CLK_5, the fourth output signal OUT4<12> output by the sixth stage of shift register unit 21 remains at a high level before falling to a low level.

In the sixth stage 6, because the clock signals of 10CLK are used in this embodiment, the signals output by every five shift register units 21 (each stage sequentially outputs the first output signal OUT1 and the second output signal OUT2) form one cycle, at the same time, because the sixth stage of shift register unit 21 receives the shift signal CR output by the tenth stage of shift register unit 21 as the display reset signal STD, at this stage in the case that the third clock signal CLKC provided by the seventeenth sub-clock signal line CLK_17 becomes a high level, the display reset signal STD received by the sixth stage of shift register unit 21 is also high, so that the thirty-eighth transistor M38 and the thirty-ninth transistor M39 are turned on, and thus the fourth voltage VGL1 of low level can be used to reset the first node Q1<11> and the second node Q2<12>.

After the sixth stage of shift register unit 21 drives the subpixel units in the eleventh and twelfth rows in the display panel to complete display; by analogy, the seventh, eighth and other shift register units 21 drive the subpixel units in the display panel to complete the display driving of one frame row by row, whereby the display period of the first frame ends.

At the same time, in the display period DS of the first frame 1F, the third node H<11> in the sixth stage of shift register unit is also charged. For example, in the case that the first frame 1F requires that the twelfth row of subpixel unit groups are sensed, the following operations are also performed in the display period DS of the first frame 1F.

In the first stage 1, the selection control signal OE provided by the eleventh sub-clock signal line CLK_11 and the shift signal (the signal provided by the fifteenth sub-clock signal line CLK_15) output by the first sub-unit in the fourth stage of shift register unit 21 may be the same, so the first transistor M1 is turned on. At the same time, the second input signal STU2 received by the sixth stage of shift register unit 21 and the shift signal output by the first sub-unit in the fourth stage of shift register unit 21 may be the same, so that the second input signal STU2 of high level can charge the third node H<11> to pull up the third node H<11> to a high level.

It should be noted that the foregoing charging process for the third node H<11> is only an example, and the embodiments of the present disclosure include but are not limited thereto. For example, the second input signal STU2 received by the sixth stage of shift register unit 21 is also the same as the shift signal output by the other stage of shift register unit 21, and at the same time, the signal provided to the eleventh sub-clock signal line CLK_11 and the second input signal STU2 have the same time sequence.

In the first stage 1, due to the overlap between the 10CLK clock signals which are used, in the case that the selection control signal OE is a high level, the third node H<13> in the seventh stage of shift register unit is also charged to a high level.

The high electric potentials of H<11> and H<13> can be maintained until the blanking period BL of the first frame 1F. In the case that the twelfth row of subpixel unit groups needs to be sensed in the first frame 1F, the following operations are performed in the blanking period BL of the first frame 1F. It should be noted that the following description is made by taking the case that the first subpixel unit 40 in the subpixel unit group of the twelfth row as an example.

In the seventh stage 7, the first clock signal CLKA provided by the twelfth sub-clock signal line CLK_12 is at a high level. For the sixth stage of shift register unit, because the third node H<11> is maintained to be a high level at this stage, the second transistor M2 is turned on, and the first clock signal CLKA of high level is transmitted to the fourth node N<11> through the second transistor M2, so that the fourth node N<11> becomes a high level. The third transistor M3 and the fourth transistor M4 are turned on under the control of the fourth node N<11>, so the first voltage VDD of high level can charge the first node Q1<11> and the second node Q2<12>, respectively, so that the electric potentials of the first node Q1<11> and the second node Q2<12> are pulled up.

At the same time, in the seventh stage 7, due to the coupling effect of the first capacitor C1, in the case that the fourth node N<11> changes from a low level to a high level, the fourth node N<11> couples and pulls up the third node H<11>, so that the third node H<11> can be maintained at a high electric potential which is relatively high, which ensures that the second transistor M2 is fully turned on.

Then the first clock signal CLKA provided by the twelfth sub-clock signal line CLK_12 changes from a high level to a low level, so that the fourth node N<11> becomes a low level. Due to the coupling effect of the first capacitor C1, the electric potential of the third node H<11> also drops.

Similarly, for the seventh stage of shift register unit, the change processes of the third node H<13>, the fourth node N<13>, the first node Q1<13> and the second node Q2<14> can be referred to the above description of the sixth stage of shift register unit and is not repeated here.

In the eighth stage 8, the third clock signal CLKC provided by the fourth sub-clock signal line CLK_4 becomes a high level, and the electric potential of the first node Q1<11> is further pulled up due to the bootstrap effect, so the seventh transistor M7 remains on, and thus the first output signal OUT1<11> output by the sixth stage of shift register unit 21 becomes a high level.

At the same time, in the eighth stage 8, the fourth clock signal CLKD provided by the fifth sub-clock signal line CLK_5 becomes a high level, and the electric potential of the second node Q2<12> is further pulled up due to the bootstrap effect, so the ninth transistor M9 remains on, and thus the second output signal OUT2<12> output by the sixth stage of shift register unit 21 becomes a high level.

It should be noted that, in the eighth stage, in the case that the third clock signal CLKC provided by the fourth sub-clock signal line CLK_4 becomes a low level, correspondingly, the electric potential of the first node Q1<11> in the sixth stage of shift register unit 21 and the electric potential of the first output signal OUT1<11> also drop. Similarly, in the case that the fourth clock signal CLKD provided by the fifth sub-clock signal line CLK_5 becomes a low level, correspondingly, the electric potential of the second node Q2<12> in the sixth stage of shift register unit 21 and the electric potential of the second output signal OUT2<12> also drop.

In the ninth stage 9, the fourth clock signal CLKD provided by the fifth sub-clock signal line CLK_5 becomes a high level, and the electric potential of the second node Q2<12> is further pulled up due to the bootstrap effect, so the ninth transistor M9 remains on, and thus the second output signal OUT2<12> output by the sixth stage of shift register unit 21 becomes a high level.

At the same time, in the ninth stage 9, the third clock signal CLKC provided by the sixth sub-clock signal line CLK_6 becomes a high level, the electric potential of the first node Q1<13> is further pulled up due to the bootstrap effect, so the seventh transistor M7 remains on, and thus the first output signal OUT1<13> output by the seventh stage of shift register unit 21 becomes a high level.

It should be noted that, in the ninth stage 9, in the case that the fourth clock signal CLKD provided by the fifth sub-clock signal line CLK_5 becomes a low level, correspondingly, the electric potential of the second node Q2<12> in the sixth stage of shift register unit 21 and the electric potential of the second output signal OUT2<12> also drop.

In the tenth stage 10, the fourth clock signal CLKD provided by the fifth sub-clock signal line CLK_5 becomes a low level, and accordingly, the electric potential of the second node Q2<12> in the sixth stage of shift register unit 21 and the electric potential of the second output signal OUT2<12> also drop.

At the same time, in the tenth stage 10, the third clock signal CLKC provided by the sixth sub-clock signal line CLK_6 becomes a high level. Accordingly, the electric potential of the first node Q1<13> in the seventh stage of shift register unit 21 and the electric potential of the first output signal OUT1<13> also decrease.

In the eleventh stage 11, the tenth sub-clock signal line CLK_10 and the eleventh sub-clock signal line CLK_11 provide a high level, and both the fortieth transistor M40 and the forty-first transistor M41 in each stage of shift register unit 21 are turned on, so that the first node Q1 and the second node Q2 which are in each stage of shift register unit 21 can be reset; the first transistor M1 in each stage of shift register unit 21 is turned on, and because the received second input signal STU2 is a low level at this time, the third node H in each stage of shift register unit 21 can be reset, thereby completing the global reset.

So far, the driving sequence of the first frame ends. For subsequent driving of the gate driving circuit in the second frame, the third frame and more stages, reference may be made to the foregoing description, and details are not described herein again.

It should be noted that, in the embodiments of the present disclosure, the same time sequence of two signals means that time of a high level synchronous, and it is not required that the amplitudes of the two signals are the same.

In addition, the above description is made by taking the case that the first subpixel unit 40 in the subpixel unit group 70 is sensed as an example. For example, the second subpixel unit 50 in the subpixel unit group 70 is also selected for sensing during the blanking period of one frame. The working principle is similar to that described above and is not described again. For another example, during the blanking period of one frame, the first subpixel unit 40 in the subpixel unit group 70 is sensed first, and then the second subpixel unit 50 in the subpixel unit group 70 is sensed; or, in the blanking period of one frame, the second subpixel unit 50 in the subpixel unit group 70 is sensed first, and then the first subpixel unit 40 in the subpixel unit group 70 is sensed.

Figure 17:
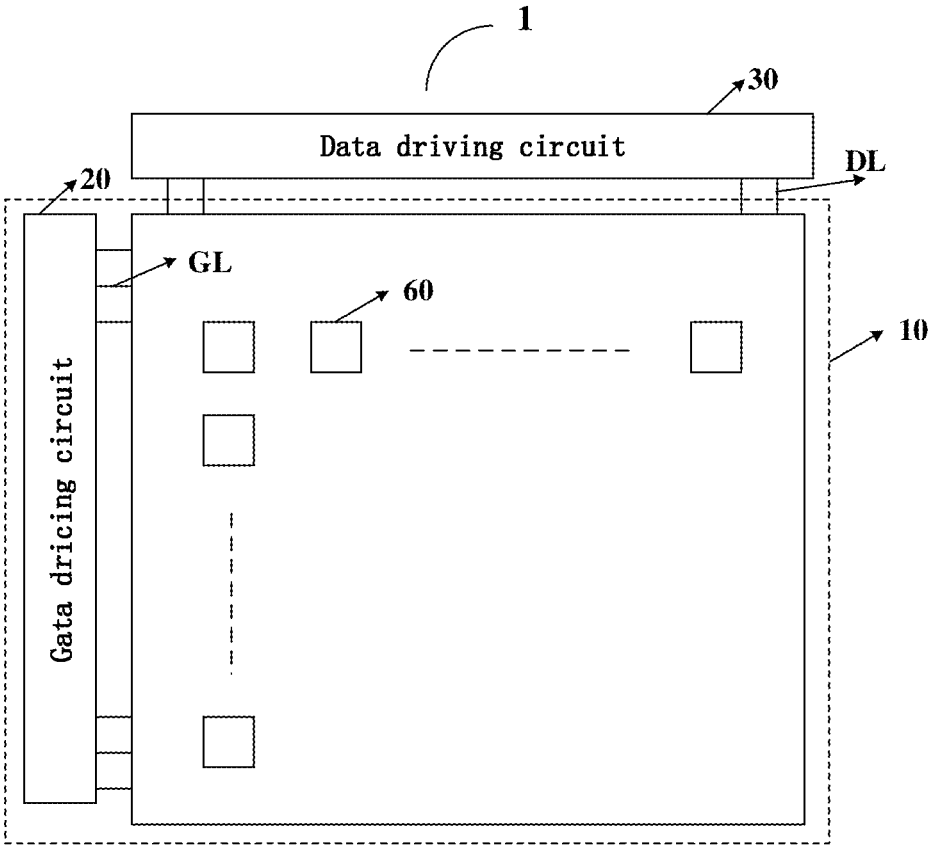
FIG. 17 is a schematic diagram of a display device provided by at least one embodiment of the present disclosure.

The embodiments of the present disclosure further provide a display device 1. As shown in FIG. 17, the display device 1 includes the electronic panel (such as the display panel 10) provided by any one of the embodiments of the present disclosure, and a pixel array including a plurality of subpixel units 60 is provided in the electronic panel (for example, the display panel 10).

For each shift register unit in the gate driving circuit 20, the first output signal OUT1 and the second output signal OUT2 that are output are respectively provided to different rows of subpixel units 60, the third output signal OUT3 and the fourth output signal OUT4 are respectively provided to different rows of the subpixel units 60, the first output signal OUT1 and the third output signal OUT3 are respectively provided to different subpixel units in the same subpixel unit group in the same row, and the second output signals OUT2 and the fourth output signals OUT4 are respectively provided to different subpixel units in the same subpixel unit group in another row. For example, the gate driving circuit 20 is electrically connected to the subpixel units 60 through the gate lines GL. The gate driving circuit 20 is used to provide the driving signal to the pixel array. For example, the driving signal can drive the scanning transistor (first scanning transistor or second scanning transistor) and the sensing transistor (first sensing transistor or second sensing transistor) which are in the subpixel unit 60.

For example, the display device 1 further includes a data driving circuit 30 for providing the data signal to the pixel array. For example, the data driving circuit 30 is electrically connected to the subpixel units 60 through the data lines DL.

It should be noted that the display device 1 in the embodiments may be any product or component having a display function such as a display, an OLED panel, an OLED TV, a mobile phone, a tablet computer, a notebook computer, a digital photo frame, a navigator, or the like.

For technical effects of the display device 1 provided by the embodiments of the present disclosure, reference may be made to the corresponding descriptions of the display panel 10 in the foregoing embodiments, and details are not described herein again.

What are described above is related to the illustrative embodiments of the disclosure only and not limitative to the scope of the disclosure; the scopes of the disclosure are defined by the accompanying claims.

What is claimed is:

1. An electronic panel, comprising a gate driving circuit and a plurality of subpixel units arranged in an array, the array comprising N rows and M columns, wherein each row of subpixel units is divided into a plurality of subpixel unit groups, and each subpixel unit group comprises a first subpixel unit and a second subpixel unit;

the first subpixel unit comprises a first light emitter unit, a first pixel driving circuit configured to drive the first light emitter unit to emit light, and a first sensing circuit configured to sense the first pixel driving circuit;

the second subpixel unit comprises a second light emitter unit, a second pixel driving circuit configured to drive the second light emitter unit to emit light, and a second sensing circuit configured to sense the second pixel driving circuit;

the gate driving circuit comprises N+1 output terminal groups arranged in sequence, each output terminal group comprises a first output terminal and a second output terminal, a plurality of first output terminals in the N+1 output terminal groups are configured to output a first gate scanning signal that turns on a plurality of first subpixel units in the N rows of the subpixel units of the array row by row, and a plurality of second output terminals in the N+1 output terminal groups are configured to output a second gate scanning signal that turns on a plurality of second subpixel units in the N rows of the subpixel units of the array row by row;

the first pixel driving circuit of the first subpixel unit in the subpixel unit group of an nth row among the N rows is connected to the first output terminal of an nth output terminal group among the N+1 output terminal groups of the gate driving circuit to receive the first gate scanning signal as a first scanning driving signal, and the first sensing circuit of the first subpixel unit in the subpixel unit group of the nth row is connected to the first output terminal of an (n+1)th output terminal group among the N+1 output terminal groups of the gate driving circuit to receive the first gate scanning signal as a first sensing driving signal;

the second pixel driving circuit of the second subpixel unit in the subpixel unit group of the nth row is connected to the second output terminal of the nth output terminal group of the gate driving circuit to receive the second gate scanning signal as a second scanning driving signal, and the second sensing circuit of the second subpixel unit in the subpixel unit group of the nth row is connected to the second output terminal of the (n+1)th output terminal group of the gate driving circuit to receive the second gate scanning signal as a second sensing driving signal;

wherein $1 \leq i \leq N$, and N and M are integers greater than or equal to 2.

2. The electronic panel according to claim 1, wherein the first pixel driving circuit comprises a first data writing circuit, a first driving circuit and a first charge storage circuit;

the first driving circuit is connected to the first data writing circuit, the first charge storage circuit, the first light emitter unit and the first sensing circuit, and the first driving circuit is configured to control a first driving current for driving the first light emitter unit to emit light;

the first data writing circuit is further connected to the first charge storage circuit, and the first data writing circuit is configured to receive the first scanning driving signal and write a first data signal to the first driving circuit in response to the first scanning driving signal;

the first sensing circuit is further connected to the first charge storage circuit and the first light emitter unit, and the first sensing circuit is configured to receive the first sensing driving signal, and write a first reference voltage signal to the first driving circuit in response to the first sensing driving signal or read the first sensing voltage signal from the first driving circuit; and the first charge storage circuit is further connected to the first light emitter unit and is configured to store the first data signal and the first reference voltage signal which are written.

3. The electronic panel according to claim 2, wherein the second pixel driving circuit comprises a second data writing circuit, a second driving circuit and a second charge storage circuit;

the second driving circuit is connected to the second data writing circuit, the second charge storage circuit, the second light emitter unit and the second sensing circuit, and the second driving circuit is configured to control a second driving current for driving the second light emitter unit to emit light;

the second data writing circuit is further connected to the second charge storage circuit, and the second data writing circuit is configured to receive the second scanning driving signal and write a second data signal to the second driving circuit in response to the second scanning driving signal;

the second sensing circuit is further connected to the second charge storage circuit and the second light emitter unit, and the second sensing circuit is configured to receive the second sensing driving signal, and write a second reference voltage signal to the second driving circuit in response to the second sensing driving signal or read the second sensing voltage signal from the second driving circuit; and the second charge storage circuit is further connected to the second light emitter unit and is configured to store the second data signal and the second reference voltage signal which are written.

4. The electronic panel according to claim 3, further comprising a plurality of data lines and a plurality of sensing lines; wherein the first data writing circuit and the second data writing circuit which are in each subpixel unit group are connected to the same data line among the plurality of data lines;

the first sensing circuit and the second sensing circuit which are in each subpixel unit group are connected to the same sensing line among the plurality of sensing lines.

5. The electronic panel according to claim 3, further comprising 2N+2 gate lines arranged in sequence; wherein the 2N+2 gate lines are respectively connected to the N+1 first output terminals of the gate driving circuit and the N+1 second output terminals of the gate driving circuit in a one-to-one manner;

the first data writing circuit in the subpixel unit group of the nth row is connected to the first output terminal in the nth output terminal group of the gate driving circuit through a (2n−1)th gate line among the 2N+2 gate lines;

the second data writing circuit in the subpixel unit group of the nth row is connected to the second output terminal in the nth output terminal group of the gate driving circuit through a (2n)th gate line among the 2N+2 gate lines;

the first sensing circuit in the subpixel unit group of the nth row is connected to the first output terminal in the (n+1)th output terminal group of the gate driving circuit through a (2n+1)th gate line among the 2N+2 gate lines;

the second sensing circuit in the subpixel unit group of the nth row is connected to the second output terminal in the (n+1)th output terminal group of the gate driving circuit through a (2n+2)th gate line among the 2N+2 gate lines.

6. The electronic panel according to claim 3, wherein the second data writing circuit comprises a second scanning transistor, the second driving circuit comprises a second driving transistor, the second sensing circuit comprises a second sensing transistor, and the second charge storage circuit comprises a second storage capacitor;

a gate electrode of the second scanning transistor is configured to receive the second scanning driving signal, a first electrode of the second scanning transistor is configured to receive the second data signal, and a second electrode of the second scanning transistor is connected to a gate electrode of the second driving transistor;

a first electrode of the second driving transistor is configured to receive a first driving voltage for generating the second driving current, and a second electrode of the second driving transistor is connected to a first electrode of the second sensing transistor;

a gate electrode of the second sensing transistor is configured to receive the second sensing driving signal, and a second electrode of the second sensing transistor is configured to receive the second reference voltage signal or output the second sensing voltage signal; and a first electrode of the second storage capacitor is connected to a gate electrode of the second driving transistor, and a second electrode of the second storage capacitor is connected to the second electrode of the second driving transistor.

7. The electronic panel according to claim 2, wherein the first data writing circuit comprises a first scanning transistor, the first driving circuit comprises a first driving transistor, the first sensing circuit comprises a first sensing transistor, and the first charge storage circuit comprises a first storage capacitor;

a gate electrode of the first scanning transistor is configured to receive the first scanning driving signal, a first electrode of the first scanning transistor is configured to receive the first data signal, and a second electrode of the first scanning transistor is connected to a gate electrode of the first driving transistor;

a first electrode of the first driving transistor is configured to receive a first driving voltage for generating the first driving current, and a second electrode of the first driving transistor is connected to a first electrode of the first sensing transistor;

a gate electrode of the first sensing transistor is configured to receive the first sensing driving signal, and a second electrode of the first sensing transistor is configured to receive the first reference voltage signal or output the first sensing voltage signal; and a first electrode of the first storage capacitor is connected to a gate electrode of the first driving transistor, and a second electrode of the first storage capacitor is connected to the second electrode of the first driving transistor.

8. The electronic panel according to claim 1, further comprising a plurality of data lines and a plurality of sensing lines; wherein the first pixel driving circuit and the second pixel driving circuit which are in each subpixel unit group are connected to the same data line among the plurality of data lines;

the first sensing circuit and the second sensing circuit which are in each subpixel unit group are connected to the same sensing line among the plurality of sensing lines.

9. The electronic panel according to claim 1, further comprising 2N+2 gate lines arranged in sequence; wherein the 2N+2 gate lines are respectively connected to the N+1 first output terminals of the gate driving circuit and the N+1 second output terminals of the gate driving circuit in a one-to-one manner;

the first pixel driving circuit in the subpixel unit group of the nth row is connected to the first output terminal in the nth output terminal group of the gate driving circuit through a (2n−1)th gate line among the 2N+2 gate lines;

the second pixel driving circuit in the subpixel unit group of the nth row is connected to the second output terminal in the nth output terminal group of the gate driving circuit through a (2n)th gate line among the 2N+2 gate lines;

the first sensing circuit in the subpixel unit group of the nth row is connected to the first output terminal in the (n+1)th output terminal group of the gate driving circuit through a (2n+1)th gate line among the 2N+2 gate lines;

the second sensing circuit in the subpixel unit group of the nth row is connected to the second output terminal in the (n+1)th output terminal group of the gate driving circuit through a (2n+2)th gate line among the 2N+2 gate lines.

10. The electronic panel according to claim 1, wherein the gate driving circuit comprises a plurality of shift register units which are cascaded, and the shift register unit comprises a first sub-unit, a second sub-unit and a blanking input sub-unit;

the first sub-unit comprises a first input circuit and a first output circuit, the first input circuit is configured to control a level of a first node in response to a first input signal, and the first output circuit is configured to output a shift signal, a first output signal and a third output signal under control of the level of the first node;

the second sub-unit comprises a second input circuit and a second output circuit, the second input circuit is configured to control a level of a second node in response to the first input signal, and the second output circuit is configured to output a second output signal and a fourth output signal under control of the level of the second node; and the blanking input sub-unit is connected to the first node and the second node, and is configured to receive a selection control signal and control the level of the first node and the level of the second node.

11. The electronic panel according to claim 10, wherein the blanking input sub-unit comprises a selection control circuit, a third input circuit, a first transmission circuit and a second transmission circuit, wherein the selection control circuit is configured to control a level of a third node by using a second input signal in response to the selection control signal and maintain the level of the third node;

the third input circuit is configured to control a level of a fourth node under control of the level of the third node;

the first transmission circuit is electrically connected to the first node and the fourth node, and is configured to control the level of the first node under control of the level of the fourth node or under control of a first transmission signal; and the second transmission circuit is electrically connected to the second node and the fourth node, and is configured to control the level of the second node under control of the level of the fourth node or under control of a second transmission signal.

12. The electronic panel according to claim 10, wherein the first sub-unit further comprises a first control circuit, a first reset circuit, a second reset circuit, a shift signal output terminal, a first output signal terminal and a third output signal terminal; the second sub-unit further comprises a second control circuit, a third reset circuit, a fourth reset circuit, a second output signal terminal and a fourth output signal terminal;

the shift signal output terminal is configured to output the shift signal, the first output signal terminal is configured to output the first output signal, the third output signal terminal is configured to output the third output signal, the second output signal terminal is configured to output the second output signal, and the fourth output signal terminal is configured to output the fourth output signal;

the first control circuit is configured to control a level of a fifth node under control of both the level of the first node and a second voltage;

the first reset circuit is configured to reset the first node, the shift signal output terminal, the first output signal terminal and the third output signal terminal under control of the level of the fifth node;

the second reset circuit is configured to reset the first node, the shift signal output terminal, the first output signal terminal and the third output signal terminal under control of a level of a sixth node;

the second control circuit is configured to control the level of the sixth node under control of the level of the second node and a third voltage;

the third reset circuit is configured to reset the second node, the second output signal terminal and the fourth output signal terminal under control of the level of the sixth node; and the fourth reset circuit is configured to reset the second node, the second output signal terminal and the fourth output signal terminal under control of the level of the fifth node.

13. The electronic panel according to claim 12, wherein the blanking input sub-unit further comprises a common reset circuit;

the common reset circuit is electrically connected to the fourth node, the fifth node and the sixth node, and is configured to reset the fourth node under control of the level of the fifth node or the level of the sixth node.

14. The electronic panel according to claim 12 or 13, wherein the first sub-unit further comprises a third control circuit and a fourth control circuit, the third control circuit is configured to control the level of the fifth node in response to a first clock signal, and the fourth control circuit is configured to control the level of the fifth node in response to the first input signal; and the second sub-unit further comprises a fifth control circuit and a sixth control circuit, the fifth control circuit is configured to control the level of the sixth node in response to the first clock signal, and the sixth control circuit is configured to control the level of the sixth node in response to the first input signal.

15. The electronic panel according to claim 12, wherein the electronic panel is a display panel;

the first sub-unit further comprises a fifth reset circuit and a sixth reset circuit, the fifth reset circuit is configured to reset the first node in response to a display reset signal, and the sixth reset circuit is configured to reset the first node in response to a global reset signal; and the second sub-unit further comprises a seventh reset circuit and an eighth reset circuit, the seventh reset circuit is configured to reset the second node in response to the display reset signal, and the eighth reset circuit is configured to reset the second node in response to the global reset signal.

16. The electronic panel according to claim 15, wherein the shift register unit further comprises a common electric-leakage prevention circuit, a first electric-leakage prevention circuit and a second electric-leakage prevention circuit;

the common electric-leakage prevention circuit is electrically connected to the first node and a seventh node, and is configured to control a level of the seventh node under control of the level of the first node;

the first electric-leakage prevention circuit is electrically connected to the seventh node, the first reset circuit, the second reset circuit, the fifth reset circuit and the sixth reset circuit, and is configured to prevent electric leakage at the first node under control of the level of the seventh node; and the second electric-leakage prevention circuit is electrically connected to the seventh node, the third reset circuit, the fourth reset circuit, the seventh reset circuit and the eighth reset circuit, and is configured to prevent electric leakage at the second node under control of the level of the seventh node.

17. A display device, comprising the electronic panel according to claim 1.

18. A driving method of the electronic panel according to claim 1, wherein a period for one frame comprises a display period and a blanking period, wherein the electronic panel is a display panel;

during the display period, in each subpixel unit group, the first pixel driving circuit drives the first light emitter unit to emit light in a first stage, and the second pixel driving circuit drives the second light emitter unit to emit light in a second stage;

wherein the first stage is different from the second stage.

19. The driving method according to claim 18, wherein during the blanking period, an i-th row of subpixel unit groups is randomly selected from the N rows of subpixel unit groups, so that the first sensing circuit in each subpixel unit group of the i-th row or the second sensing circuit in each subpixel unit group of the i-th row performs sensing;

wherein $1 \leq i \leq N$.

20. The driving method according to claim 18, wherein during the blanking period, an i-th row of subpixel unit groups is randomly selected from the N rows of subpixel unit groups, so that the first sensing circuit in each subpixel unit group of the i-th row and the second sensing circuit in each subpixel unit group of the i-th row perform sensing;

wherein $1 \leq i \leq N$.

* * * * *